US006519430B2

(12) United States Patent
Higeta et al.

(10) Patent No.: US 6,519,430 B2
(45) Date of Patent: Feb. 11, 2003

(54) REMANUFACTURING METHOD COMPRISING DEVELOPING BLADE DISMOUNTING AND MOUNTING STEPS

(75) Inventors: Akira Higeta, Funabashi (JP); Satoshi Yasuda, Tokyo (JP); Yoshiyuki Kakumi, Tuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 09/888,402

(22) Filed: Jun. 26, 2001

(65) Prior Publication Data

US 2002/0028087 A1 Mar. 7, 2002

(30) Foreign Application Priority Data

Jun. 28, 2000 (JP) ..... 2000-194585

(51) Int. Cl.[7] ..... G03G 15/00; G03G 15/04

(52) U.S. Cl. ..... 399/109; 399/111; 399/113; 399/274; 399/284; 399/115

(58) Field of Search ..... 399/109, 110, 399/111, 113, 114, 119, 274, 284

(56) References Cited

U.S. PATENT DOCUMENTS

| | | | | |
|---|---|---|---|---|
| 4,851,960 A | | 7/1989 | Nakamura et al. | 361/225 |
| 5,331,373 A | | 7/1994 | Nomura et al. | |
| 5,452,056 A | | 9/1995 | Nomura et al. | |
| 5,485,249 A | | 1/1996 | Higeta et al. | |
| 5,585,889 A | | 12/1996 | Shishido et al. | |
| 5,592,268 A | * | 1/1997 | Uehara et al. | 399/276 |
| 5,740,499 A | | 4/1998 | Higeta et al. | 399/105 |
| 5,809,374 A | | 9/1998 | Tsuda et al. | 399/111 |
| 5,890,036 A | * | 3/1999 | Karakama et al. | 399/111 |
| 6,101,348 A | | 8/2000 | Nonaka et al. | 399/103 |
| 6,185,390 B1 | | 2/2001 | Higeta et al. | 399/90 |
| 6,212,343 B1 | * | 4/2001 | Hosokawa et al. | 399/102 |

FOREIGN PATENT DOCUMENTS

| | | |
|---|---|---|
| JP | 63-149669 | 6/1988 |
| JP | 8-166751 | 6/1996 |
| JP | 8-305258 | 11/1996 |

* cited by examiner

*Primary Examiner*—Hoang Ngo
(74) *Attorney, Agent, or Firm*—Fitzpatrick, Cella, Harper & Scinto

(57) ABSTRACT

A remanufacturing method for a process cartridge detachably mountable to a main assembly of an electrophotographic image forming apparatus includes the steps of separating first and second units of the cartridge, dismounting from the second unit a developing blade mounted to the second unit, filling developer into a developer accommodating portion of the second unit through a developer supply opening for supplying a developer roller of the second unit from the developer accommodating portion, mounting the dismounted developing blade to the second unit with a facing orientation opposite from a facing orientation before the developing blade dismounting step, and coupling the first and second units.

52 Claims, 33 Drawing Sheets

REMANUFACTURING METHOD COMPRISING DEVELOPING BLADE DISMOUNTING AND MOUNTING STEPS

FIELD OF THE INVENTION AND RELATED ART

The present invention relates to a recycling method for a process cartridge. The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Furthermore, the process cartridge may contain at least the electrophotographic photosensitive drum and the developing means.

Examples of the image forming apparatus include an electrophotographic copying machine, an electrophotographic printer (a laser beam printer or LED printer mountable), a facsimile machine, a word processor and the like.

Heretofore, in an electrophotographic image forming apparatus using the electrophotographic image process, a process cartridge type in which the electrophotographic photosensitive member and process means actable on the electrophotographic photosensitive member are integrally contained in a cartridge, which is detachably mountable to the main assembly of the image forming apparatus. In such a process cartridge type, the maintenance of the apparatus can be carried out by the users without the serviceman, and therefore, the operativity can be improved significantly. For this reason, it is widely used in the image forming apparatus.

Such a process cartridge forms an image on recording material with a developer. Therefore, the developer is consumed in accordance with image forming operations. When the developer is consumed up to such an extent that user is not satisfied with the image quality, the commercial value of the process cartridge is lost.

It is desired that such a used process cartridge are is given the commercial value, again by remanufacturing the process cartridge through easy method.

SUMMARY OF THE INVENTION

Accordingly, it is a principal object of the present invention to provide a simple remanufacturing method for a process cartridge.

It is another object of the present invention to provide a remanufacturing method of a process cartridge wherein the process cartridge with which the developer is consumed to such an extent that user is not satisfied with the image quality is recycled to be given the commercial value.

According to an aspect of the present invention, there is provided a remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step of separating the first unit and the second unit from each other;

(B) a developing blade dismounting step of dismounting from the second unit a developing blade, mounted into the second unit, for regulating an amount of the developer deposited on the developing roller;

(C) a developer filling step of filling the developer into the developer accommodating portion through a developer supply opening for supplying the developing roller from the developer accommodating portion;

(D) a developing blade mounting step of mounting the developing blade dismounted in said developing blade dismounting step to the second unit with a facing orientation which is opposite from a facing orientation before said developing blade dismounting step; and (E) a unit coupling step of coupling the first unit and the second unit.

According to another aspect of the present invention, there is provided a remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step for separating the first unit and the second unit from each other;

(B) a developing blade dismounting step of dismounting from the second unit a developing blade, mounted into the second unit, for regulating an amount of the developer deposited on the developing roller;

(C) a developing blade mounting step of mounting the developing blade dismounted in said developing blade dismounting step to the second unit with a facing orientation which is opposite from a facing orientation before said developing blade dismounting step;

(D) a developer filling step of filling the developer into the developer accommodating portion through a developer filling port provided in the developer accommodating portion; and (E) a unit coupling step of coupling the first unit and the second unit.

According to a further object of the present invention, there is provided a remanufacturing method for a process cartridge detachably mountable to a main assembly of an electrophotographic image forming apparatus, said process cartridge including a first unit supporting an electrophotographic photosensitive drum and a cleaning blade for removing a developer remaining on the electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step for separating the first unit and the second unit from each other;

(B) a drum replacing process of replacing the electrophotographic photosensitive drum mounted to said first unit with a new electrophotographic photosensitive drum;

(C) a developing roller dismounting step of dismounting the developing roller mounted to the second unit;

(D) a developing blade dismounting step of dismounting a developing blade, mounted to the second unit, for regulating an amount of the developer by elastically contacting a part thereof to the developing roller, from the second unit;

(E) an elastic member mounting step of mounting an elastic member for applying a contact pressure to the developing roller from the developing blade which has been dismounted from the second unit and which is to be reused;

(F) a developer filling step of filling the developer into the developer accommodating portion through a developer supply opening for supplying the developing roller from the developer accommodating portion;

(G) a developing blade mounting step of mounting the developing blade dismounted in said developing blade dismounting step to the second unit with a facing orientation which is opposite from a facing orientation before said developing blade dismounting step;

(H) a developing roller mounting step of mounting the developing roller to the second unit; and (I) a unit coupling process of coupling the first unit and the second unit.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

The drawings are all related with Embodiments of the present invention.

DESCRIPTION OF THE PREFERRED EMBODIMENTS

The description will be made as to the preferred embodiment of the present invention in conjunction with the company drawings. In the specification, the lateral direction or widthwise direction is the direction in which the process cartridge B is mounted to the main assembly 14 of the apparatus, and is the same as the feeding direction of the recording material. The longitudinal direction of the process cartridge B is the direction crossing (substantially perpendicular) with the direction in which the process cartridge is mounted to or demounted from the main assembly 14 of the apparatus, and it is parallel with the surface of the recording material and is crossing (substantially perpendicular) with the feeding direction of the recording material. With respect to the process cartridge, the left and right is those as seen in the feeding direction of the recording material and from the top side.

Figure 1:
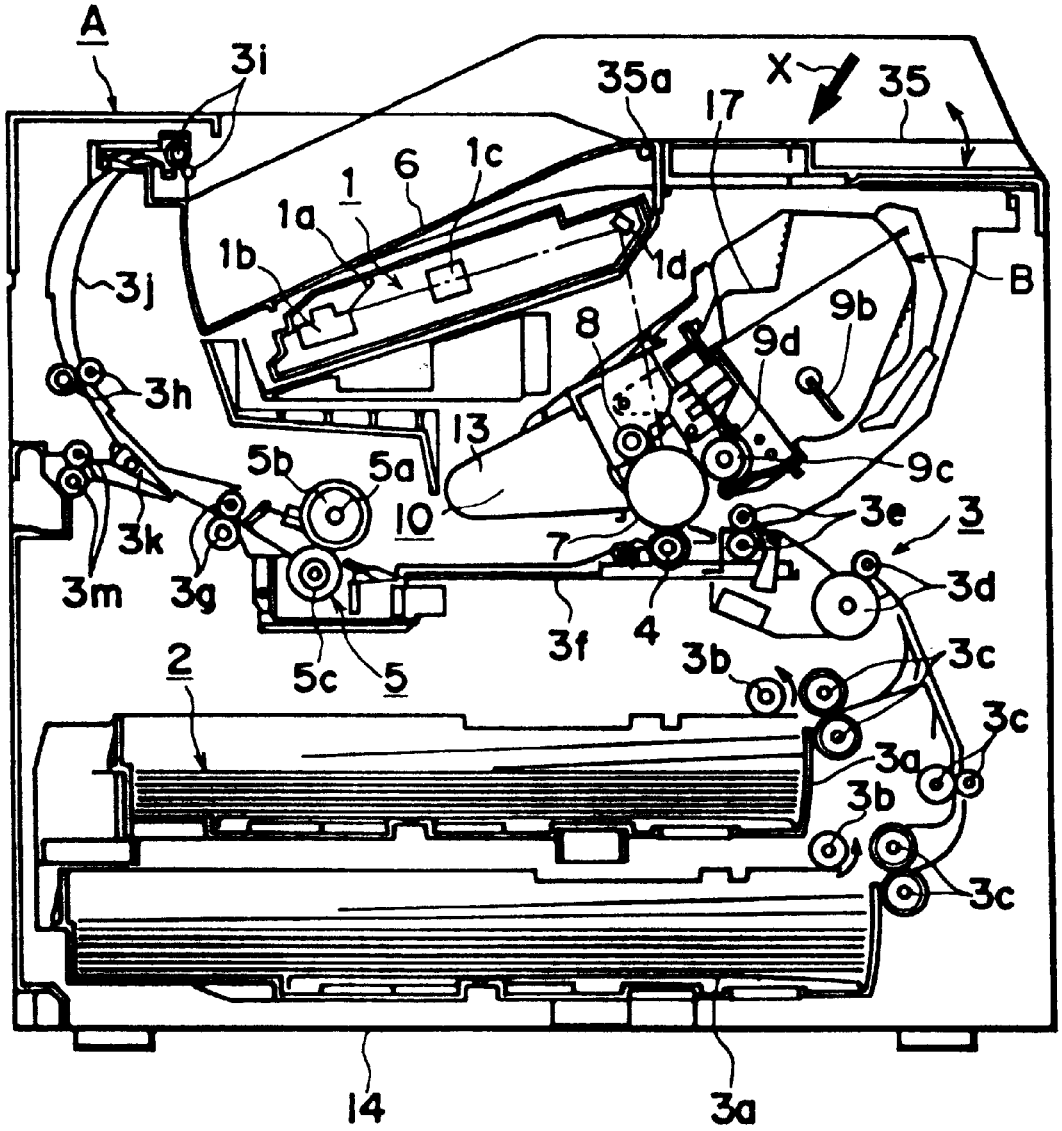
FIG. 1 is a longitudinal sectional view of an electrophotographic image forming apparatus.
Figure 2:
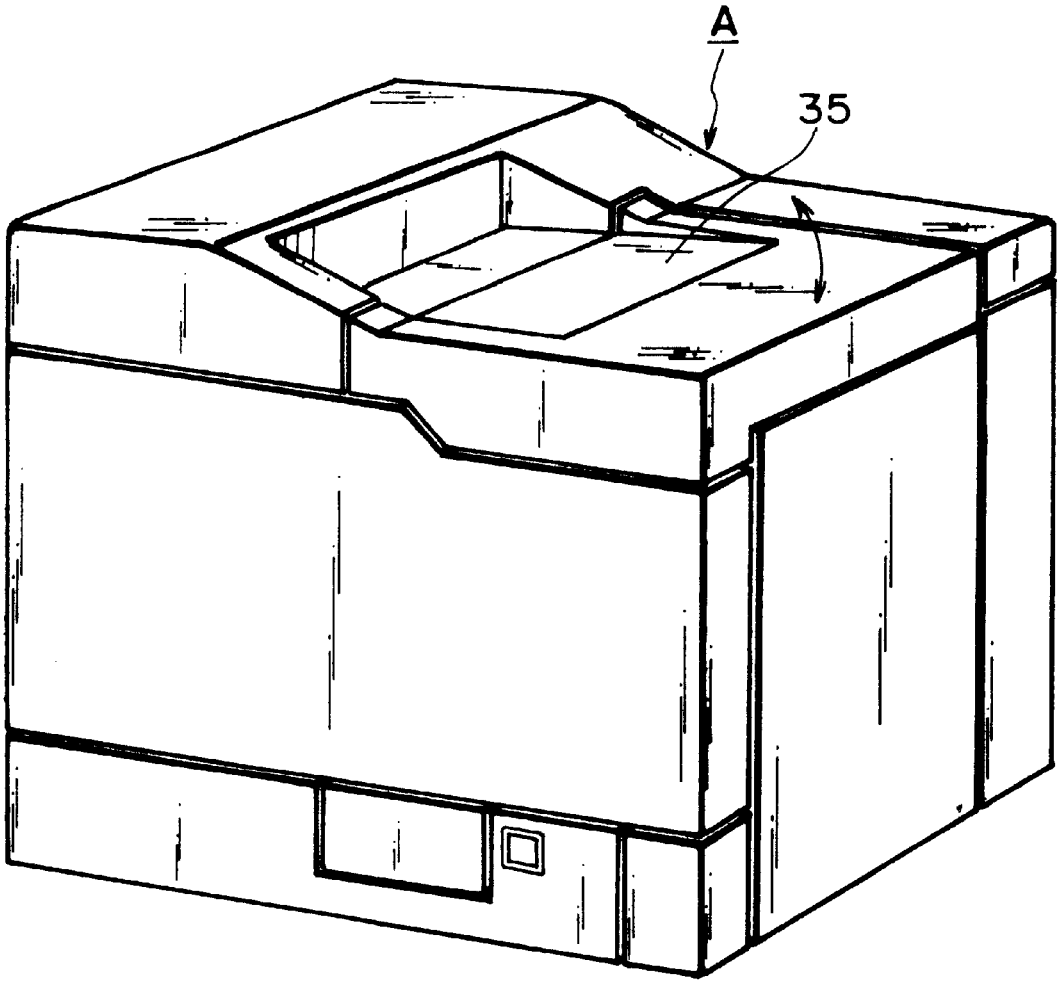
FIG. 2 is a perspective view of an outer appearance of the apparatus of the FIG. 1.
Figure 3:
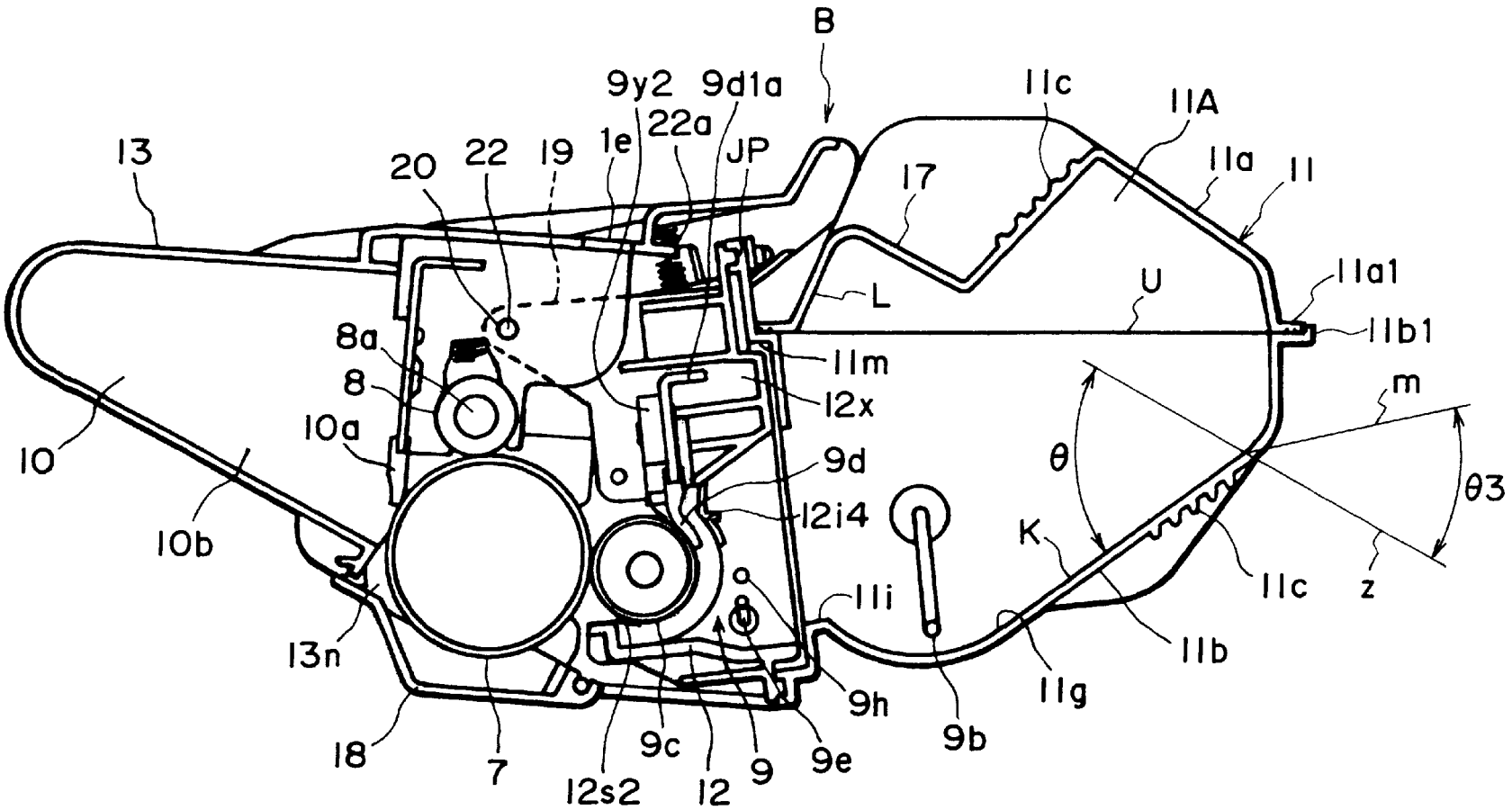
FIG. 3 is a longitudinal sectional view of a process cartridge.
Figure 4:
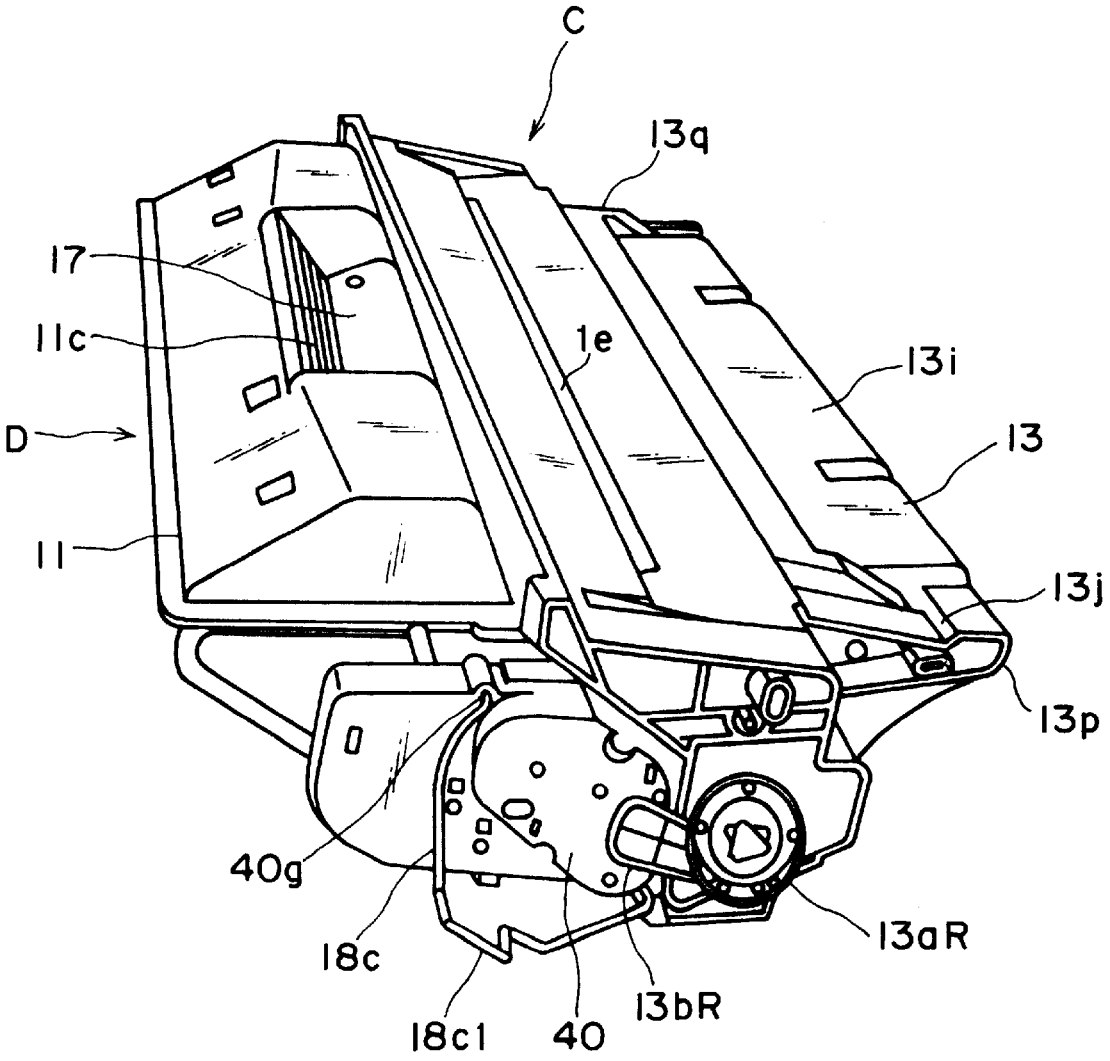
FIG. 4 is a perspective view of an outer appearance of the process cartridge of FIG. 3 as seen from upper right.
Figure 5:
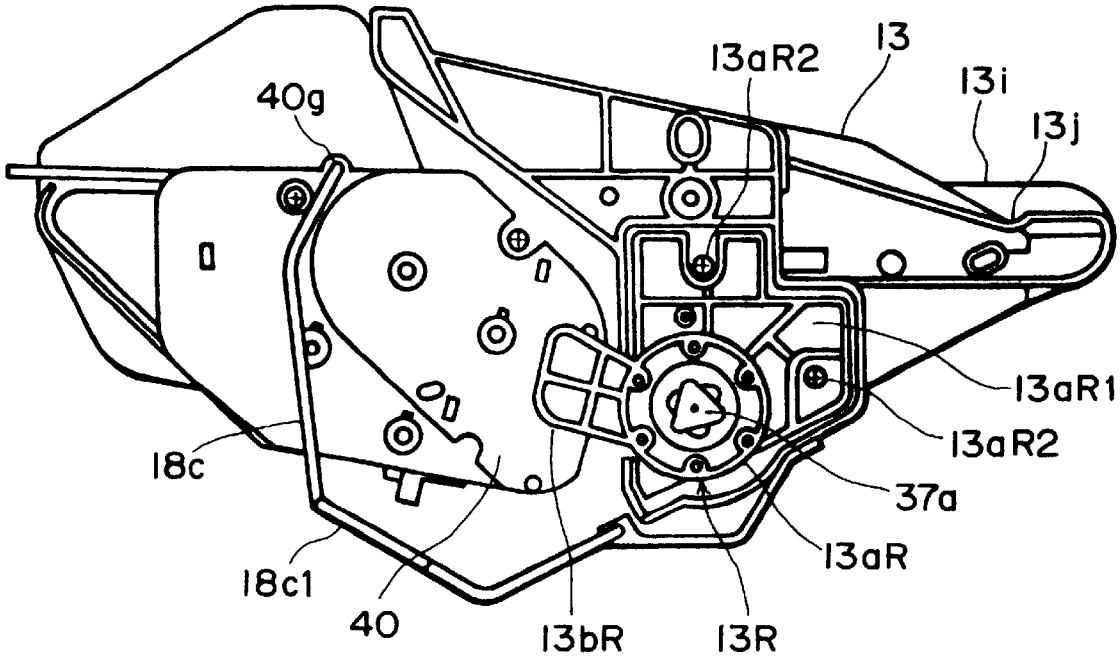
FIG. 5 is a right side view of the process cartridge shown in FIG. 3.
Figure 6:
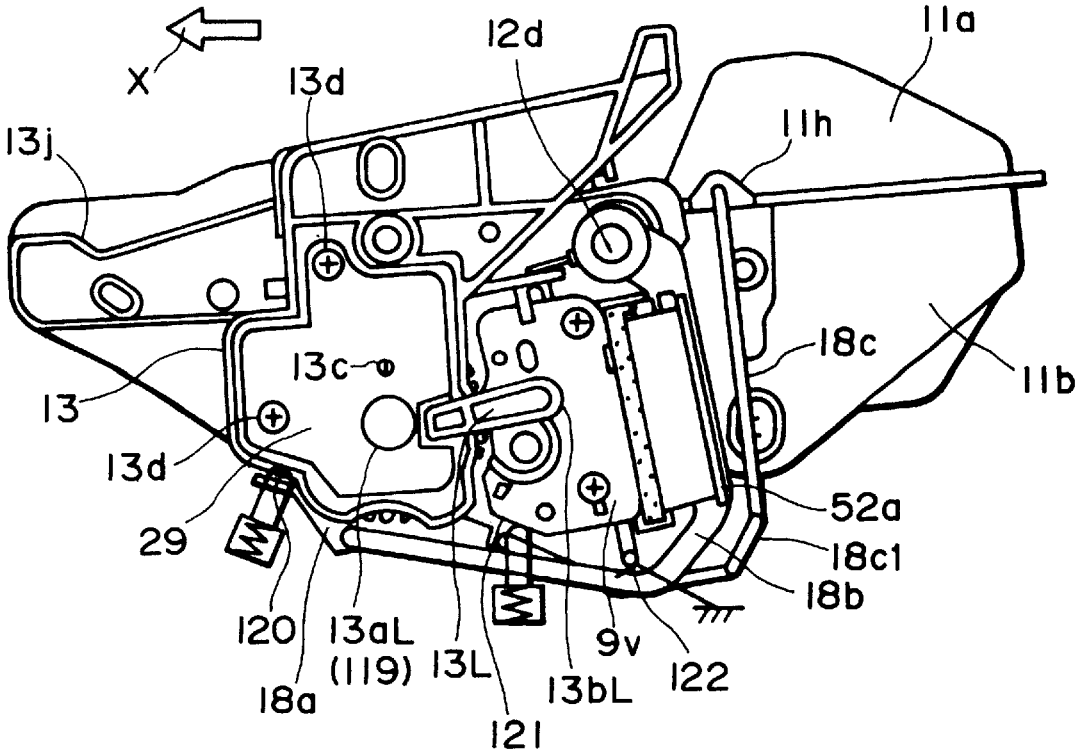
FIG. 6 is a left side view of the process cartridge shown in FIG. 3.
Figure 7:
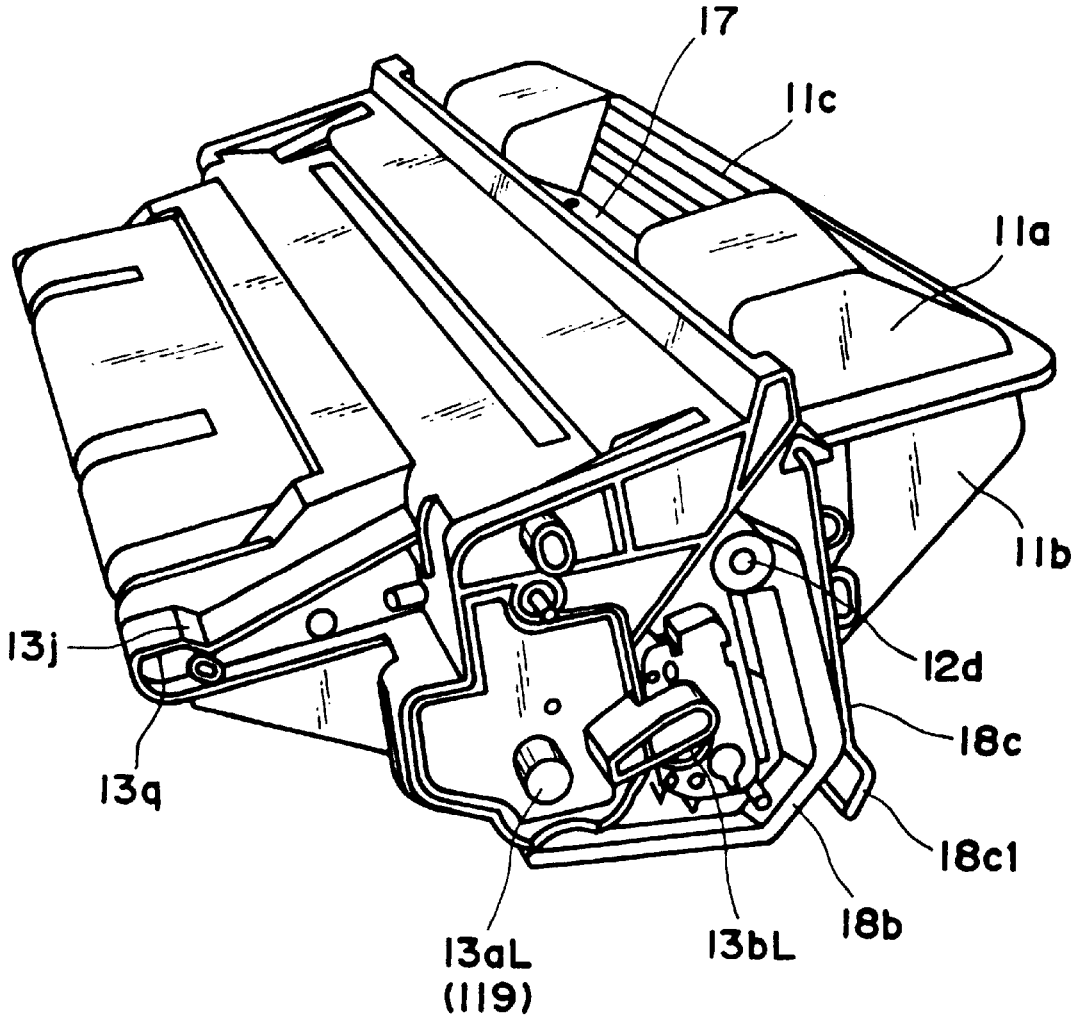
FIG. 7 is a perspective view of an outer appearance of the process cartridge as shown in FIG. 3, as seen from upper left.
Figure 8:
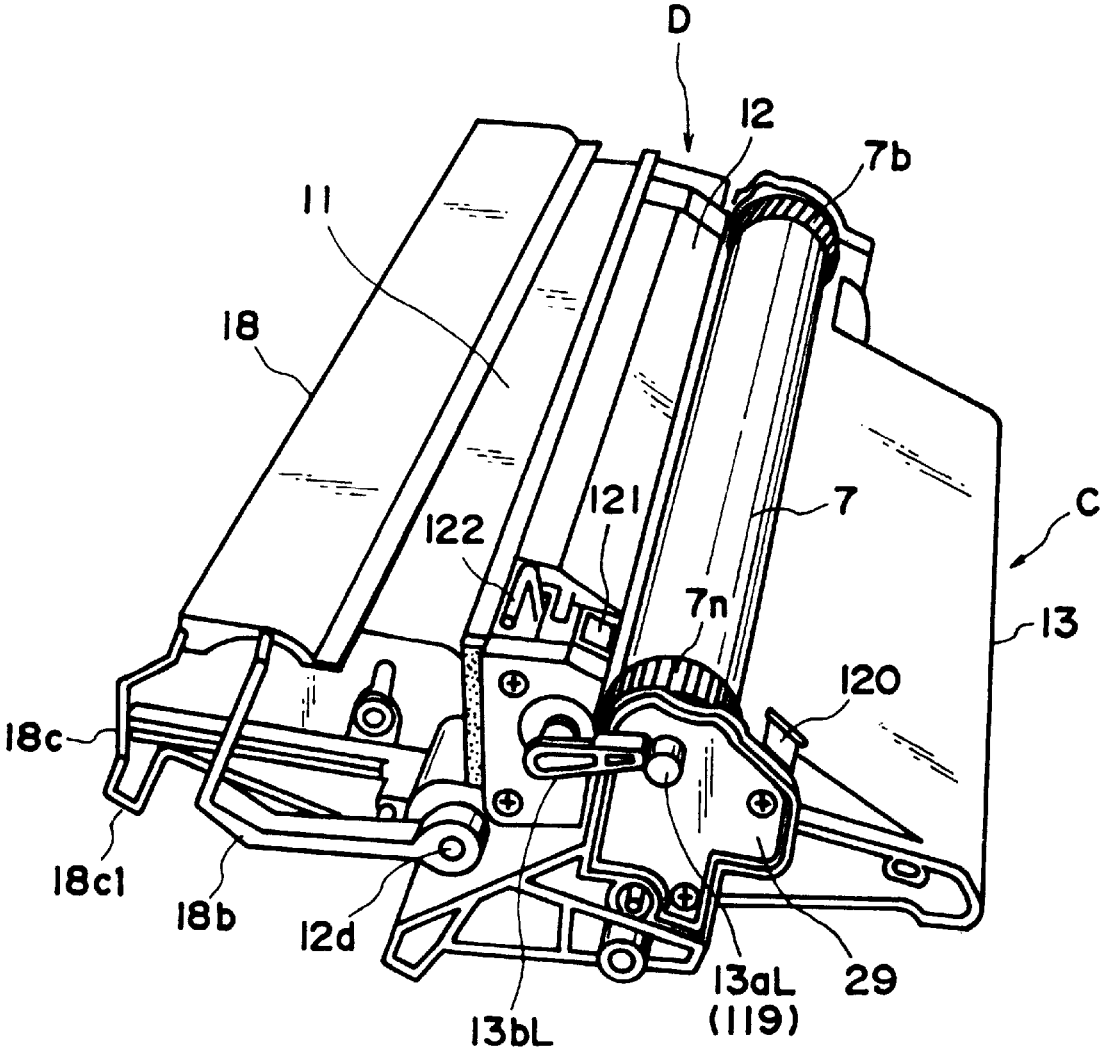
FIG. 8 is a perspective view of an outer appearance, illustrating a bottom left portion of the process cartridge shown in FIG. 3.

FIG. 1 illustrates a structure of an electrophotographic image forming apparatus (laser beam printer) according to an embodiment of the present invention, and FIG. 2 is a perspective view of an outer appearance. FIGS. 3–8 show a process cartridge according to an embodiment of the present invention. FIG. 3 is a sectional view of a process cartridge; FIG. 4 is a perspective view of an outer appearance thereof; FIG. 6 is a left side view; FIG. 7 is a perspective view as seen from a topside; FIG. 8 is a perspective view as seen from the bottom side. In the specification, the upper or top side or surface of the process cartridge B is the side which takes the upper position when the process cartridge B is mounted to the main assembly 14 of the apparatus, and the bottle more lower surface or side is the side which takes the lower position when the process cartridges mounted to the main assembly of the apparatus.

Referring to FIGS. 1 and 2, the description will be made as to an electrophotographic image forming apparatus in the form of a laser beam printer A in this embodiment. The laser beam printer A, as shown in FIG. 1, forms images on the recording materials such as recording paper, OHP sheet, textile or the like through an electrophotographic image forming process. In the image forming process, a visualized toner image is formed on an electrophotographic photosensitive member in the form of a drum. More particularly, the photosensitive drum is electrically charged by charging means, and the photosensitive drum is exposed to a laser beam which has been modulated in accordance with the image information to be recorded, through optical means, so that electrostatic latent image is formed on the photosensitive drum in accordance with the image information. The latent image is visualized by developing means into a toner image. In synchronism with the formation of the toner image, a recording material 2 contained in a sheet feeding cassette 3*a* is fed out by means of a pick-up roller 3*b*, a couple of feeding rollers 3*c*, 3*d* and a couple of registration rollers 3*e*. Then, the toner image formed on the photosensitive drum 7 contained in the process cartridge B is transferred onto the recording material 2 by application of a voltage to the transferring means in the form of a transfer roller 4. The recording material 2 having received in the toner image is fed to fixing means 5 along a feeding guide 3*f*. The fixing means 5 comprises a driving roller 5*c* and a fixing roller 5*b* containing a heater 5*a* therein.

The toner image on the recording material 2 is fixed by application of heat and pressure. The recording material 2 is further fed by discharging rollers 3*g*, 3*h*, 3*i* to a discharging tray 6 through a reverse path 3*j*. The discharging tray 6 is provided on the top side of the main assembly 14 of the apparatus. Alternatively, a swingable flapper 3*k* may be operated to discharge the recording material 2 by the discharging rollers 3*m* not through the reverse path 3*j*. In this embodiment, the feeding means 3 is constituted by the pick-up roller 3*b*, the pair of feeding rollers 3*c*, 3*d*, the pair of registration rollers 3*e*, the feeding guide 3*f*, the pairs of discharging rollers 3*g*, 3*h*, 3*i* and the pair of discharging rollers.

On the other hand, the process cartridge B, as shown in FIGS. 3–8, includes the photosensitive drum 7 having a photosensitive layer 7*e* (FIG. 11), and the surface thereof is uniformly charged by application of the postage to the charging means in the form of a charging roller 8. Subsequently, the laser beam modulated in accordance with the image information is projected onto the photosensitive drum 7 through the opening 1*e* from the optical system, so that latent image is formed. Then, the latent image is developed with the toner by the developing means 9. The charging roller 8 is provide contacted to the photosensitive drum 7 to electrically charge it. The charging roller 8 is driven by the photosensitive drum 7. The developing means 9 supplies the toner to a developing zone of the photosensitive drum 7 to develop the latent image formed on the photosensitive drum 7. The optical system 1 comprises a laser diode 1*a*, a polygonal mirror 1*b*, lenses 1*c*, and a reflection mirror 1*d*. Here, the developing means 9 feeds the toner from the toner container 11A toward the developing roller 9*c* by rotation of the toner feeding member 9*b*. The developing roller 9*c* containing therein a stationary magnet is rotated, and a layer of toner triboelectrically charged by a developing blade 9*d* is formed on the surface of the developing roller 9*c*, and the toner is carried to the developing zone. The toner is transferred onto the photosensitive drum 7 in accordance with the latent image, thus visualizing the latent image into a toner image. Here, the developing blade 9*d* functions to regulate the amount of the toner applied on the peripheral surface of the developing roller 9*c* and to apply the trip electric charge to the toner particles. A rotatable toner stirring member 9*e* is provided adjacent to the developing roller 9*c* to circulate the toner in the developer chamber. The transfer roller 4 is supplied with a voltage having the polarity opposite from the polarity of the toner image, by which the toner image formed on the photosensitive drum 7 is transferred onto the recording material 2. Thereafter, the residual toner remaining on the photosensitive drum 7 is removed by cleaning means 10. The cleaning means 10 comprises an elastic cleaning blade 10*a* contacted to the photosensitive drum 7 and functions to scrape the residual toner off the photosensitive drum 7 and collect the scrape toner in a removed toner container 10*b*. The process cartridge B comprises a toner frame 11 having a toner container (toner accommodating portion) 11A for containing the tone, and a developing device frame 12 supporting developing means 9 having the developing roller 9*c* and so on, the toner frame 11 and the developing device frame 12 being coupled with each other.

In addition, it comprises a cleaning frame 13 containing the photosensitive drum 7, the charging roller 8 and the cleaning means 10 including the cleaning blade 10*a*. The process cartridge B is detachably mountable to the main assembly 14 of the image forming apparatus by the user. The process cartridge B is provided with an exposure opening 1*e* for permitting exposure of the photosensitive drum 7 to the image information light and with an opening for facing the photosensitive drum 7 to the recording material 2. More particularly, the exposure opening 1*e* is provided in the cleaning frame 13, and the transfer opening 13*n* is provided between the developing device frame 12 and the cleaning frame 13.

Housing of Process Cartridge B

The description will be made as to the structure of the process cartridge B according to an embodiment of the present invention.

Figure 19:
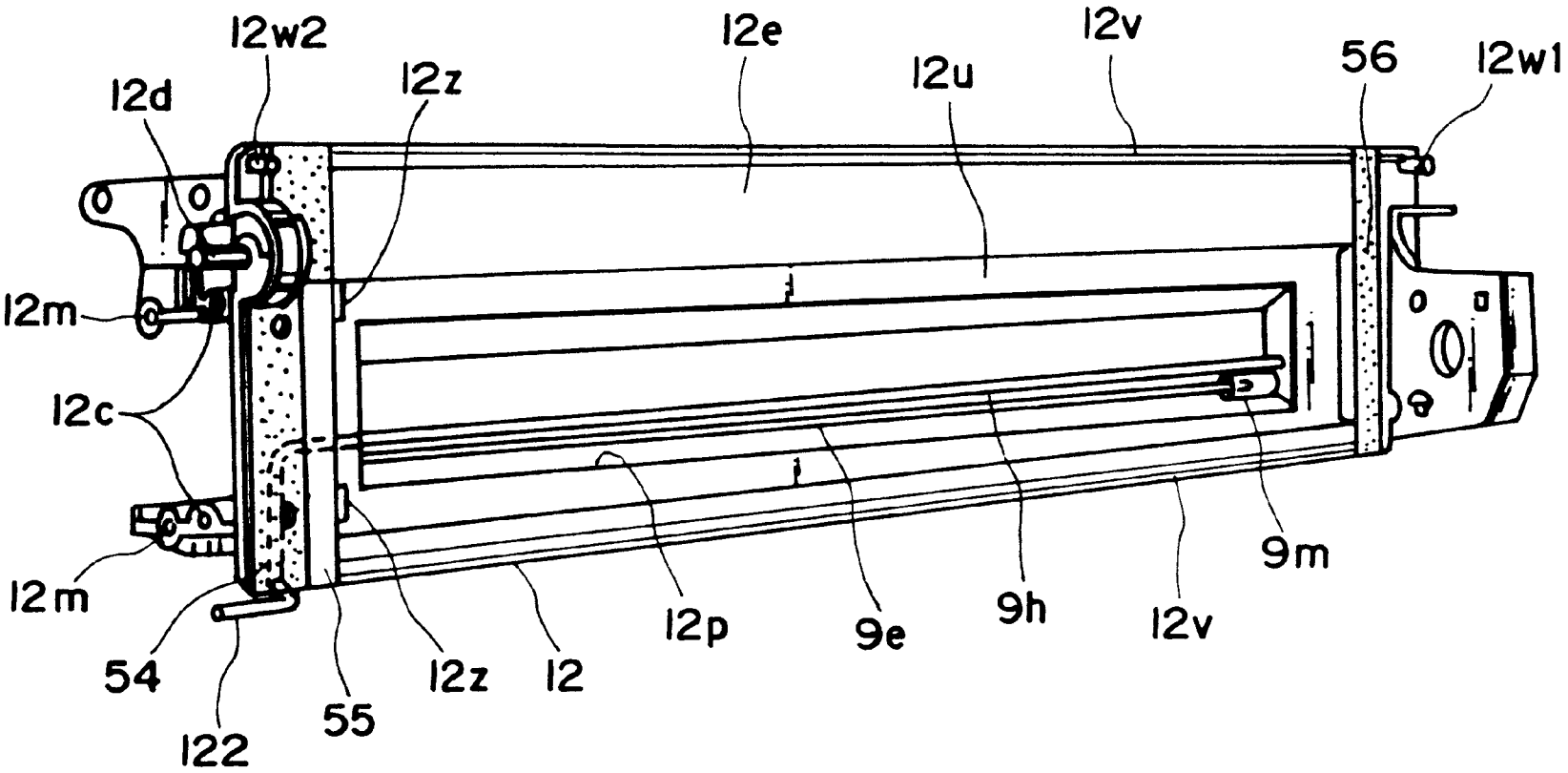
FIG. 19 is a perspective view of a developing device frame.
Figure 20:
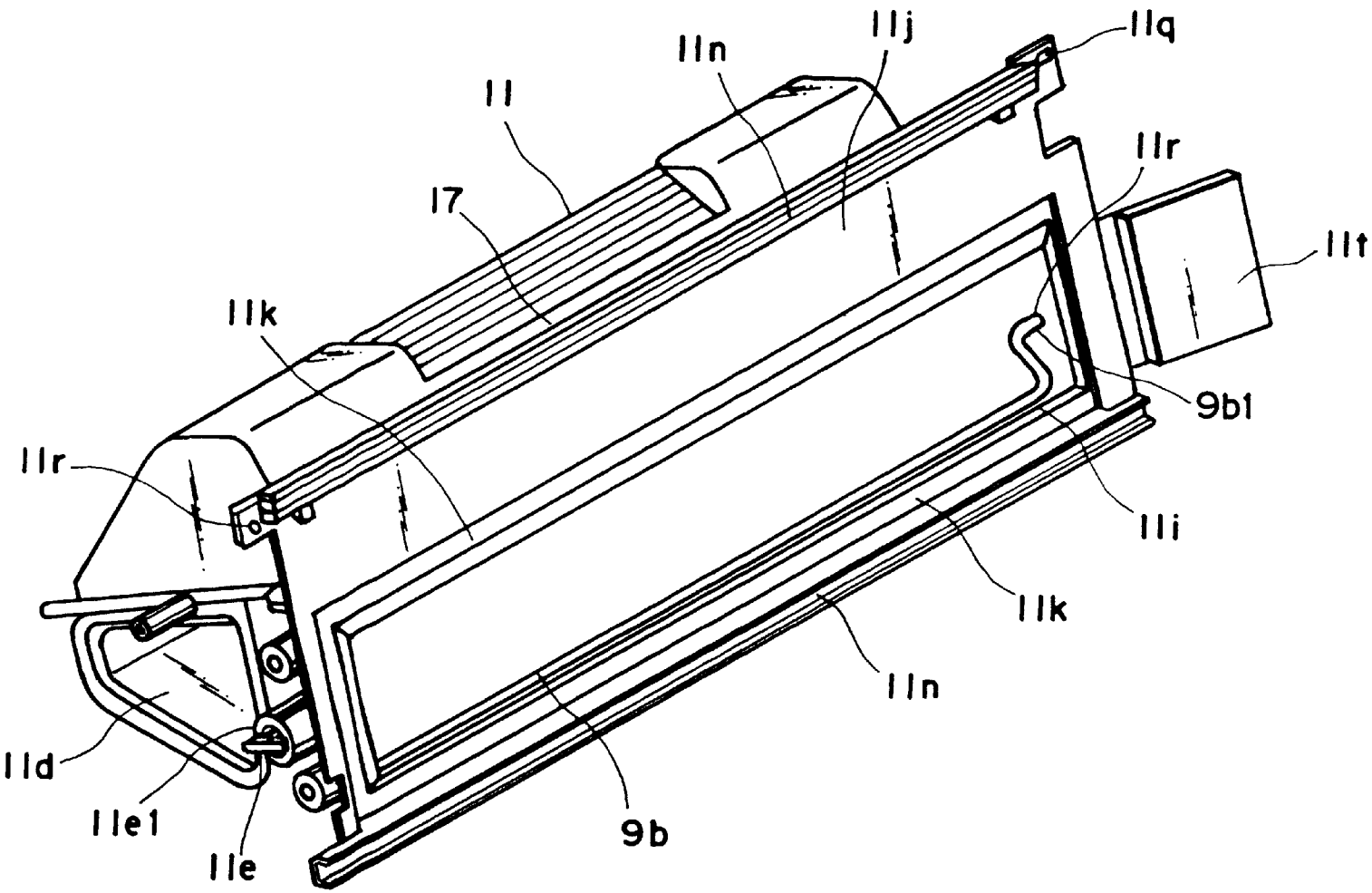
FIG. 20 is a perspective view of a toner frame.

The process cartridge B of this embodiment comprises the toner frame 11 and the developing device frame 12 which are coupled with each other, and the cleaning frame 13 is rotatably coupled thereto, by which a housing is constituted. In the housing, there are contained the photosensitive drum 7, the charging roller 8, the developing means 9 and the cleaning means 10, thus constituting a cartridge. The process cartridge B is detachably mounted to the cartridge mounting means provided in the main assembly 14 of the image forming apparatus. The respective frames will be described. As shown in FIGS. 3 and 20, a toner feeding member 9*b* is rotatably amounted to the toner frame 11. To the developing device frame 12, the developing roller 9*c* and the developing blade 9*d* are mounted, and the stirring member 9*e* for circulating that toner in the developer chamber is rotatably mounted adjacent to the developing roller 9*c*. The developing device frame 12, as shown in FIGS. 3 and 19, is provided with an antenna rod 9*h* extended substantially parallel with the developing roller 9*c*, opposed to the developing roller 9*c* in the longitudinal direction. The said toner frame 11 and the developing device frame 12 are welded (ultrasonic welding in this embodiment) into an integral developing unit D (second frame, FIG. 13). The developing unit D is provided with a drum shutter member 18 which is effective to cover the photosensitive drum 7 when the process cartridge B is outside the main assembly 14 of the image forming apparatus to protect the photosensitive drum from foreign matters or from long-term exposure thereof to the light. The drum shutter member 18, as shown in FIG. 6, is provided with a shutter cover 18*a* for closing and opening the opening 13*n* shown in FIG. 3 and links 18*b*, 18*c* supporting the shutter cover 18*a*. As shown in FIGS. 4 and 5, in the upstream side of the shutter cover 18*a* with respect to the feeding direction of the recording material 2 at each of the longitudinal ends thereof, an end of a righthand side link 18*c* is journaled in a hole 40*g* of a development holder 40. As shown in FIG. 6 and 7, an end of a left side link 18*c* is journaled in a boss 11*h* provided in a lower frame 11*b* of the toner frame 11. The other end of each of the links 18*c* is journaled in the upstream side of the shutter cover 18*a* with respect to the mounting direction of the process cartridge B. The link 18*c* is made of metal wire, and the portion journaled in the shutter cover 18*a* is connected between the opposite sides of the process cartridge, by which the left and right links 18*c* are integral with each other. The link 18*b* is provided only on one side of the shutter cover 18*a*, and one and thereof is journaled in the shutter cover 18*a* at a downstream side with respect to the feeding direction of the recording material 2, and the other end is journaled in the dowel 12*d* provided in the developing device frame 12. The link 18*b* is made of a synthetic resin material. The links 18*b*, 18*c* have different lengths, and a quadric link mechanism is constituted by them, the shutter cover 18*a*, the toner frame 11 and the developing device frame 12. A projected portion 18*c*1 projected in the lateral direction is contacted to a fixing member (unshown) provided adjacent and a cartridge mounting space S of the image forming apparatus 14, and by the motion of the process cartridge B, the drum shutter member 18 is driven to open the shutter cover 18*a*. The drum shutter member 18 constituted by the shutter cover 18*a* and the links 18*b*, 18*c* is urged such that shutter cover 18*a* covers the transfer opening 13*n* by a function of a torsion coil spring (not shown) inserted in the dowel 12*d* and having one end engaged with the link 18*b* and the other end engaged with the developing device frame 12.

Figure 12:
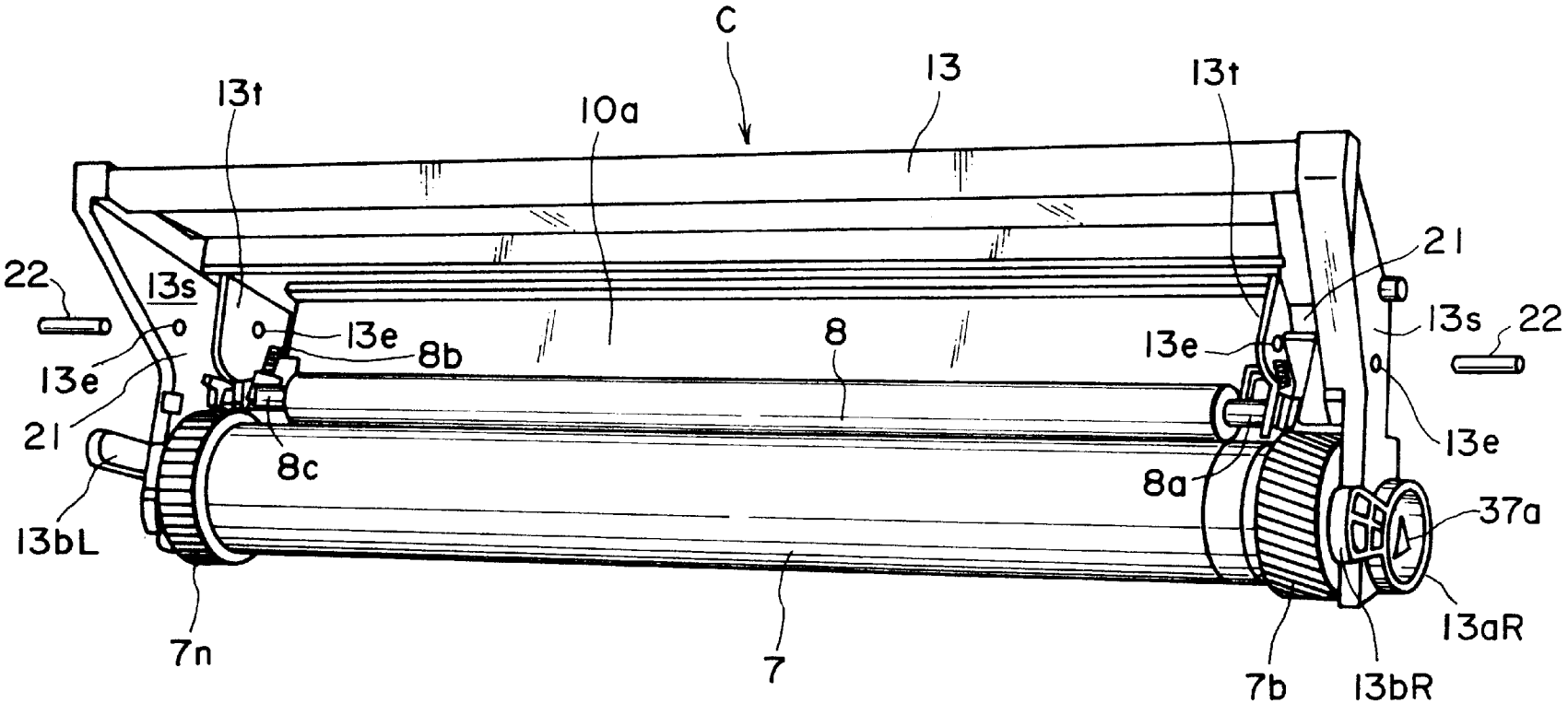
FIG. 12 is a perspective view of a cleaning unit.

As shown in FIGS. 3 and 12, the cleaning frame 13 supports the photosensitive drum 7, the charging roller 8 and the cleaning means 10 to constitute a cleaning unit C (FIG. 12) (first frame).

Figure 13:
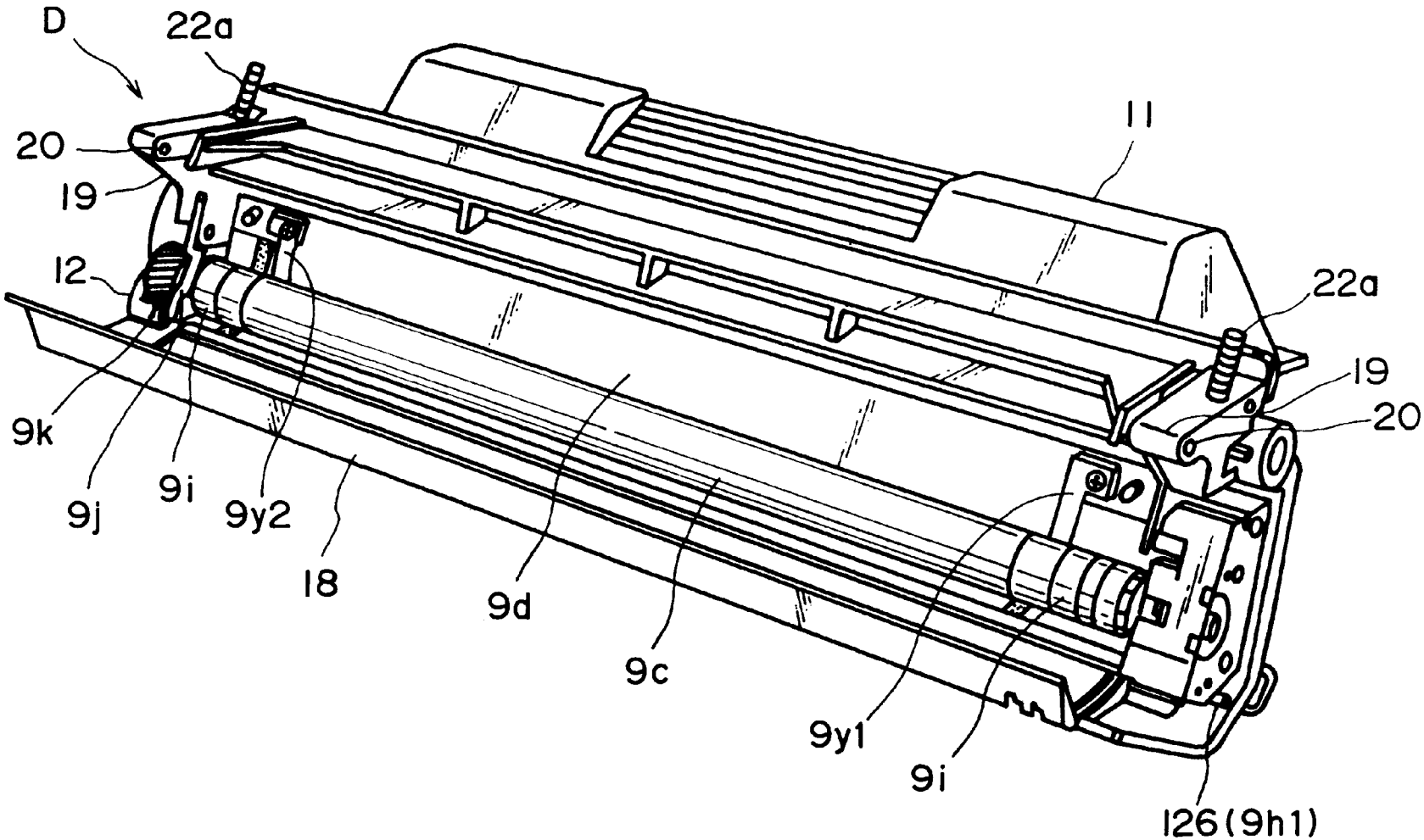
FIG. 13 is a perspective view of a developing unit.

The said developing unit D and the cleaning unit C are coupled with a connecting or coupling member 22 in the form of a pin having a circular cross-section, for relative rotation. As shown in FIG. 13, a free end portion of an arm portion 19 formed at each of longitudinal (the direction of the axis of the developing roller 9*c*) direction of the developing device frame 12, is provided with a round hole 20 extending parallel to the developing roller 9*c* (FIG. 13). On the other hand, at each of the longitudinal ends of the cleaning frame 13, there is provided a recess 21 for receiving the arm portion 19 (FIG. 12). The arm portion 19 is inserted into the recess 21, and the connecting member 22 is press-fitted into the mounting hole 13*e* of the cleaning frame 13, and is engaged into the hole 20 at the end of the arm portion 19, and is further press-fitted into the inside hole 13*e*, by which the developing unit D and the cleaning unit C are coupled for rotation about the connecting member 22. A compression coil spring 22*a* is provided in an unshown dowel projected from a base portion of the arm portion 19 abuts an upper wall of the recess 21 of the cleaning frame 13, so that compression coil spring 22*a* urges the developing device frame 12 downwardly, by which the developing roller 9*c* is assuredly urged against the photosensitive drum 7. The upper wall of the recess 21 of the cleaning frame 13 is inclined such that when the developing unit D and the cleaning unit C are combined with each other, the compression coil spring 22*a* is gradually compressed more. As shown in FIG. 13, a spacer roller 9*i* having a diameter larger than that of the developing roller 9*c* is provided at each of the longitudinal ends of the developing roller 9*c*. The roller 9*i* is urged to the photosensitive drum 7 so that in the photosensitive drum 7 and the developing roller 9*c* are opposed to each other with a predetermined gap therebetween (approx. 300 $\mu$m). Thus, the developing unit D and the cleaning unit C is rotatable relative to each other about the connecting member 22. By the resilient force of the compression coil spring 22*a*, the correct positional relation is established between the peripheral surface of the photosensitive drum 7 and that of the developing roller 9*c*. In this manner, the compression coil spring 22*a* is mounted to the developing device frame 12 at the base portions of the arm portion 19, and therefore, the force of the compression coil spring 22*a* does not influence beyond the base portion of the arm portion 19. The base portion of the arm portion 19 has high strength and rigidity, the accuracy is assured without use of particular reinforcement about the spring seat. The coupling between the cleaning frame 13 and the developing device frame 12 will be described in more detail hereinafter.

{Guiding Means for Process Cartridge B}

Figure 9:
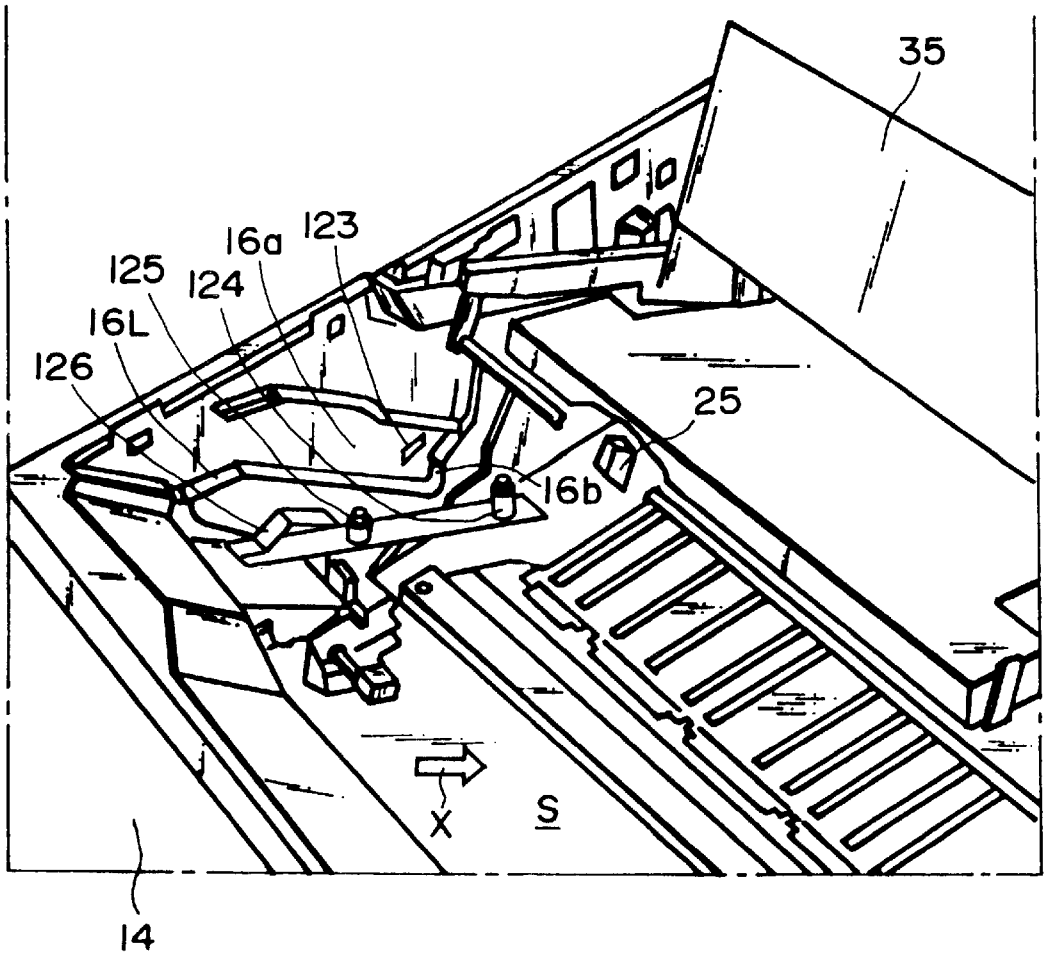
FIG. 9 is a perspective view of an outer appearance of a mounting portion of the main assembly of the apparatus, for the process cartridge.
Figure 10:
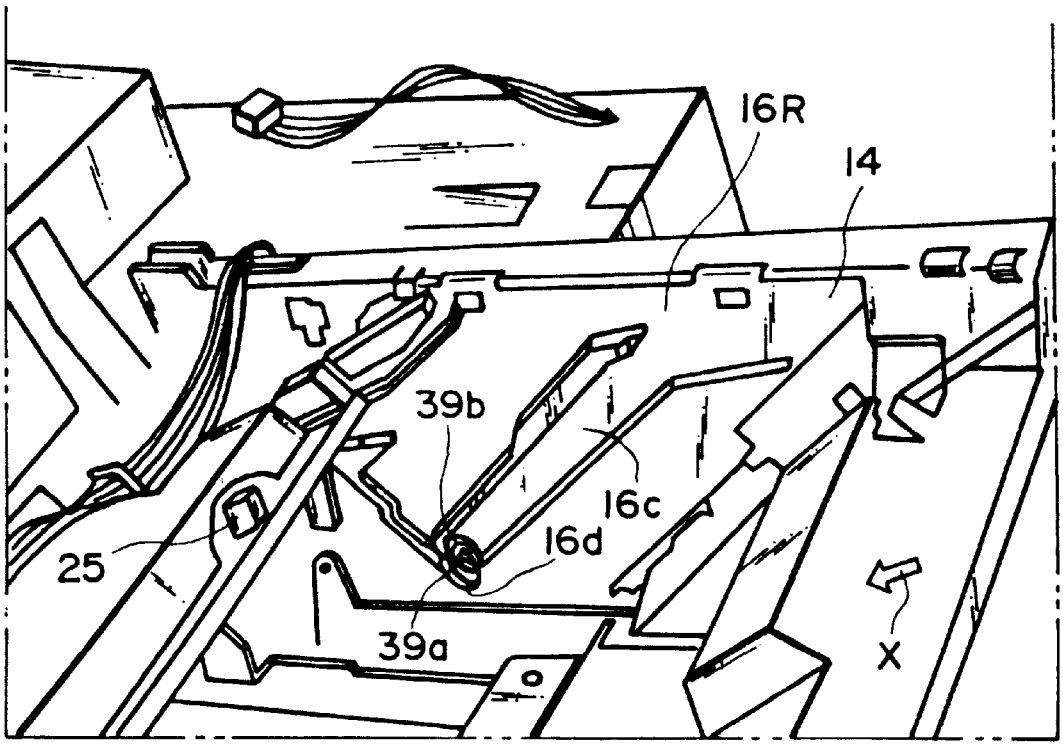
FIG. 10 is a perspective view of an outer appearance of a mounting portion of the main assembly of the apparatus, for the process cartridge.

The description will be made as to the guide means for guiding the process cartridge B when it is mounted to the main assembly 14 of the apparatus. FIGS. 9, 10 show the guide means. FIG. 9 is a perspective view as seen from the left side in the direction (arrow X) in which the process cartridge B is mounted to the main assembly A. FIG. 10 is a perspective view as seen from the righthand side.

As shown in FIGS. 4, 5, 6, 7, the cleaning frame 13 is provided on the opposite outer surfaces with guide means which is guided when the process cartridge B is mounted to or demounted from the main assembly 14 of the apparatus. The guide means comprises cylindrical guides 13*a*R, 13*a*L as positioning guides and anti-rotation guides 13*b*R, 13*b*L. As shown in FIG. 5, the cylindrical guide 13*a*R is in the form of a hollow cylinder, and the anti-rotation guide 13*b*R is integrally molded with the cylindrical guide 13*a*R, and is extended radially and outwardly from the circumferences of the cylindrical guide 13*a*R. The cylindrical guide 13*a*R has an integral mounting flange 13*a*R1. The right-hand guide member 13R having the cylindrical guide 13*a*R, the anti-rotation guide 13*b*R is fixed to the cleaning frame 13 by penetrating small screws through holes formed in the flange 13*a*R1 and threading them into the cleaning frame 13. The anti-rotation guide 13*b*R of the right-hand guide member 13R fixed to the cleaning frame 13 is disposed on a side of the developing device frame 12 so as to be extended to the side of a development holder 40 fixed to the developing device frame 12, which will be described hereinafter. As shown in FIG. 6, a hole 13*k*1 (FIG. 11) of the cleaning frame 13 is engaged with an expanded diameter portion 7*a*2 of the drum shaft 7*a*. It is engaged with a positioning pin 13*c* projected on the cleaning frame 13 so that rotation is prevented, and a cylindrical guide 13*a*L is projected outwardly (front side in the direction perpendicular to the sheet of the drawing of FIG. 6) of a flat flange 29 which is fixed to the cleaning frame 13 by small screw 13*d*. An inside of the flange 29 is provided with the drum shaft 7*a* fixed thereto, which is effective to rotatably support a spur gear 7*n* cramped into the photosensitive drum 7. The said cylindrical guide 13*a*L and the drum shaft 7*a* are coaxial with each other. The flange 29, the cylindrical guide 13*a*L and the drum shaft 7*a* are integral or a one piece metal (iron, for example). As. shown in FIG. 6, an anti-rotation guide 13*b*L is projected integrally from the site of the cleaning frame 13. It is slightly away from the cylindrical guide 13*a*L and is extended substantially radially from the cylindrical guide 13*a*L. The guide 13*b*L has an elongated configuration. At the portion where the anti-rotation guide 13*b*L may interfere the flange 29, the flange 29 is cut away. The height thereof is such that it is substantially flush with the top surface of the guide 13*b*L. The guide 13*b*L is extended to the side of the developing roller shaft reception box 9*v*. The left-hand guide member 13L is constituted by the cylindrical guide 13*a*L of metal and a support anti-rotation guide 13*b*L of synthetic resin material.

The description will be made as to a regulating abutment 13*j* provided on an upper surface 13*i* of the cleaning unit C. Here, the upper surface means the surface which takes an upper position when the process cartridge B is mounted to the main assembly 14 of the image forming apparatus. In this embodiment, as shown in FIGS. 4–7, the regulating abutment 13*j* is provided at each of a right-hand end 13*p* and a left-hand end 13*q* (in the direction perpendicular to the process cartridge mounting direction) on the upper surface 13*i* of the cleaning unit C. The regulating abutment 13*j* functions to regulate the position of the process cartridge B when the process cartridge B dismounted to the main assembly 14 of the image forming apparatus. More particularly, when the process cartridge B is mounted to the main assembly 14 of the apparatus image formation, the regulating abutment 13*j* is abutted to a fixing member 25 (FIGS. 9, 10) in the main assembly 14 of the image forming apparatus by which the process cartridge B is limited in the rotation about the cylindrical guides 13*a*R, 13*a*L.

Guide means provided in the main assembly 14 of the image forming apparatus will be described. When an opening and closing member 35 of the main assembly 14 of the image forming apparatus is rotated about the pivoted 35*a* in the couterclockwise direction, the top part of the main assembly 14 of the image forming apparatus is open so that mounting portion for the process cartridge B is seen, as illustrated in FIGS. 9, 10. A guide member 16R is provided on the left inner side with respect to the process cartridge mounting direction through the opening, as shown in FIG. 9, and a guide member 16L is provided on the right inner side, as shown in FIG. 10. As shown in Figures, each of the guide members 16R, 16L comprises a guide portion 16*a*, 16*c* which is inclined downward as seen in the direction indicated by an arrow X (process cartridge B inserting direction) and a semicircular positioning groove 16*b*, 16*d* which continues with the guide portion 16*a*, 16*c* and into which the cylindrical guide 13*a*R, 13*a*L of the process cartridge B is snugly fitted. The peripheral wall portion of each of the positioning grooves 16*b*, 16*d* is cylindrical.

The center of the positioning groove 16*b*, 16*d* is concentric with the center of the cylindrical guide 13*a*R, 13*a*L of the process cartridge B when the process cartridge B is mounted to the main assembly 14 of the apparatus, and further with the center of the photosensitive drum. The guide portions 16*a*, 16*c* have such widths as seen in the mounting direction of the process cartridge B that cylindrical guides 13*a*R, 13*a*L are loosely fitted therein, respectively. The guides 13*b*R, 13*b*L have widths which are smaller than the diameters of the cylindrical guides 13*a*R, 13*a*L so that guides 13*b*R, 13*b*L are loosely fitted therein. However, rotations of the cylindrical guides 13*a*R, 13*a*L and the guides 13*b*R, 13*b*L are limited by the guide portions 16*a*, 16*c*, and the orientation of the process cartridge B is made correct when it is being mounted to the main assembly. When the process cartridge B is completely mounted to the main assembly 14 of the image forming apparatus, the cylindrical guides 13*a*R, 13*a*L of the process cartridge B are engaged in the positioning grooves 16*b*, 16*d* of the guide members 13R, 13L, respectively, and in addition, the left and right regulating abutments 13*j* of the leading portion of the cleaning frame 13 of the process cartridge B are abutted to the fixing member 25 of the main assembly 14 of the apparatus. When the centers of the cylindrical guides 13*a*R, 13*a*L of the process cartridge B is maintained horizontal, the developing unit D side is heavier than the cleaning unit C, so that a primary moment is produced.

When the process cartridge B is to be mounted to the main assembly 14 of the image forming apparatus, the user grips a rib 11*c* of the toner frame 11 at the recess 17 side and lower side, and the cylindrical guides 13*a*R, 13*a*L are inserted into the guide portions 16*a*, 16*c* of the cartridge mounting portion of the main assembly 14 of the image forming apparatus, and then the user rotates the process cartridge in the direction of front side down so as to insert the anti-rotation guides 13*b*R, 13*b*L into the guide portions 16*a*, 16*c* of the main assembly 14 of the image forming apparatus. The cylindrical guide 13*a*R, 13*a*L and the anti-rotation guides 13*b*R, 13*b*L of the process cartridge B are further inserted along the guide portions 16*a*, 16*c* of the main assembly 14 of the image forming apparatus, and when the cylindrical guides 13*a*R, 13*a*L of the process cartridge B reach the positioning grooves 16*b*, 16*d* of the main assembly 14 of the image forming apparatus, the cylindrical guides 13*a*R, 13*a*L are seated on the positioning grooves 16*b*, 16*d* by the gravity of the process cartridge B. By doing so, the cylindrical guides 13*a*R, 13*a*L of the process cartridge B are correctly positioned relative to the positioning grooves 16*b*, 16*d*. The central line connecting the centers of the cylindrical guides 13$a$R, 13$a$L is also the center line of the photosensitive drum 7, and therefore, the position of the photosensitive drum 7 is generally determined relative to the main assembly 14 of the image forming apparatus. Finally, the position of the photosensitive drum relative to the main assembly 14 is determined when the coupling is engaged. In the state, there is a small gap between the fixing member 25 of the main assembly 14 of the image forming apparatus and the regulating abutment 13$j$ of the process cartridge B. When the user releases the process cartridge B, the developing unit D side lowers about the cylindrical guides 13$a$R, 13$a$L, and correspondingly the cleaning unit C rises, so that regulating abutments 13$j$ of the process cartridge B are abutted to the fixing member 25 of the main assembly 14 of the image forming apparatus, so that process cartridge B is correctly mounted to the main assembly 14 of the image forming apparatus. Thereafter, the opening and closing member 35 is rotated in the clockwise direction about the pivot 35$a$ to its closing position.

When the process cartridge B is to be taken out of the main assembly 14 of the apparatus, the opening and closing member 35 of the main assembly 14 of the apparatus is rotated to its open position. The user grips the upper and lower ribs 11$c$ and lifts it, by which the cylindrical guides 13$a$R, 13$a$L of the process cartridge B rotates about the positioning grooves 16$b$, 16$d$ of the main assembly 14, and therefore, the regulating abutments 13$j$ are released from the fixing portion member 25 of the main assembly 14 of the apparatus. When the process cartridge B is pulled further, the cylindrical guides 13$a$R, 13$a$L are disengaged from the positioning grooves 16$b$, 16$d$ and are moved to the guide portions 16$a$, 16$c$ of the guide member 16R, 16L fixed to the main assembly 14 of the apparatus. Then, the process cartridge B is lifted up, so that cylindrical guides 13$a$R, 13$a$L and the anti-rotation guides 13$b$R, 13$b$L of the process cartridge B rise in the guide portions 16$a$, 16$c$ of the main assembly 14 of the apparatus, by which the orientation of the process cartridge B is regulated to be guided to the outside of the main assembly 14 of the apparatus without interfering with the other portion. As shown in FIG. 12, the spur gear 7$n$ is provided at the end which is opposite from the end having the drum gear 7$b$ (helical gear). The spur gear 7$n$, when the process cartridge B is mounted to the main assembly 14 of the apparatus, is brought into meshing engagement with a gear (unshown) coaxially integral with the transfer roller 4 provided in the main assembly 14 of the apparatus, so that driving connection is established to drive the transfer roller 4.

Toner Frame

Figure 16:
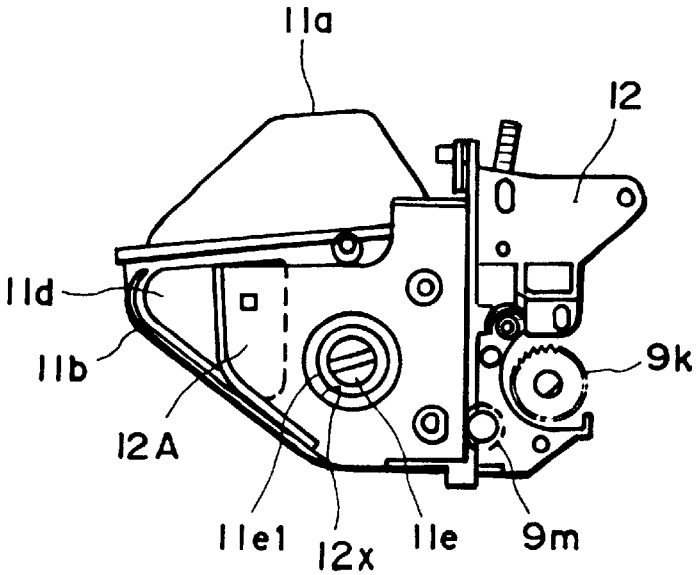
FIG. 16 is a side view of a side plate of the developing device frame and the toner frame.
Figure 21:
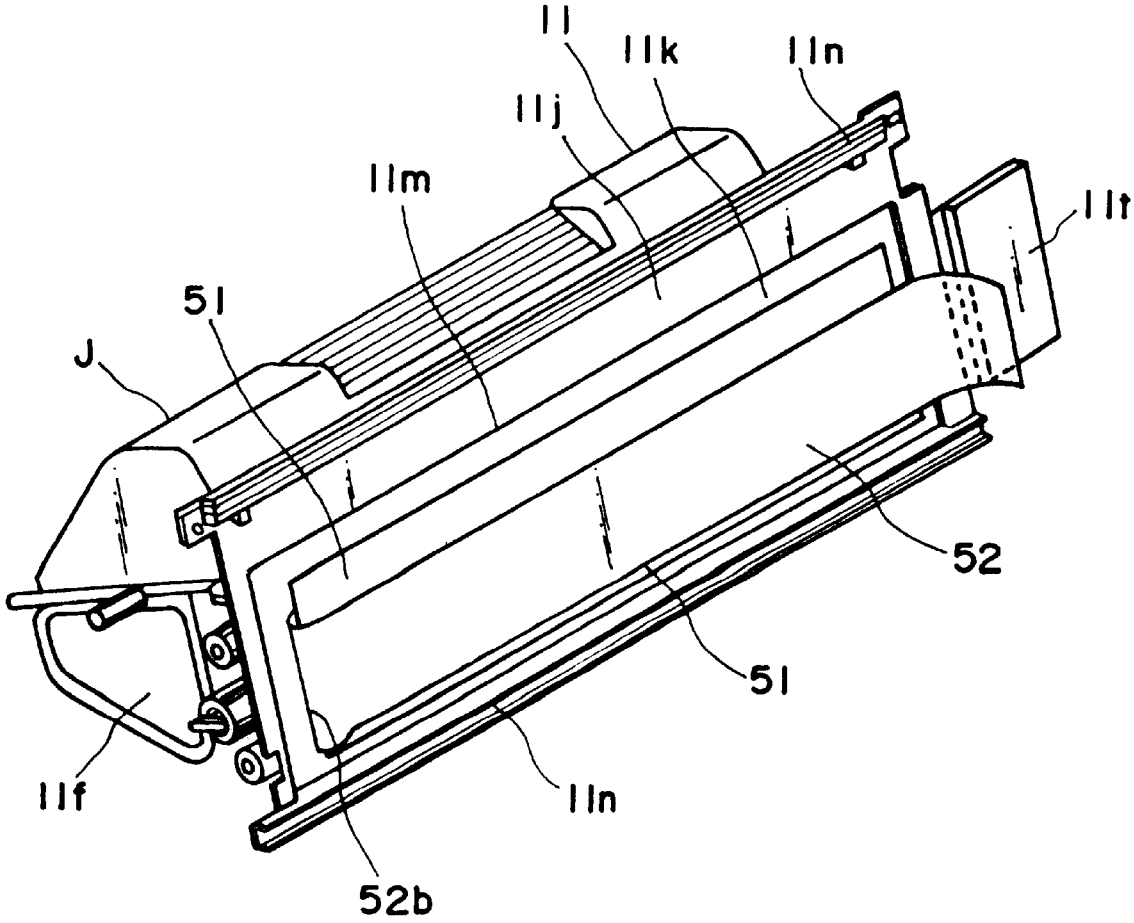
FIG. 21 is a perspective view of a toner frame.

Referring to FIGS. 3, 5, 7, 16, 20 and 21, the description will be made us to the toner frame. FIG. 20 is a perspective view of the tone of frame before a toner seal is welded, and FIG. 21 is a perspective view thereof after the toner is filled. As shown in FIG. 3, toner frame 11 comprises an upper frame 11$a$ and a lower frame 11$b$. The upper frame 11$a$, as shown in FIG. 1, is expanded upwardly to occupy the space at the right side of the optical system of the main assembly 14 of the image forming apparatus, so the amount of the toner contained in the process cartridge B is made larger without increasing the size of the image forming apparatus A. As shown in FIGS. 3, 4 and 7, the upper frame 11$a$ is provided with a recess 17 in the longitudinally central portion to provide a grip. The user grips the process cartridge between the recess 17 of the upper frame 11$a$ and the bottom side of the lower frame 11$b$. The ribs 11$c$ are extended on the bottom side of the lower frame 11$b$ and on one side of the recess 17 to facilitate the gripping by the user. As shown in FIG. 3, the upper frame 11$a$ is provided with a flange 11$a$1 which is engaged with a flange 11$b$1 having a rim around the lower frame 11$b$, and the frames 11$a$, 11$b$ are welded by ultrasonic welding at the welding surface U, which causes welded rib to melt. The connecting method is not limited to the ultrasonic welding, but may be a welding, a forced vibration, bonding or the like. When the frames 11$a$, 11$b$ are welded by the ultrasonic welding, the frames 11$a$, 11$b$ are supported by the flange 11$b$1. Additionally, a stepped portion 11$m$ is provided substantially on the same plane as the flange 11$b$1 above the opening 11$i$. The structure providing to stepped portion 11$m$ will be described hereinafter. Prior to welding the frames 11$a$, 11$b$, a toner feeding member 9$b$ is set in the lower frame 11$b$. As shown in FIG. 16, a coupling member 11$e$ is set through a hole 11$e$1 formed in the side plate of the toner frame 11 so as to be locked with an end of the toner feeding member 9$b$. The said hole 11$e$1 is provided at longitudinal end of the lower frame 11$b$. On the same side as the hole 11$e$1, a rectangular triangular toner filling opening 11$d$ is provided to permit the toner to be filled. The edge of the toner filling opening 11$d$ includes a side which extends along the connecting line between the upper and lower toner frames 11$a$, 11$b$ and which is one of the sides constituting the right angle, a substantially vertical side which is the other side constituting the right angle, and a hypotenuse side extending along the bottom side of the lower frame 11$b$. With this arrangement, the size of the toner filling opening 11$d$ is maximized. The hole 11$e$1 and the toner filling opening 11$d$ are juxtaposed with each other. As shown in FIG. 20, an opening 11$i$ is formed extending in the longitudinal direction of the toner frame 11 to permit the toner to be fed from the toner frame 11 into the developing device frame 12, and the opening 11$i$ is sealed as will be described hereinafter. Thereafter, the toner is filled into the toner frame through the toner filling opening 11$d$, and the toner filling opening 11$d$ is plugged by a toner cap 11$f$, as shown in FIG. 21, thus accomplishing the toner unit J. The toner cap 11$f$ is made of polyethylene, polypropylene resin material, and it is press-fitted into the toner filling opening 11$d$ of the toner frame 11 or bonded thereto. The toner unit J is then welded with the developing device frame 12 which will be described hereinafter, by ultrasonic welding to constitute the developing unit D. The connecting method is not limited to the ultrasonic welding, but may be bonding, snap fit using elastic force, or the like.

As shown in FIG. 3, the lower frame 11$b$ of the toner frame 11 is provided with an inclined surface K, and the angle of the inclination is determined such that toner spontaneously falls with consumption of the toner. The preferable angle 9 between the horizontal line Z and the inclined surface K of the process cartridge B which is mounted to the main assembly 14 of the apparatus which is in the horizontal position, is approx. 65°. The lower frame 11$b$ is provided with a concave shape portion 11$g$ at a lower portion to permit rotation of the toner feeding member 9$b$. The diameter of rotation of the toner feeding member 9$b$ is approx. 37 mm. The concave shape portion 11$g$ is recessed from an extension of the inclined surface K by approx. 0 mm--10 mm. The reason is as follows. If the concave shape portion 11$g$ is above the inclined surface K, the toner having fallen to the position between the concave shape portion 11$g$ and the inclined surface K cannot be fed into the developing device frame 12 with the result of the occurrence of non-usable toner remaining in the toner frame. However, with above-described structure of this embodiment, the toner is assuredly fed from the toner frame 11 into the developing device frame 12.

The toner feeding member 9*b* is made of an iron rod-like member having a diameter of approx. 2 mm. It is in the form of a crank. FIG. 20 shows one side. One of the journal 9*b*1 is journaled in a hole 11*r* of the toner frame 11 faced to the opening 11*i*, and the other is fixed to the coupling member 11*e* (not shown in FIG. 20). As described in the foregoing, the provision of the concave shape portion 11*g* permits the rotation of the toner feeding member 9*b* so that stabilized toner feeding is assured at low cost.

Figure 22:
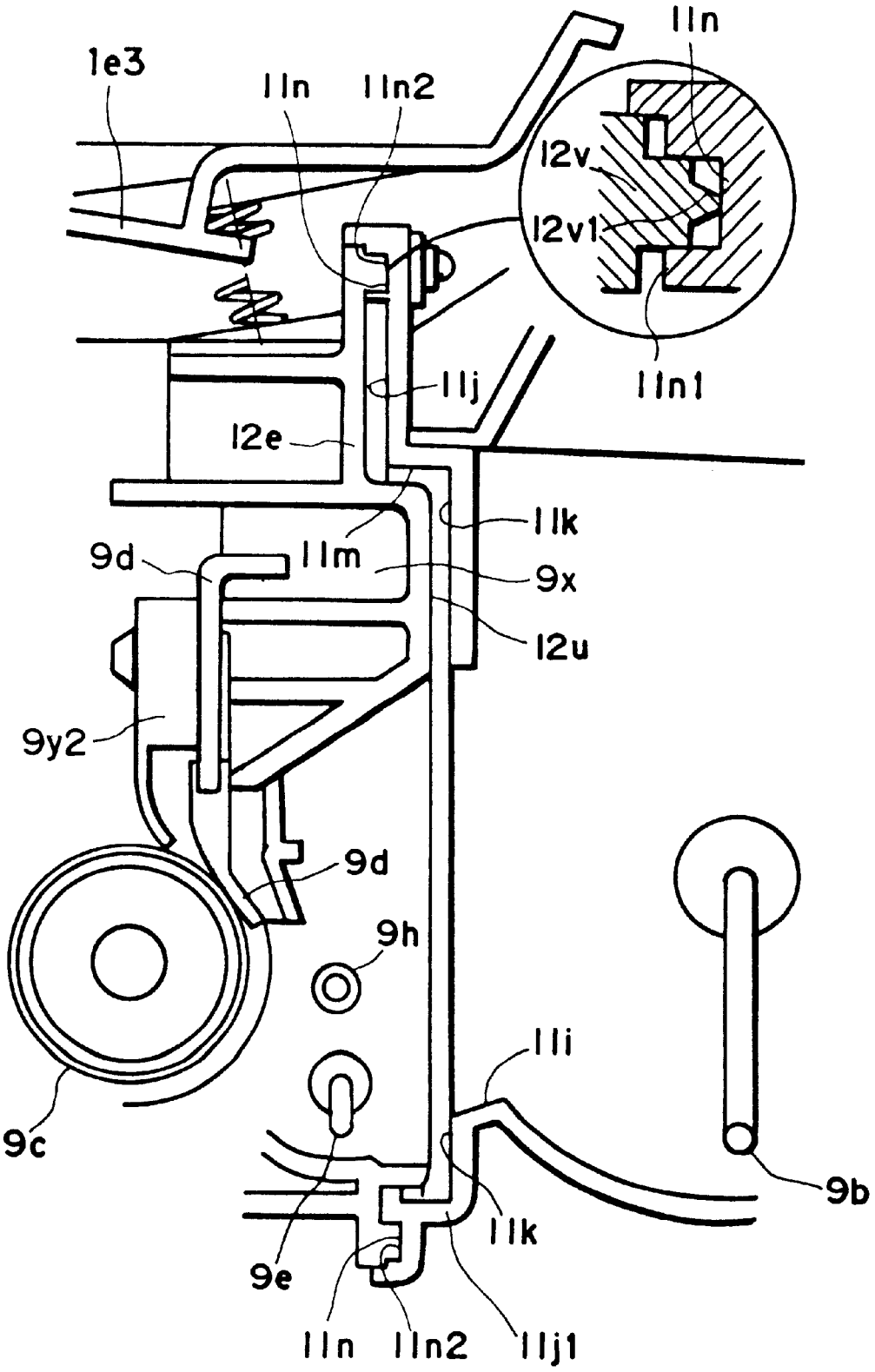
FIG. 22 is a longitudinal sectional view of the toner seal portion shown in FIG. 21.

As shown in FIGS. 3, 20 and 22, the opening 11*i* is provided at the connecting portion between the toner frame 11 and the developing device frame 12 to permit the toner to be fed from the toner frame 11 to the developing device frame 12. Around the opening 11*i*, there is provided a recessed surface 11*k*. The recessed surface 11*k* is provided with an upper and lower flanges 11*j*, 11*j*1, and the upper edge portion of the flange 11*j* and the lower edge portion of the flange 11*j*1 are provided with respective groove 11*n* extending in the longitudinal direction. The upper flange 11*j* has a channel-like configurations, and the lower flange 11*j*1 is extended in the direction grossing with the recessed surface 11*k*. As shown in FIG. 22, the bottom 11*n*2 of the groove 11*n* is outer (toward the developing device frame 12) than the recessed surface Ilk. The flange 11*j* of the opening 11*i* may be in the form of a frame in the same plane.

As shown in FIG. 19, the surface faced to the toner frame 11 of the developing device frame 12 is in the same plane (one flat surface 12*u*). At the upper and lower portions and the opposite longitudinal ends of the flat surface 12*u*, there is extended parallel flange 12*e* in the form of a frame with a space from the flat surface 12*u*. Along the longitudinal edge of the flange 12*e*, there is provided a rib 12*v* which it engaged with the groove 11*n* of the toner frame 11. The top surface of the rib 12*v* is provided with a trianglar projection 12*v*1 which is used for the ultrasonic welding. The toner frame 11 and the developing device frame 12 having been assembled with respective parts, are coupled with each other by engagement between the groove 11*n* of the toner frame 11 and the rib 11*v* of the developing device frame 12, and the ultrasonic welding is effected at the engaged portion, as will be described hereinafter. As shown in FIG. 21, an easily tearable cover film 51 is stuck on the recessed surface 11*k* and is extended in the longitudinal direction to seal the opening 11*i* of the toner frame 11. The cover film 51 is stuck on the toner frame 11 along the four sides of the opening 11*i* in the recessed surface 11*k*. To the cover film 51, a tear tape 52 is welded to permit the user to tear the cover film 51 to unseal the opening 11*i*. The tear tape 52 is folded back at one longitudinal end 52*b* of the opening 11*i* and extended out through between the toner frame 11 and an elastic sealing material 54 (FIG. 19) made of felt or the like at that it to the longitudinal end of the surface of the developing device frame 12 faced to the toner frame 11. An outside end 52*a* of the tear tape 52 is provided with a grip member 11*t* (FIGS. 6, 20, 21). The grip member 11*t* is integral with the toner frame 11, and the portion connecting with the toner frame 11 is made particularly thinner than the other portion to permit cutting. The end of the tear tape 52 is affixed to the grip member 11*t*. To the inside a portion of the surface of the sealing material 54, a tape 55 in the form of a synthetic resin film having a small friction coefficient is affixed. An elastic sealing material 56 is affixed to the flat surface 12*e* at a longitudinal end portion which is opposite from the position at which the elastic sealing material 54 is affixed (FIG. 19).

The above-described elastic sealing materials 54, 56 are affixed to the flange 12*e* over the entire width at each of the opposite longitudinal ends of the flange 12*e*. The elastic sealing materials 54, 56 are met with the flange 11*j* at the opposite longitudinal ends of the recessed surface 11*k*, and are overlapped with the rib 12*v* over the entire widths of the flange 11*j*. In order to facilitate the alignment of the frames 11, 12 when the toner frame 11 and the developing device frame 12 are connected, the flange 11*j* of the toner frame 11 is provided with a round hole 11*r* and a rectangular hole 11*q* engageable with a cylindrical dowel 12*w*1 and a rectangular shape dowel 12*w*2 provided on the developing device frame 12, respectively. The round hole 11*r* is closely fitted with the dowel 12*w*1, and the rectangular hole 11*q* is engaged with the dowel 12*w*2 closely in the widthwise direction and loosely in the longitudinal direction.

When the toner frame 11 and the developing device frame 12 coupled with each other, the toner frame 11 and the developing device frame 12 are independently assembled. Thereafter, the positioning cylindrical dowel 12*w*1 and the rectangular shape dowel 12*w*2 of the developing device frame 12 are engaged into the positioning positioning round hole 11*r* and rectangular hole 11*q* of the toner frame 11. The rib 12*v* of the developing device frame 12 is engaged into the groove 11*n* of the toner frame 11. Then, the toner frame 11 and the developing device frame 12 are press-contacted to each other, by which the sealing materials 54, 56 are compressed to the flange 11*j* at the opposite longitudinal ends of the toner frame 11, and a rib 12*z* approaches to the flange 11*j* of the toner frame 11 functioning as a spacer. The rib 12*z* is integrally molded with the flat surface 12*u* of the developing device frame 12 at each of the opposite longitudinal ends. In order to permit passage of the tear tape 52, the rib 12*z* is provided only at the lateral sides of the tear tape 52.

While developing device frame 12 and the toner frame 11, the ultrasonic vibration is imparted between the rib 12*v* and the groove 11*n*, and the resultant sheet fuses the trianglar projection 12*v*1 to be welded with the bottom of the groove 11*n*. By doing so, the edge 11*n*1 of the groove 11*n* of the toner frame 11 and the rib 12*z* (a spacer for the developing device frame 12) are closely contacted to each other, and a space with the sealed peripheral edge is provided between the recessed surface 11*k* of the toner frame 11 and the opposing flat surface 12*u* of the developing device frame 12. The cover film 51 and the tear tape 52 are accommodated in the space. In order to feed the toner out of the toner frame 11 into the developing device frame 12, the base portion side of the grip member 11*t* at the end 52*a* (FIG. 6) of the tear tape 52 projected to the outside of the process cartridge B is cut out of the toner frame 11 or tear out, and the user pulls the grip member 11*t* by the hand. Then, the cover film 51 is torn, and therefore, the opening 11*i* is unsealed, so that toner can be fed out of the toner frame 11 into the developing device frame 12. The elastic sealing materials 54, 56 are compressed to be thinner at each of the opposite longitudinal end of the flange 11*j* of the toner frame 11 while keeping the flat hexahedron shape, therefore, the sealing property is sufficient.

Because of the above-described structure of the opposing surfaces of the toner frame 11 and the developing device frame 12, when the force for tearing the cover film 51 is imparted to the tear tape 52, the tear tape 52 can be smoothly drawn out through between the frames 11, 12. When the toner frame 11 and the developing device frame 12 are welded to each other, the heat is produced which is effective to fuse the trianglar projection 12*v*1. The generation heat might result in thermal deformation in the toner frame 11 developing device frame 12 due to the thermal stress. However, according to this embodiment, the groove 11*n* of the toner frame 11 and the rib 12*v* of the developing device frame 12 are engaged with each other substantially over the entire longitudinal range so that coupling between them are reinforced around the welded portion, and therefore, the thermal deformation due to the thermal stress is not significant.

The material of the toner frame 11 and the developing device frame 12 may be a plastic resin material such as polystyrene, ABS resin material acrylonitrile/butadiene/styrene copolymer resin material, polycarbonate, polyethylene, polypropylene or the like.

FIG. 3 is a side sectional view of the toner frame 11 used in this embodiment. FIG. 3 shows an example in which the coupling surface JP between the toner frame 11 and the developing device frame 12 is substantially vertical.

Further description will be made as to the toner frame 11 used in this embodiment. In order to let the one component toner accommodated in the toner container 11A toward the opening 11*i*, there are provided two inclined surfaces K, L. The inclined surfaces K, L extend about the entire length of the toner frame 11. The inclined surface L is disposed above the opening 11*i*, and the inclined surface K is disposed at the rear side of the opening 11*i*. The inclined surface L is formed in the upper frame 11*a*, and the inclined surface K is formed in the lower frame 11*b*. The inclined surface L is vertical direction or directed more downward than the vertical direction in the state when the process cartridge B is mounted to the main assembly 14 of the apparatus. The inclined surface K is inclined such that angle Θ3 thereof relative to the line m perpendicular to the connecting surface JP between the toner frame 11 and the developing device frame 12 is the approx. 20°–40°. In this embodiment, the configuration of the upper frame 11*a* is determined such that lower frame 11*b* can be set with such an angle, when the upper frame 11*a* and the lower frame 11*b* are connected with each other. According to this embodiment, the toner can be efficiently fed out of the toner container 11A toward the opening 11*i*.

Developing Frame

Figure 14:
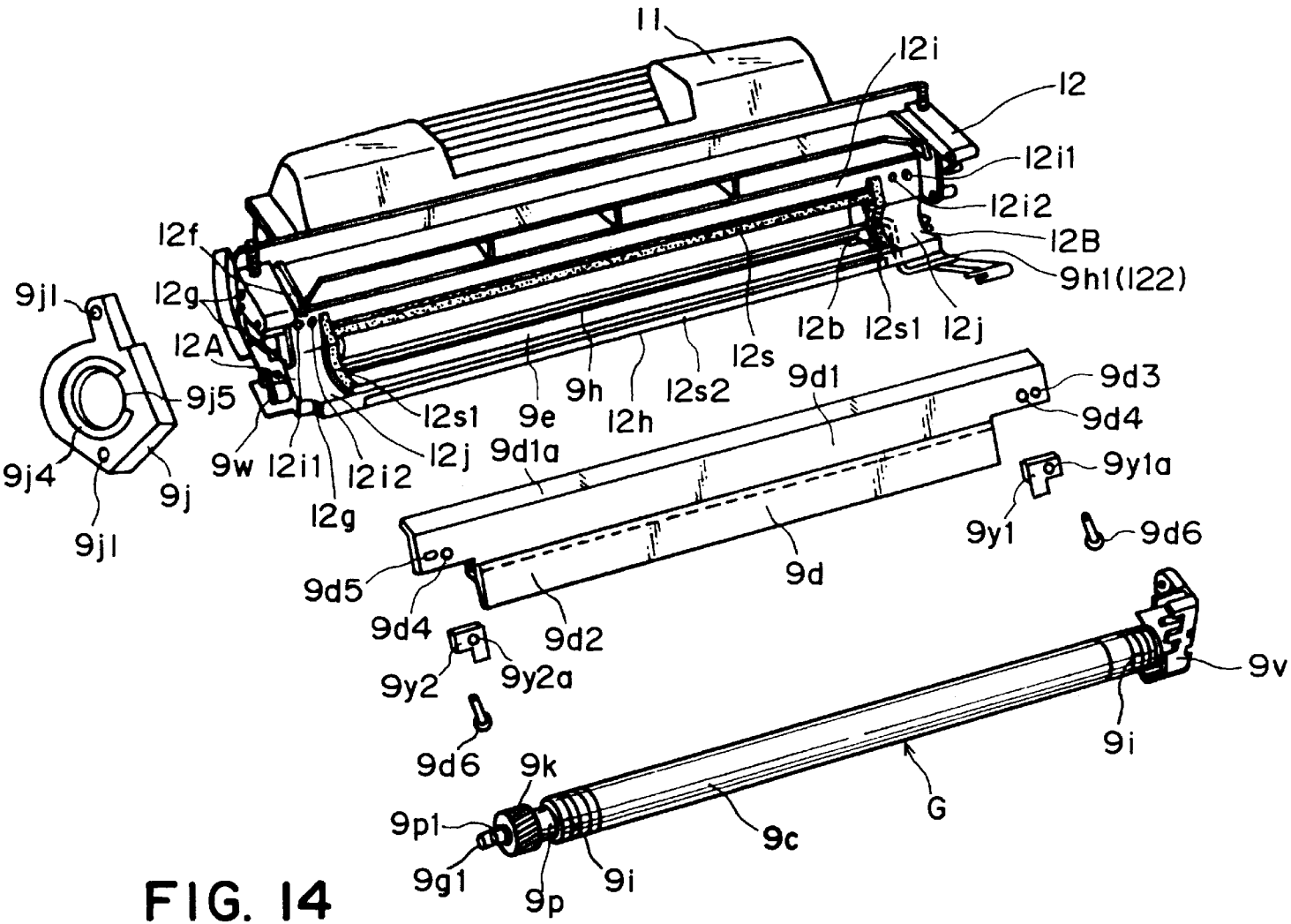
FIG. 14 is a partly exploded perspective view of a developing unit.
Figure 15:
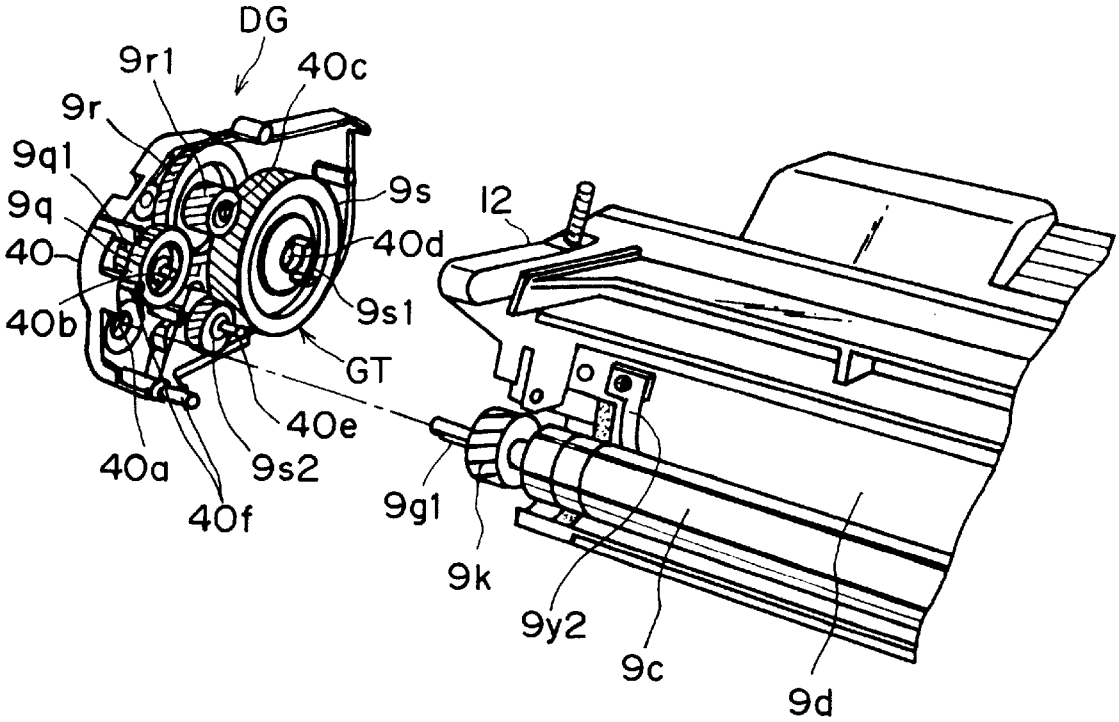
FIG. 15 is a perspective view of a rear portion of a development holder.
Figure 17:
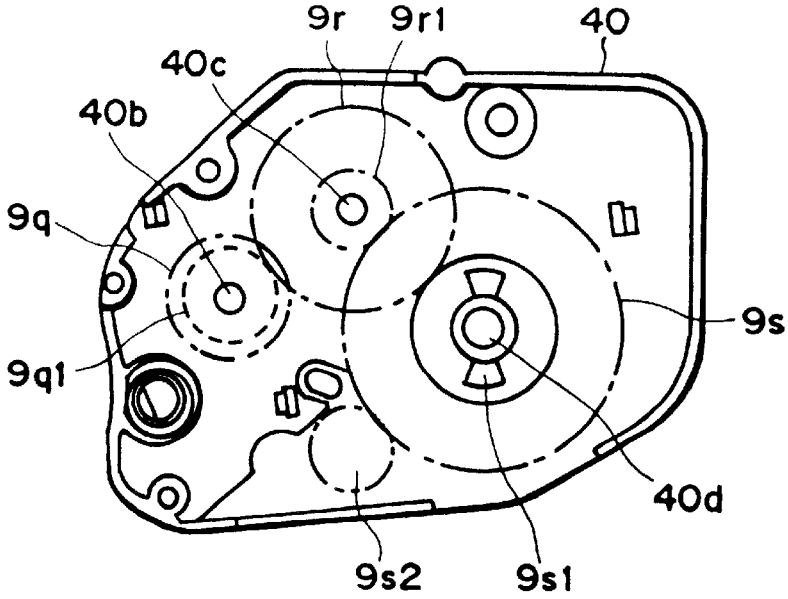
FIG. 17 is a side view of the development holder portion shown in FIG. 15 as seen from the inside toward the outside.
Figure 18:
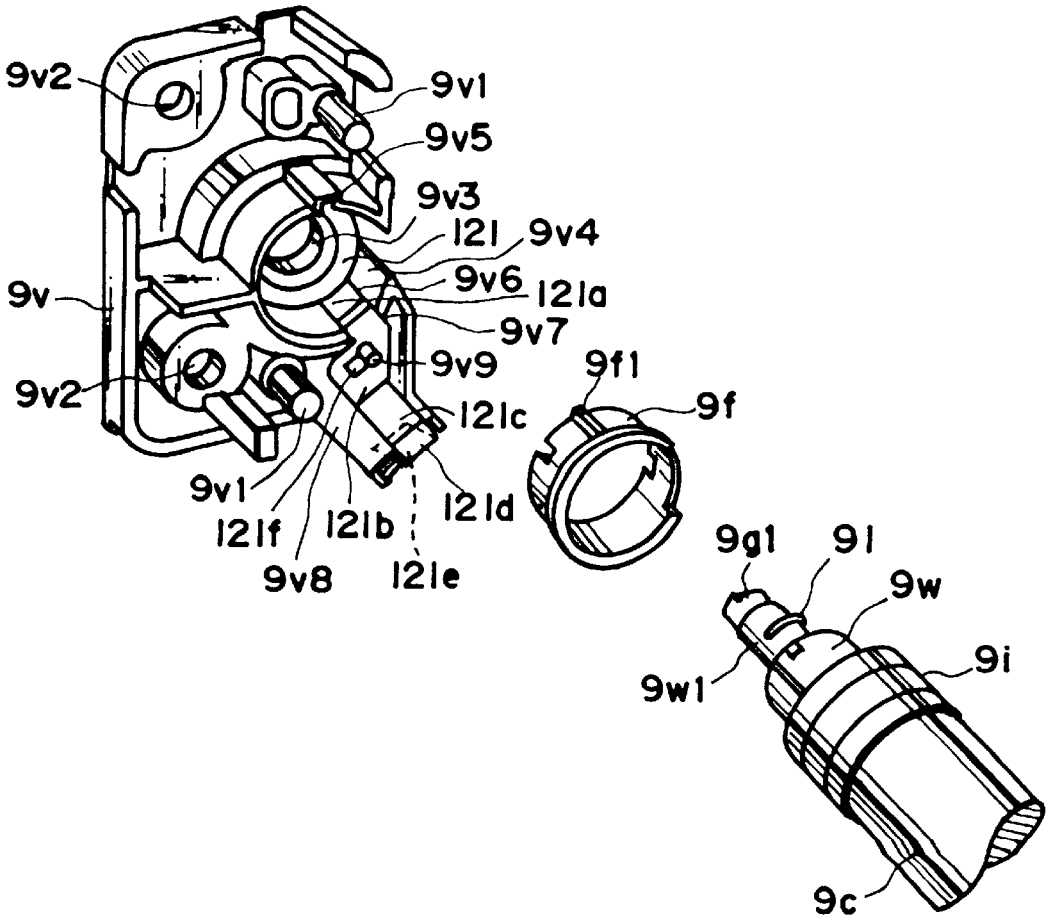
FIG. 18 is a perspective view of a developing roller shaft reception case.

The developing device frame will be further described. Referring to FIGS. 3, 14, 15, 16, 17, 18, the developing device frame 12 will be described. FIG. 14 is a partly exploded perspective view of the developing device frame 12 into which various parts are being set. FIG. 15 is a perspective view of the developing device frame 12 to which the developing means driving transmitting unit DG is being set. FIG. 16 is a side view of the developing unit without the drive transmission unit DG. FIG. 17 is a side view of the developing means driving transmitting unit DG as seen from inside. FIG. 18 is a perspective view illustrating inside a portion of the bearing case.

Figure 32:
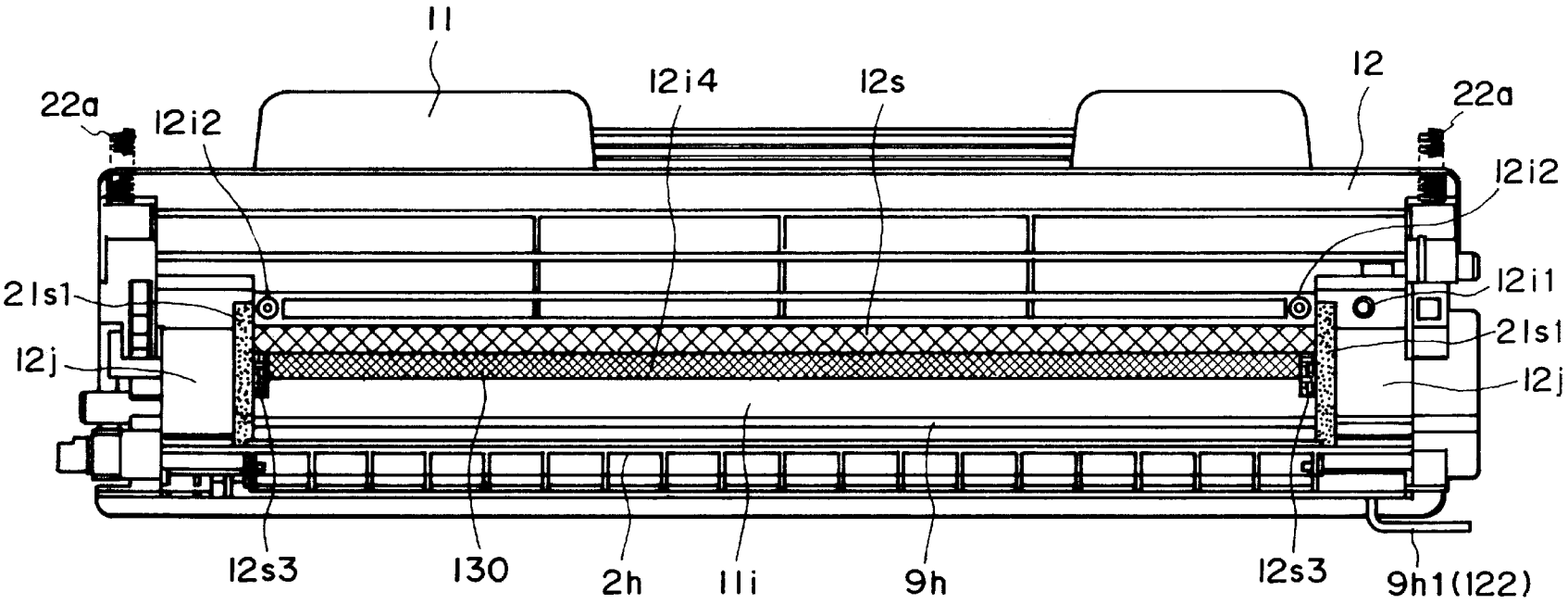
FIG. 32 is a front view of the developing frame to which the elastic member is affixed.

The developing device frame 12 is assembled with the developing roller 9*c*, the developing blade 9*d*, the toner stirring member 9*e*, an antenna rod 9*h* for detecting a remaining toner amount, as has been described hereinbefore. The developing blade 9*d* comprises an integral metal plate 9*d*1 and silicone rubber 9*d*2, the metal plate 9*d*1 having a thickness of approx. 1–2 mm, as shown in FIG. 14. By the silicone rubber 9*d*2 contacting to the developing roller 9*c* along the generating line of the developing roller 9*c*, the amount of the toner applied on the peripheral surface of the developing roller 9*c* is controlled. A scraper (righthand side) 9*y*1 and a scraper (left side) 9*y*2 are contacted to the peripheral surface of the developing roller 9*c* with elastic deformation at a part thereof. The function to scrape the toner off the developing roller 9*c* at the opposite longitudinal ends thereof and to move the toner toward inside, thus preventing leakage of the toner at the opposite ends of the developing roller 9*c*. The developing device frame 12 is provided with a dowel 12*i*1 and a female screw 12*i*2 in a flat surface 12*i* to which the developing blade is mounted (blade abutment surface). The metal plate 9*d*1 is provided with a hole 9*d*3 at the right-hand end portion and an elongated hole 9*d*5 at the left-hand end portion, the elongated hole 9*d*5 being the elongated in the longitudinal direction. The engaged with the dowel 12*i*1. The dowel 12*i*1, the hole 9*d*3 and the elongated hole 9*d*5 at the left and right portions function as positioning means for the developing blade 9*d*. More particularly, in FIG. 14, the dowel 12*i*1 and the hole 9*d*3 at the righthand side are loosely fitted with the gap of several μm to several tens μm and function to limit the motion in the longitudinal direction and in the direction perpendicular thereto. On the other hand, at the left side, the same applies to the dowel 12*i*1, but the hole 9*d*5 of the metal plate 9*d*1 engaged with the left side dowel 12*i*1 is elongated in the longitudinal direction. If the elongated hole 9*d*5 were the same as the right side hole, even a slight amount of deviation between the distance between the left and right dowels 12*i*1 and the distance between the holes 9*d*3 and 9*d*5 would result in incapability of mounting. However, the engagement between the elongated hole 9*d*5 and the dowel 12*i*1 is the same as with the righthand side as long as the direction perpendicular to the longitudinal direction is concerned. In this manner, the developing blade 9*d* is correctly positioned in the longitudinal direction by the engagement between the dowel 12*i*1 and the hole 9*d*3, and in the orthogonal direction, the correct positioning its accomplished by the engagement between the dowels 12*i*1 and the holes 9*d*3 and 9*d*5. Therefore, the mounting accuracy is assured. After the developing blade 9*d* is engaged with the above-described positioning means, a small screw 9*d*6 is threaded into the female screw 12*i*2 through the screw bore 9*y*1*a*, 9*y*2*a* of each of the scraper (righthand side) 9*y*1 and scraper (left side) 9*y*2 and through the screw bore 9*d*4, by which the left and right scrapers 9*y*1 (righthand side) and 9*y*2 (left side) and the metal plate 9*d*1 are fixed on the flat surface 12*i*. To the developing device frame 12, an elastic seal member 12*s* made of Moltopren is affixed above the metal plate 9*d*1 along the length thereof to prevent outward leakage of the toner. Furthermore, a seal member 12*s*1 is affixed containing from each of the opposite ends of the seal member 12*s* to an arcuation surface 12*j* extending along the developing roller 9*c*. In addition, a thin elastic seal member 12*s*2 is affixed to a lower jaw portion 12*h* in contact with the generating line of the developing roller 9*c*. One end of the metal plate 9*d*1 of the developing blade 9*d* is bent at about 90° to provide a bent portion 9*d*1*a*. The developing blade 9*d* has a thickness of approx. 1.5 mm–2 mm, and therefore, the magnetic seal member 12*s*1 cannot be overlapped with the longitudinal end portion of the developing blade 9*d*, with a result of an occurrence of a small gap therebetween. If the gap remains unsealed, the toner having passed through the gap is accumulated when the toner layer is formed on the developing roller 9*c*. As shown in FIG. 32, in order to seal the gap, an assistance seal 12*s*3 is affixed to an unshown seat of the developing device frame 12 at the back side of the developing blade 9*d* and inside of each of the seal members 12*s*1.

Referring to FIGS. 14, 18, the developing roller unit G will be described. The developing roller unit G comprises as a unit (1) the developing roller 9*c*, the (2) spacer rollers 9*i* for maintaining a predetermined gap between the peripheral surface of the developing roller 9c and the peripheral surface of the photosensitive drum 7, the spacer roller 9i being made of electrical insulation material such as synthetic resin material and functioning as a sleeve cap to prevent electric leakage between the cylindrical portion of aluminum Al of the photosensitive drum 7 and the cylindrical portion of aluminum Al of the developing roller 9c at each of the opposite ends of the developing roller 9c, (3) a developing roller shaft reception 9j (FIG. 14 is an enlarged view of the developing roller shaft reception 9j) for rotatably supporting the developing roller 9c and correctly positioning the developing device frame 12, (4) a developing roller gear 9k (helical gear) for receiving a driving force from the helical drum gear 7b of the photosensitive drum 7 and for rotating the developing roller 9c, (5) a development coil spring contact 91 having an end engaged with the end of the developing roller 9c (FIG. 18), and (6) a magnet, provided in the developing roller 9c, for depositing the toner on the peripheral surface of the developing roller 9c. In FIG. 14, the bearing case 9v has already been mounted to the developing roller unit G. Actually however, the developing roller unit G is engaged with the bearing cases 9v when the bearing case 9v is mounted to the developing device frame 12 after the developing roller unit G is going to be mounted between the side plates 12A, 12B.

The developing roller unit G, as shown in FIG. 14, is provided with a metal flange 9p fixedly engaged to an end of the developing roller 9c. The flange 9p has a developing roller gear mounting shaft portion 9p1 extended outwardly. The developing roller gear mounting shaft portion 9p1 is provided with two parallel flat portions, with which a developing roller gear 9k of synthetic resin material is non-rotatably engaged. The developing roller gear 9k is a helical gear, and therefore, a thrust force is produced during the rotation thereof. The direction of the helical configuration is such that thrust force is toward the inside in the longitudinal direction. Through the flange 9g, D-cut shafts 9g1 are extended outwardly. One of the shafts 9g1 is engaged with a development holder 40 of the drive transmission unit DG, and is non-rotatably supported. The developing roller shaft reception 9j is provided with a round hole having an inward anti-rotation projection 9j5, and a bearing 9j4 having a C-shaped cross-section is snugly fitted, and the flange 9p is rotatably engaged with the bearing 9j4. The developing roller shaft reception 9j is engaged into a slit 12f of the developing device frame 12, and the projection 40f of the development holder 40 is inserted into the hole 12g of the developing device frame 12 and the hole 9j1 of the developing roller shaft reception 9j, so that development holder 40 is fixed to the developing device frame 12. The said bearing 9j4 is provided with a flange, and only the flange portion has a C-shaped cross-section, but it may have the C-shaped cross-section over the entire length. The into which the bearing 9j1 of the developing roller shaft reception 9j is provided with a stepped hole, and the anti-rotation projection 9j5 is provided at the large diameter portion which receives the flange of the bearing 9j4. The bearing 9j and a bearing 9f which will be described hereinafter are made of polyacetal, polyamide or the like resin material.

The end portions of the magnet penetrating the developing roller 9c in the form of a sleeve are extended out of the developing roller 9c. The shaft portion 9g1 is engaged with an unshown D-shaped supporting hole 9v3 provided in the developing roller shaft reception box 9v shown in FIG. 18. A hollow journal 9w of vanishing edge member is inserted into and fixed to the inside of the developing roller 9c at each of the opposite ends, and a diameter-reduced cylindrical portion 9w1 integral with the journal 9w is effective to electrically insulate a development coil spring contact 9l electrically connected with the developing roller 9c and the magnet 9g from each other. The bearing 9f with the flange is made of an insulating material of synthetic resin, and is engaged with a bearing engaging hole 9v4 which is concentric with the magnet supporting hole 9v3. The bearing engaging hole 9v4 is provided with a keyway 9v5 into which a key portion 9f1 integral with the bearing 9f is engaged, so that rotation of the bearing 9f is prevented. The bearing engaging hole 9v4 has a bottom where there is an inner end of a developing bias contact 121 in the form of a flat ring. When the developing roller 9c is set in the developing roller shaft reception box 9v, the development coil spring contact 9l of metal is compressed and press-contacted to the developing bias contact 121. The said developing bias contact 121 has a discharge portion 121a bent from the outer diameter of the disk and engaged with the axial recess 9v6 of the bearing engaging hole 9v4 and expanded outside the bearing 9f, a second discharge portion 121b containing from the first discharge portion 121a and bent into a cut-away portion 9v7 provided at an end of the bearing engaging hole 9v4, a third discharge portion 121c bent from the second discharge portion 121b, a fourth discharge portion 121d bent from the third discharge portion 121c radially outwardly, and an outer contact portion 121e bent from the fourth discharge portion 121d in the same direction. In order to support such a developing bias contact 121, the developing roller shaft reception box 9v is provided with a supporting portion 9v8 projected longitudinally inwardly, and the supporting portion 9v8 is contacted to the fourth discharge portions 121c, 121d and to the outer contact portion 121e. The second discharge portion 121b is provided with a hole 121f into which a dowel 9v9 projecting longitudinally inwardly at the backside of the developing roller shaft reception box 9v. The outer contact portion 121e of the developing bias contact 121 is brought into contact with the developing bias contact member 125 of the main assembly 14 of the apparatus when the process cartridge B is mounted to the main assembly 14. By doing so, the developing bias can be applied to the developing roller 9c.

The two cylindrical projections 9v1 provided in the developing roller shaft reception box 9v are engaged with hole portions 12m provided at one longitudinal end of the developing device frame 12, so that developing roller shaft reception box 9v is correctly positioned relative to the developing device frame 12. An unshown small screw is threaded into the female screw 12c of the developing device frame 12 through the screw bore 9v2 of the developing roller shaft reception box 9v, thus fixing the developing roller shaft reception box 9v to the developing device frame 12. Thus, in this embodiment, when the developing roller 9c is mounted to the developing device frame 12, the developing roller unit G is a first assembled. Then, the thus assembled developing roller unit G is mounted to the developing device frame 12.

The developing roller unit G is assembled in the next step. First, the magnet 9g is inserted into the developing roller 9c provided with the flange 9p mounted thereto, and the journal 9w and the development coil spring contact 9l are mounted to one end of the developing roller 9c. Then, the spacer rollers 9i are mounted to the respective ends, and the developing roller shaft reception 9j are mounted to the outside thereof. Subsequently, the developing roller gear 9k is mounted to the developing roller gear mounting shaft portion 9p1 at one end of the developing roller 9c. Then, at each of the opposite ends of the developing roller 9c now having the developing roller gears 9*k*, the shaft 9*g*1 of the magnet (D-cut shaft) is projected. In this manner, the developing roller unit G these constructed.

The description will be made as to the antenna rod 9*h* for detecting the remaining toner amount. As shown in FIGS. 14, 19, the antenna rod 9*h* has an end bent into a crank shape. A contact portion 9*h*1 (remaining toner amount detecting contact 122) provided at one end thereof is contacted to the toner detecting contact member 126 mounted to the main assembly 14 of the apparatus which will be described hereinafter so as to be electrically connected thereto. When the antenna rod 9*h* is mounted to the developing device frame 12, the free end of the antenna rod 9*h* is penetrated through a through-hole 12*b* provided in the side plate 12B of the developing device frame 12. Then, the free end is supported in an unshown hole formed in the opposite side of the developing device frame 12. Thus, the antenna rod 9*h* is positioned and supported by the through-hole 12*b* and the unshown hole. In order to prevent introduction of the toner, a seal member (unshown) of synthetic resin material ring, felt, sponge or the like is inserted into the through-hole 12*b*. An arm portion of the contact portion 9*h*1 in the form of the crank is placed at such a position that when the developing roller shaft reception box 9*v* is mounted to the developing device frame 12, the developing roller shaft reception box 9*v* prevents the motion of the antenna rod 9*h* to prevent the antenna rod 9*h* from disengaging to outside. The side plate 12A of the developing device frame 12 into which the free end of the antenna rod 9*h* is inserted is opposed to the toner cap 11*f* provided in lower the frame 11*b* to partly cover the toner cap 11*f* when the toner frame 11 and the developing device frame 12 are coupled with each other. As shown in FIG. 16, the side plate 12A is provided with a hole 12*x*, through which a shaft coupling portion 9*s*1 (FIG. 15) of a toner feeding gear 9*s* of transmitting a driving force to the toner feeding member 9*b*. The gear 9*s* is provided with a shaft coupling portion 9*s*1 engaged with an end of the toner feeding member 9*b* and coupled with a coupling member 11*e* rotatably supported on the toner frame 11 (FIGS. 16, 20) to transmit the driving force to the toner feeding member 9*b*.

As shown in FIG. 19, a toner stirring member 9*e* is rotatably supported on the developing device frame 12, and is extended in parallel with the antenna rod 9*h*. The toner stirring member 9*e* has a shape of a crank, and is journaled in the side plate 12B at one end, and is engaged with the toner stirring gear 9*m* having an integral shaft portion rotatably supported in the side plate 12A as shown in FIG. 16, at the other end. A crank arm is hooked in a cut-away portion of the shaft portion to transmit the rotation of the stirring gear 9*m* to the toner stirring member 9*e*.

The description will be made as to the transmission of the driving force to the developing unit D. As shown in FIG. 15, a supporting hole 40*a* of the development holder 40 is engaged with the partly non-circular shaft 9*g*1 of the D-cut magnet 9*g* so as to be non-rotatably supported. When the development holder 40 is mounted to the developing device frame 12, the developing roller gear 9*k* is engaged with the gear 9*q* of the gear train GT, and the toner stirring gear 9*m* is engaged with the small gear 9*s*2. By this, the toner feeding gear 9*s* and the toner stirring gear 9*m* can receive the driving force from the developing roller gear 9*k*. The gears between the gear 9*q* and the toner feeding gear 9*s* are all idler gears. The gear 9*q* in meshing engagement with the developing roller gear 9*k* end of the small gear 9*q*1 integral with the gear 9*q* are rotatably supported on the dowel 40*b* integral with the development holder 40. The large gear 9*r* in meshing engagement with the small gear 9*q*1 and the small gear 9*r*1 integral with the gear 9*r* this rotatably supported on the dowel 40*c* integral with the development holder 40. The small gear 9*r*1 is in meshing engagement with the toner feeding gear 9*s*.

The toner feeding gear 9*s* is rotatably supported on the dowel 40*d* integral with the development holder 40. The toner feeding gear 9*s* is provided with a shaft coupling portion 9*s*1. The toner feeding gear 9*s* easy in meshing engagement with a small gear 9*s*2. The small gear 9*s*2 is rotatably supported on the dowel 40*e* integral with the development holder 40. The dowels 40*b*, 40*c*, 40*d*, 40*e* have a diameter of approx. 5–6 mm and support the gears in the gear train GT. With the foregoing structure, the gears constituting the gear train is supported by one member (the development holder 40 in this embodiment). Therefore, the gear train GT can be assembled into the development holder 40, so that assembling steps can be simplified. More particularly, the assembling developing unit D is completed by mounting to the developing device frame 12 the antenna rod 9*h*, the toner stirring member 9*e*, by mounting to the developing device frame 12 the developing roller unit G, the developing means driving transmitting unit DG and the gear case 9*v*.

In FIG. 19, designated by 12*p* is an opening which it extended in the longitudinal direction of the developing device frame 12. The opening 12*p* is faced to the opening 11*i* of the toner frame 11 when the toner frame 11 and the developing device frame 12 are coupled. The toner accommodated in the toner frame 11 can be supplied to the developing roller 9*c* by this. The stirring member 9*e* and the antenna rod 9*h* extend over the entire length of the opening 12*p*. The material of the developing device frame 12 may be the same as the material of the toner frame 11.

Electrical Contact

Referring to FIGS. 8, 9, 11, 23, the description will be made as to connections and arrangements of the contacts for establishing electric connection between the process cartridge B and the main assembly 14 of the image forming apparatus when the process cartridge B is mounted to the main assembly 14.

As shown in FIG. 8, the process cartridge B is provided with a plurality of electrical contacts. They are, (1) the cylindrical guide 13*a*L (electroconductive grounding contact, a reference numeral 119 will be used when it is considered as the electroconductive grounding contact) which is electrically connected with the photosensitive drum 7 to electrically ground the photosensitive drum 7 to the main assembly 14 of the apparatus; (2) an electroconductive charging bias contact 120 electrically connected with the charging roller shaft 8*a* to apply a charging bias to the charging roller 8 from the main assembly 14 of the apparatus; (3) an electroconductive developing bias contact 121 electrically connected with the developing roller 9*c* to apply a developing bias to the developing roller 9*c* from the main assembly 14 of the apparatus; (4) an electroconductive remaining toner amount detecting contact 122 electrically connected with the antenna rod 9*h* for detecting the remaining toner amount. Those four contacts are provided to be exposed on the side surface and the bottom surface of the cartridge frame. The four contacts 119–122 are spaced from each other to avoid electrical leakage between them, on the left side surface and bottom side of the cartridge frame as seen in the mounting direction of the process cartridge B.

Figure 11:
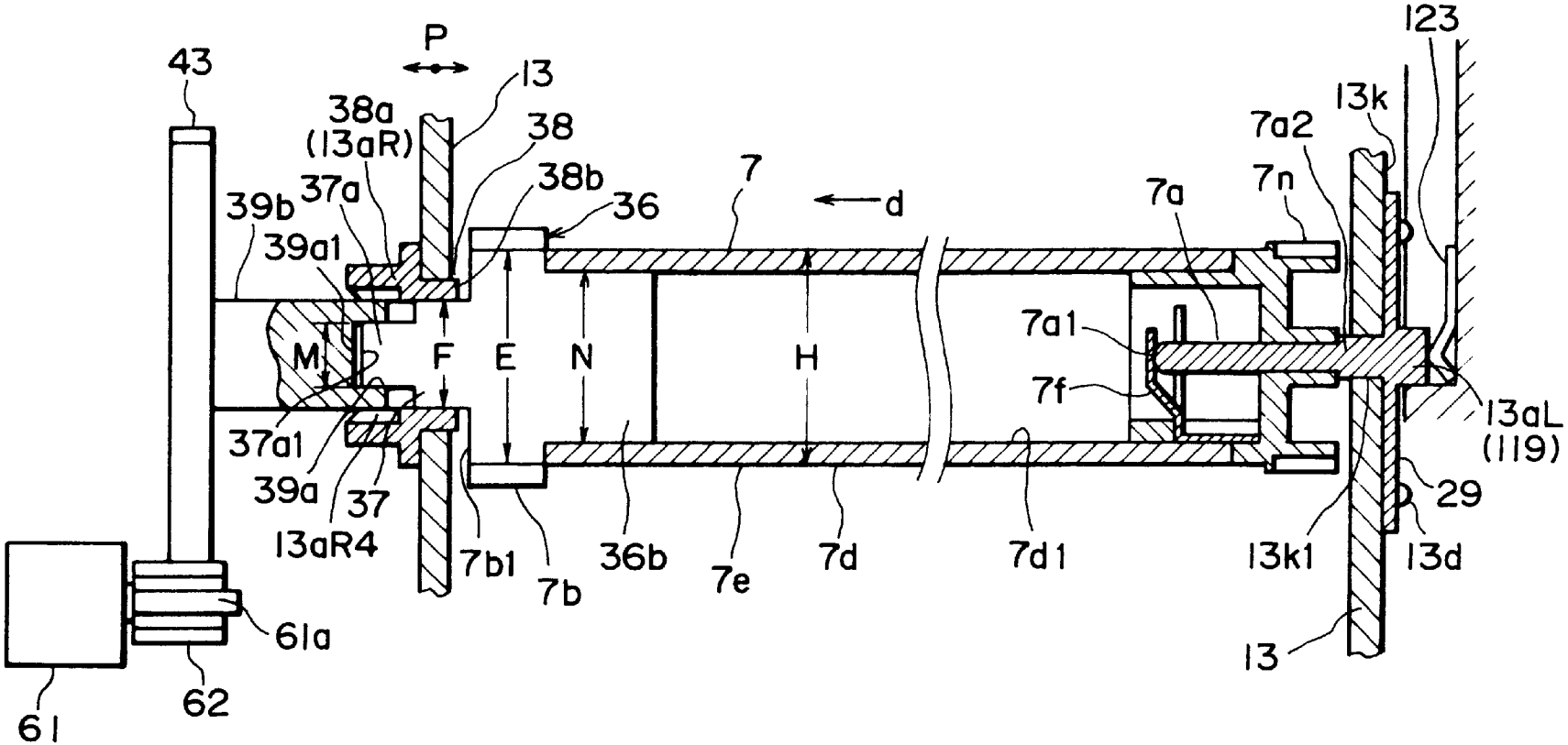
FIG. 11 is a longitudinal sectional view of a photosensitive drum and a driving device therefor.

The grounding contact 119 and the charging bias contact 120 are provided on the cleaning unit C, and the developing bias contact 121 and the remaining toner amount detecting contact 122 are provided on the developing device frame 12. The said remaining toner amount detecting contact 122 also functions as a process cartridge detecting contact for permitting the main assembly 14 to detect the presence or absence of the process cartridge B mounted to the main assembly 14. As shown in FIG. 11, the grounding contact 119 is coaxial with the drum shaft 7*a* integral with the flange 29 of an electroconductive material, and a grounding plate 7*f* electrically connected with the drum cylinder 7*d* is press-contacted to the drum shaft 7*a*, by which the ground in line is extended to the outside. In this embodiment, the flange 29 is made of metal such as iron. The charging bias contact 120 and the developing bias contact 121 have thickness of approx. 0.1 mm–0.3 mm (electroconductive metal plate such as a stainless steel or phosphor bronze plate) which are extended from inside of the process cartridge. The charging bias contact 120 is exposed on the bottom surface of the cleaning unit C at the side opposite from the side having the drive transmission mechanism, and the developing bias contact 121 and the remaining toner amount detecting contact 122 are exposed on the bottom surface of the developing unit D at the opposite from the side having the drive transmission mechanism.

The drum gear 7*b* is in meshing engagement with the developing roller gear 9*k* to rotate the developing roller 9*c*. The drum gear 7*b*, when it rotates, produces a thrust force (in the direction of an arrow d) which urges the photosensitive drum 7 which is provided in the cleaning frame 13 with a play in the longitudinal direction, toward the side where the drum gear 7*b* is provided. By this, the grounding plate 7*f* fixed on the spur gear 7*n* is pressed against the drum shaft 7*a*. Then, the lateral edge 7*b*1 of the drum gear 7*b* is abutted to the inner end surface 38*b* of the bearing 38 fixed to the cleaning frame 13. By this, the photosensitive drum 7 is correctly positioned in the longitudinal direction in the process cartridge B. The grounding contact 119 is exposed at one side of the cleaning frame 13. The drum shaft 7*a* enters the drum cylinder 7*d* coated with a photosensitive layer 7*e* at the center thereof, the drum cylinder 7*d* being made of aluminum. The drum cylinder 7*d* and the drum shaft 7*a* are electrically connected with each other by the contact of the grounding plate 7*f* to the inner surface 7*d*1 of the drum cylinder 7*d* and the end surface 7*a*1 of the drum shaft 7*a*.

The said charging bias contact 120 is provided adjacent to the position where the cleaning frame 13 supports the charging roller 8. The charging bias contact 120, as shown in FIG. 12, is electrically connecting with the shaft 8*a* of the charging roller 8 through a combination spring 8*b* contacted to the charging roller shaft 8*a*. T he combination spring 8*b* has a coil spring portion compressed between the charging roller bearing 8*c* in sliding engagement with a guide groove extending substantially along a line connecting the centers of the charging roller 8 in the cleaning frame 13 and the photosensitive drum 7 and a spring seat at one end of the guide groove. The combination spring 8*b* is provided with an inner contact and press contacted to the charging roller shaft 8*a* at the seat winding portion adjacent spring seat. The said charging bias contact 120 extends from the exposed portion shown in FIG. 8 into the cleaning frame 13, and is bent so as to cross with a moving direction of the charging roller shaft 8*a* at one end of the charging roller 8, and ends with the spring seat 120*b* on which the combination spring 8*b* is seated.

The description will be made as to the developing bias contact 121 and the remaining toner amount detecting contact 122. These contacts 121, 122 are provided on the bottom surface of the developing unit D provided at the same side as the one lateral edge 13*k* of the cleaning frame 13. The third discharge portion of the developing bias contact 121, that is, the outer contact portion 121*e* is disposed at the side opposite from the charging bias contact 120 with the spur gear 7*n* there between. As described in the foregoing, the developing bias contact 121 is electrically connected with the developing roller 9*c* through a development coil spring contact 9*l* which is electrically connected with a lateral edge of the developing roller 9*c*.

The description will be made as to the relationship between the developing bias contact 121 and the thrust force produced in the drum gear 7*b* and the developing roller gear 9*k*. As described in the foregoing, the photosensitive drum 7 is moved, when it is driven, in the direction indicated by the arrow d in FIG. 11. On the other hand, the developing roller gear 9*k* in meshing engagement with the drum gear 7*b* receives the thrust force into direction opposite from the direction of the arrow d to urge the development coil spring contact 9*l* which urges the developing bias contact 121 as shown in FIG. 18. By this, the urging force provided by the development coil spring contact 9*l* between the developing roller 9*c* and the developing roller shaft reception 9*j* is reduced. I doing so, the contact between the development coil spring contact 9*l* and the developing bias contact 121 is assured, thus reducing the frictional resistance between the end surface of the developing roller 9*c* and the end surface of the developing roller shaft reception 9*j*, thus smoothing the rotation of the developing roller 9*c*.

The remaining toner amount detecting contact 122 shown in FIG. 8 is exposed on the developing device frame 12 upstream of the developing bias contact 121 with respect to the cartridge mounting direction (arrow X in FIG. 9). As shown in FIG. 19, the remaining toner amount detecting contact 122 is a part of the metal antenna rod 9*h* at the toner frame 11 side, the antenna rod 9*h* being extended in the longitudinal direction of the developing roller 9*c*. The antenna rod 9*h* is disposed at a position spaced from the developing roller 9*c* over the entire longitudinal direction of the developing roller 9*c*. When the process cartridge B is mounted to the main assembly 14 of the apparatus, it is contacted to a toner detecting contact member 126 (FIG. 9, 23) in the main assembly 14. The electrostatic capacity between the antenna rod 9*h* and the developing roller 9*c* changes in accordance with the amount of the toner present therebetween. The change in the electrostatic capacity is detected as a change of potential difference by a controller (unshown) electrically connected with the toner detecting contact member 126 in the main assembly 14 of the apparatus, so that remaining toner amount is detected detection.

Here, the amount of the toner providing the electrostatic capacity is the amount of the toner existing between the developing roller 9*c* and the antenna rod 9*h*. By doing so, the event that remaining toner amount in the toner container 11A reaches the predetermined amount can be detected. Therefore, the event is detected by the controller in the main assembly 14 of the apparatus through the remaining toner amount detecting contact 122, which means that remaining toner amount in the toner container 11A reaches the predetermined level. When the main assembly 14 of the apparatus detects that electrostatic capacity riches a first predetermined level, the necessity for the exchange of the process cartridge B is notified by flickering of a lamp or by sound of buzzer. The said controller detects the presence of the process cartridge B mounted to the main assembly 14 by detecting a second predetermined level of the electrostatic capacity which is lower than the first predetermined. The controller permits image forming operation of the main assembly 14 only when it detects the mounted process cartridge B. That is, start of the image forming operation of the main assembly 14 of the apparatus is prohibited otherwise. The unmounting of the process cartridge may be notified by flickering of a lamp or the like.

The description will be made as to connection between the contacts provided in the process cartridge B and contact members provided in the main assembly 14 of the apparatus. On an inner surface at the cartridge mounting space S of the image forming apparatus A at one side, there are provided a grounding contact member 123, a charging contact member 124, a developing bias contact member 125 and a toner detecting contact member 126, which are contacted with the grounding contact 119, the charging bias contact 120, developing bias contact 121 and the remaining toner amount detecting contact 122 when the process cartridge B is mounted to the main assembly of apparatus, as shown in FIG. 9. As shown in FIG. 9, the grounding contact member 123 is provided on the bottom of the positioning groove 16*b*. The developing bias contact member 125, the toner detecting contact member 126 and the charging contact member 124 are provided at a lower portion of one of wall surfaces of the cartridge mounting space S adjacent to the guide portion 16*a* outside the guide portion 16*a* below the guide portion 16*a*. They are elastic in the upward direction.

The description will be made as to the positional relation between the contacts and the guides. The remaining toner amount detecting contact 122 is disposed bottommost position; the developing bias contact 121 is disposed thereabove; the charging bias contact 120 is above it; and the anti-rotation guide 13*b*L and the cylindrical guide 13*a*L (grounding contact 119) are disposed substantially at the same levels above the charging bias contact 120. The positional relationship is based on the horizontal position of the process cartridge B shown in FIG. 6. In the cartridge mounting direction (arrow X), the remaining toner amount detecting contact 122 is disposed most upstream, and the guide 13*b*L and the developing bias contact 121 are disposed next to it (downstream). The cylindrical guide 13*a*L (grounding contact 119) is disposed next to it. The charging bias contact 120 is disclosed next to it. Because of such arrangement, the charging bias contact 120 can be made closer to the charging roller 8; the developing bias contact 121 can be made closer to the developing roller 9*c*; and the remaining toner amount detecting contact 122 can be made closer to the antenna rod 9*h*. By doing so, the distance between the contacts can be reduced in a process cartridge and in image forming apparatus. The dimensions of the contact portion for the contacts are as follows. The charging bias contact 120 is approx. 10.0 mm×10.0 mm; the developing bias contact 121 has a length of approx. 6.5 mm and a width of approx. 7.5 mm; the remaining toner amount detecting contact 122 has a diameter of 2 mm and a width of approx. 18.0 mm; the grounding contact 119 is circular having an outer diameter of approx. 10.0 mm. The above-described charging bias contact 120 and the developing bias contact 121 have rectangular configurations. The lengths of the contacts are major in the mounting direction X of the process cartridge B. and the widths are measured in the direction perpendicular thereto (horizontal).

Figure 23:
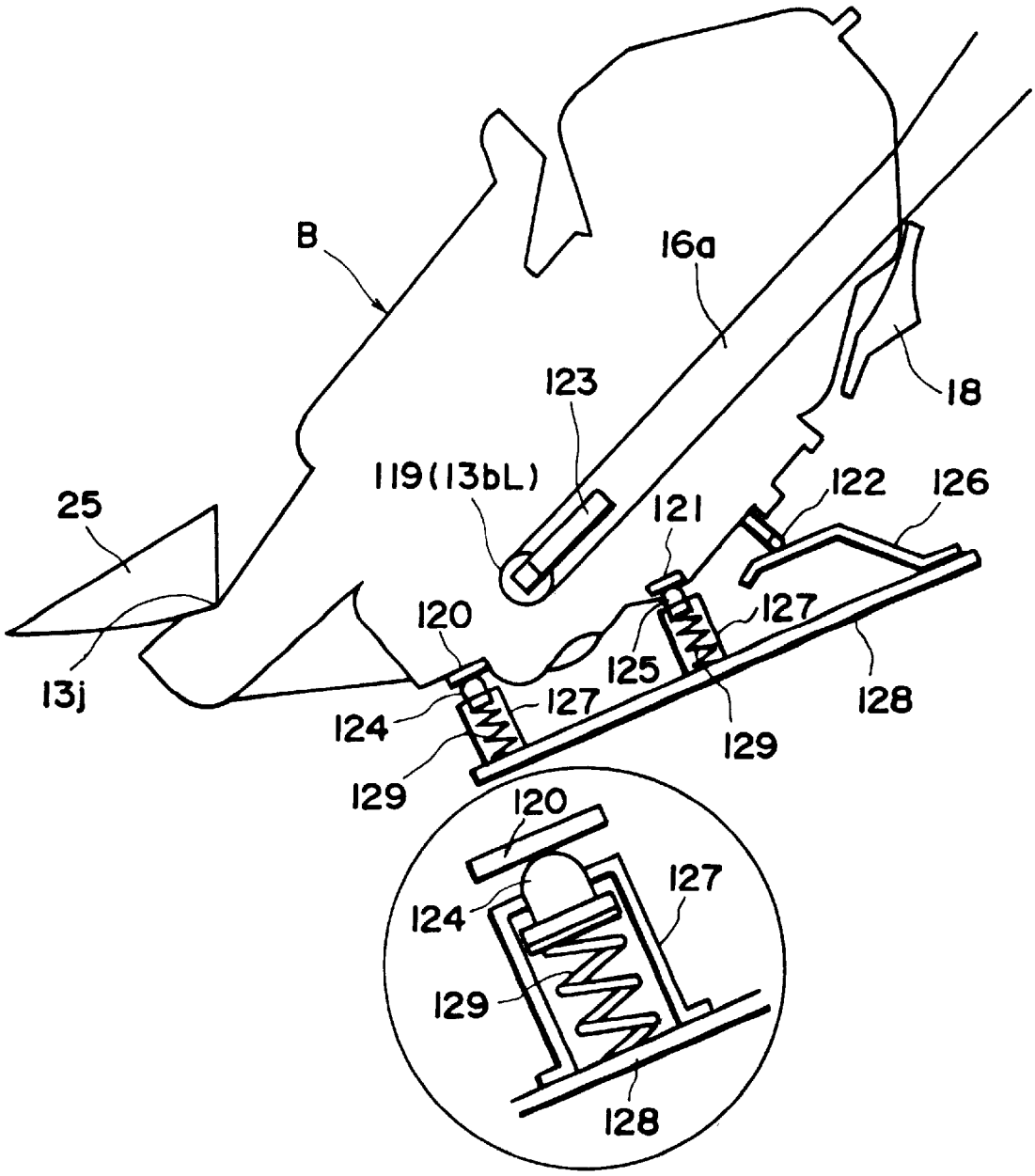
FIG. 23 is a longitudinal sectional view illustrating the relationship between electric contacts when the process cartridge is mounted to the main assembly of the apparatus.

The grounding contact member 123 is made of electroconductive leaf spring and is mounted into the positioning groove 16*b* with which the grounding contact 119, that is, cylindrical guide 13*a*L (the drum shaft 7*a* is positioned) of the process cartridge is engaged (FIGS. 9, 11, 23), and it is grounded through the main assembly frame. The said remaining toner amount detecting contact member 126 is disposed below an adjacent the guide portion 16*a*, and it is made of an electroconductive leaf spring. The other contact members 124, 125 are disposed below and adjacent the guide portion 16*a*, and are projected upward from the holder 127 by compression coil springs 129. This will be described as to the charging contact member 124 as an example. As shown in FIG. 23 in an enlarged manner, the charging contact member 124 is mounted in the holder 127 so as not to fall and so as to be movable upwardly. The holder 127 is fixed to the electrical substrate 128 mounted to the main assembly 14 of the apparatus, and the contact members and the wiring pattern are electrically connected by the electroconductive compression coil spring 129. When the process cartridge B is mounted to the image forming apparatus A with the aid of guide portion 16*a*, the contact members 123–126 are projected outwardly before the process cartridge B reaches the predetermined position.

At this time, the contacts 119–122 are not contacted to the contact members. When the process cartridge B is inserted further, the contacts 119–122 of the process cartridge B are contacted to the contact members 123–126, respectively. With further insertion of a small degree, the cylindrical guide 13*a*L of the process cartridge B is engaged into the positioning groove 16*b*, by which the contacts 119–122 are pressed to the contact members 123–126 against the elastic forces, thus assuring the contact pressure force. Thus, in this embodiment, by the mounting of a process cartridge along the guide member 16, the contacts are assuredly connected with the contact members. The grounding contact member 123, when the process cartridge B is mounted to the predetermined position, the grounding contact member 123 in the form the leaf spring is contacted to the grounding contact 119 projected from the cylindrical guide 13*a*L. When the process cartridge B is mounted to the main assembly 14 of the image forming apparatus, the grounding contact 119 and the grounding contact member 123 are electrically connected to each other to electrically ground the photosensitive drum 7. In addition, the charging bias contact 120 and the charging contact member 124 are electrically connected to each other, so that charging roller 8 can be supplied with a high voltage (AC voltage biased with DC voltage). The developing bias contact 121 and the developing bias contact member 125 are electrically connected to each other to permit application of a high voltage to the developing roller 9*c*. Additionally, the remaining toner amount detecting contact 122 and the toner detecting contact member 126 are electrically connected to each other, so that information relating to the electrostatic capacity between the contact 122 and the developing roller 9*c* can be transmitted to the main assembly 14 of the apparatus. Since the contacts 119–122 are disposed on the bottom surface of the process cartridge B, there is no influence of the positional accuracy in the widthwise direction with respect to the mounting direction of the process cartridge B indicated by the arrow X. The contacts of the process cartridge B are disposed on one side of the cartridge frame come and therefore, the necessary mechanical structure members and the electric wiring members of the main assembly 14 of the image forming apparatus and of the process cartridge B can be properly assigned to the cartridge mounting space S side and the process cartridge B side so that number of assembly steps can be reduced, and the maintenance and inspecting operations are easy.

When the process cartridge B is mounted to the main assembly 14 of the image forming apparatus, a coupling apparatus of the process cartridge and a main assembly side coupling are coupled with each other in interrelation with the closing action of the opening and closing member 35, as will be described hereinafter, by which the photosensitive drum 7 can be driven by the main assembly 14 of the apparatus.

As described in the foregoing, since the electrical contacts of the process cartridge are disposed at one side of the cartridge frame, the electrical connection with the main assembly of the image forming apparatus CA be stabilized. Or, by the arrangement of the contacts, the wiring of the electrodes can be saved in the cartridge.

Coupling and Driving Structure

The description will be made as to the coupling means which is a drive transmission mechanism for transmitting the driving force to the process cartridge B from the main assembly 14 of the image forming apparatus. FIG. 11 is a longitudinal sectional view of the coupling portion wherein the photosensitive drum 7 is mounted to the process cartridge B. As shown in FIG. 11, one longitudinal end of the photosensitive drum 7 mounted to the process cartridge B is provided with cartridge coupling means. The coupling means includes a male coupling shaft 37 (circular column configuration) of a drum flange 36 fixed to said one end portion of the photosensitive drum 7, and the free end surface of the male shaft 37 has a projection 37*a*. The end surface of the projection 37*a* is parallel with the end surface. The male shaft 37 is engaged with the bearing 38 to function as a shaft of the drum. In this embodiment, the drum flange 36, the male coupling shaft 37 and the projection 37*a* are integral. The drum flange 36 is provided with an integral helical drum gear 7*b* to transmit the driving force to the developing roller 9*c* in the process cartridge B. As shown in FIG. 11, the drum flange 36 is integrally molded with the drum gear 7*b*, the male shaft 37 and the projection 37*a*, and constitutes a driving force transmitting part having a function of transmitting the driving force. The configuration of the projection 37*a* is a twisted polygonal prism, more particularly, it has a substantially equilateral triangle cross-section which is gradually and slightly twisted in the rotational direction toward outside along the axis. The recess 39*a* engageable with the projection 37*a* has a polygonal section, and is twisted in the same manner. The pitch and directions of the twistings of the projection 37*a* and the recess 39*a* are substantially the same. The said recess 39*a* has a substantially triangular shape cross-section. The recess 39*a* is formed in a female coupling shaft 39*b* which is integral with the gear 43 provided in the main assembly 14 of the apparatus. The female coupling shaft 39*b* is mounted to the main assembly 14 of the apparatus and is movable in the axial direction and is rotatable. In this embodiment, when the projection 37*a* is engaged with the recess 39*a* of the main assembly 14 after the process cartridge B is mounted to the main assembly 14 in place, and the rotating force is transmitted from the recess 39*a* to the projection 37*a*, edge lines of the projection 37*a* in the form of the substantially equilateral triangular prism are contacted to the inner surface of the recess 39*a* uniformly, and therefore, they are made concentric with each other. The diameter of the circumscribed circle of the male coupling projection 37*a* is larger than the diameter of the inscribed circle of the female coupling recess 39*a* and is smaller than the diameter of the circumscribed circle of the female coupling recess 39*a*. Because of the twisting structure, a thrust force is produced in such a direction that recess 39*a* attracts the projection 37*a* thereto, such that end surface 37*a*1 of the projection is brought into abutment to the bottom 39*a*1 of the recess 39*a*. The thrust force applied to the coupling portion and the thrust force applied to the drum gear 7*b* are codirectional (arrow d), and therefore, the photosensitive drum 7 integral with the projection 37*a* is correctly and stably positioned in the axial direction and in the radial direction in the main assembly 14 of the image forming apparatus. In this embodiment, the rotational direction of the twisting of the projection 37*a* is opposite to the rotational direction of the photosensitive drum 7, as seen from the photosensitive drum 7 away from the base portion toward the free end, and the rotational direction of the twisting of the recess 39*a* is opposite thereto from the entrance of the recess 39*a* toward the inside, and the direction of twisting of the drum gear 7*b* of the drum flange 36 is opposite from the protest of direction of twisting of the projection 37*a*. The said male shaft 37 and the projection 37*a* are provided on the drum flange 36 such that when the drum flange 36 is mounted to one end portion of the photosensitive drum 7, they are concentric or coaxial with the photosensitive drum 7. Designated by 36*b* is an engaging portion which is engaged with the inner surface of the drum cylinder 7*d* when the drum flange 36 is mounted to the photosensitive drum 7. The drum flange 36 is mounted to the photosensitive drum 7 by cramping or by bonding. The circumference of the drum cylinder 7*d* is coated with the photosensitive layer 7*e*. To the other end of the photosensitive drum 7, a spur gear 7*n* is fixed. The material of the drum flange 36 and the spur gear 7*n* is polyacetal, polycarbonate, polyamide, polybutylene terephthalate one like. Another material may be used.

Around the projection 37*a* of the male coupling shaft 37 of the process cartridge B, there is provided a cylindrical projection 38*a* (cylindrical guide 13*a*R) which is concentric with the male shaft 37, integrally with the bearing 38 fixed to the cleaning frame 13 (FIG. 12). By the projection 38*a*, the projection 37*a* of the male coupling shaft 37 is protected when the process cartridge B is mounted to or demounted from the main assembly, so that it is not damaged or the formed by external forces. Therefore, and the possible play or vibration during the coupling driving, attributable to the damage of the projection 37*a*, can be avoided. Furthermore, the bearing 38 functions also has a guide member for guiding the process cartridge B when it is mounted to or demounted from the main assembly 14. More particularly, when the process cartridge B is mounted to the main assembly 14 of the image forming apparatus, the projection 38*a* of the bearing 38 is contacted to the main assembly side guide portion 16*c*, and the projection 38*a* functions as a positioning guide 13*a*R to facilitate the mounting and demounting of the process cartridge B relative to the main assembly 14 of the apparatus. When the process cartridge B is mounted to the apparatus in place, the projection 38*a* is supported by the positioning groove 16*d* provided in the guide portion 16*c*. Among the photosensitive drum 7, the drum flange 36 and the male coupling shaft 37, there is a relationship shown in FIG. 11. That is, $H>F\geqq M$ and $E>N$ are satisfied, where H=the outer diameter of the photosensitive drum 7, E=the dedendum circle diameter of the drum gear 7*b*, F=the bearing diameter of the photosensitive drum 7 (the outer diameter of the shaft portion male coupling shaft 37 and inner diameter of the bearing 38), M=the circumscribed circle diameter of the male coupling projection 37*a*, and N=the diameter of the engaging portion (inner diameter of the drum) between the photosensitive drum 7 and a drum flange 36. By satisfying said $H>F$, a sliding load torque at the bearing portion is smaller than in the case of supporting the drum cylinder 7*d*, and by satisfying $F\geqq M$, the undercut portion is not necessary (when the flange portion is molded, the mold this broken in the direction indicated by an arrow P in the Figure. By satisfying E>N, the mold configuration of the gear portion is provided on the left side mold righthand side as seen in the mounting direction of a process cartridge B, and therefore, the righthand side mold can be simplified, and the durability of the mold is enhanced.

On the other hand, the main assembly 14 of the image forming apparatus is provided with the coupling means of the main assembly. The coupling means of the main assembly has a female coupling shaft 39*b* (circular column configuration) at a position aligned with the rotation axis of the photosensitive drum when the process cartridge B is inserted (FIG. 11). The female coupling shaft 39*b*, as shown in FIG. 11, is a driving shaft which is integral with the large gear 43 for transmitting the driving force from a motor 61 to the photosensitive drum 7. (The female shaft 39*b* is projected from a side of the large gear 43 at the center of rotation of the large gear 43. In this embodiment, the large gear 43 and the female coupling shaft 39*b* are integrally molded. The large gear 43 is a helical gear which is in meshing engagement with a helical small gear 62 integral with or fixed to the shaft 61*a* of the motor 61. The direction and angle of the helical configuration is such that when the driving force is transmitted from the small gear 62, a thrust force is produced in the direction of moving the female shaft 39*b* toward the male shaft 37. By doing so, when the motor 61 is driven for the image forming operation, the female shaft 39*b* is moved toward the male shaft 37 by the first force so that recess 39*a* and the projection 37*a* are brought into engagement with each other. The said recess 39*a* is provided at the free end of the female shaft 39*b* at the center of rotation thereof. In this embodiment, the driving force is transmitting directly from the small gear 62 provided to the motor shaft 61*a* to the large gear 43. However, the use may be made with a gear train for rotational speed reduction, a belt and pulley mechanism, a pair of friction rollers, a timing belt and pulley mechanism.

The description will be made as to engagement between the recess 39*a* and the projection 37*a* in interrelation with the closing operation of the opening and closing member 35. The female coupling shaft 39*b* provided that center of the large gear 43 is rotatably supported in the main assembly 14. Between the large gear 43 and the main assembly 14, unshown outer cam and inner cam are closely interposed. The inner cam is fixed to the main assembly 14, and the outer cam is rotatably engaged with the female coupling shaft 39*b*. The surfaces of the outer cam and the inner cam face to each other in the axial direction are cam surfaces, which are screw surfaces contacted to each other with their centers aligned with the center of the female coupling shaft 39*b*. Between the large gear 43 and the main assembly 14, an unshown compression coil spring compressed, and the compression coil spring is inserted into the female coupling shaft 39*b*. An arm it extending in the radial direction from the outer periphery of the outer cam 63, and the free end of the arm and the pivot 35*a* of the opening and closing member 35 is coupled to a link mechanism. When the opening and closing member 35 is opened, the outer cam rotates, the opposed cam surfaces of the outer cam and the inner cam slide relative to each other, by which the large gear 43 movements away from the photosensitive drum 7. At this time, the large gear 43 is urged by the outer cam and moves while pushing the unshown compression coil spring compressed between the main assembly 14 and the large gear 39, and the female coupling recess 39*a* is away from the male coupling projection 37*a* so that coupling connection is released. Therefore, the process cartridges mountable or demountable. When the opening and closing member 35 is closed on the other hand, the outer cam rotates in the opposite direction; and it is urged by the spring, so that large gear 43 moves rightward to the position shown in FIG. 11, and the large gear 43 is engaged with the male coupling projection 37*a*, so that driving force transmittable state is established. With said structure, the mounting-and-demounting state and the operable state are established in interrelationship with the opening and closing member 35. By closing the opening and closing member 35, the outer cam rotates in the opposite direction, so that large gear 43 moves rightward, and the end surfaces of the female coupling shaft 39*b* and the male coupling shaft 37 are abutted to each other. If, at this time, the male coupling projection 37*a* and a female coupling recess 39*a* are not coupled with each other, but they will be coupled immediately after start of rotation.

In this manner, in this embodiment, when the process cartridge B is mounted to or demounted from the main assembly 14, the opening and closing member 35 is released. In interrelation with the opening and closing of the member 35, the female coupling recess 39*a* moves in a horizontal direction. When the process cartridge B is mounted to or demounted from the main assembly 14 of the apparatus, the process cartridge B and the coupling (37*a*, 39*a*) of the main assembly 14 are not coupled. Therefore, the process cartridge B can be mounted to or demounted from smoothly relative to the main assembly 14 of the apparatus. In this embodiment, the female coupling recess 39*a* is urged toward the process cartridge B by the large gear 43 being pushed by the unshown compression coil spring. Therefore, even if the male coupling projection 37*a* and the recess 39*a* are not aligned to be coupled, when the motor 61 first rotates up to the mounting of process cartridge to the main assembly, they are instantaneously coupled.

The description will be made as to the considerations of the projection 37*a* and the recess 39*a* which other engaging portions of the coupling mechanism. As described hereinbefore, the female coupling shaft 39*b* of the main assembly 14 of the apparatus is movable in the axial direction but not movable in the radial direction. On the other hand, the process cartridge B is movable in the cartridge mounting direction (X direction (FIG. 9) ) and also in the longitudinal direction when a process cartridge is mounted into main assembly 14 in place. In the longitudinal direction, the process cartridge B is movable in the small distance between the guide members 16R, 16L provided in the cartridge mounting space S. More particularly, when the process cartridge B is mounted to the main assembly 14 of the apparatus, the portion of the cylindrical guide 13*a*L (FIGS. 6, 7, 9) form on the flange 29 mounted to the other longitudinal end of the cleaning frame 13 enters the positioning groove 16*b* (FIG. 9) of the main assembly 14 without gap, so that it is correctly position, and the spur gear 7*n* fixed to the photosensitive drum 7 is brought into meshing engagement with the gear (unshown) for transmitting the driving force to the transfer roller 4. On the other hand, had one longitudinal end (driving end) of the photosensitive drum 7, the cylindrical guide 13*a*R of the cleaning frame 13 is supported by the positioning groove 16*d* provided in the main assembly 14. By the cylindrical guide 13*a*R being supported by the positioning groove 16*d* of the main assembly 14 of the apparatus, the concentricity $\phi$ between the drum shaft 7*a* and a female shaft 39*b* is within 2.00 mm, by which a first aligning function in the coupling action process is accomplished. By the opening and closing member 35 being closed, the female coupling recess 39*a* moves in the horizontal direction to be engaged with the projection 37*a* (FIG. 11).

Then, the driving side (coupling side) is positioned, and the drive transmission is established there, in the following manner. First, when the driving motor 61 of the main assembly 14 of the apparatus rotates, the female coupling shaft 39*b* moves in the direction opposite from the arrow d in FIG. 11, that is, toward the male coupling shaft 37. When the phase alignment is reached between the male coupling projection 37*a* and the recess 39*a* (in this embodiment, the projection 37*a* and the recess 39*a* have substantially equilateral triangle cross-section, and therefore, the phase alignment is reached at every 120°), they are engaged. When the male coupling projection 37*a* enters the recess 39*a* upon the engagement therebetween, the entering is smooth because the sizes of the equilateral triangles are slightly different, more particularly, the section of the female coupling recess 39*a* is larger than the equilateral triangle of the male coupling projection 37*a*.

In the state in which the male coupling projection 37*a* has entered the recess 39*a*, when the female coupling shaft 39*b* rotates, the three edge lines of the equilateral triangular column of the projection 37*a* are contacted to the inner surface of the female coupling recess 39*a* so that driving force is transmitted. The male coupling shaft 37 is moved instantaneously such that edge lines of the projection 37*a* are uniformly contacted to the inner surface of the female coupling recess 39*a* in the form of a regular polygonal shape, so that male coupling shaft 37 is moved to be aligned with the female shaft 39*b* instantaneously. With this structure, the male coupling shaft 37 and the female shaft 39*b* are aligned with each other automatically when the motor 61 is driven. By the transmission of the driving force to the photosensitive drum 7, a rotational force is applied to the process cartridge B, by which the regulating abutment 13*j* (FIGS. 4, 5, 6, 7, 23) provided at the top surface of the cleaning frame 13 of the process cartridge B is urged to the fixing member 25 (FIGS. 9, 10, 23) with stronger force, so that position of the process cartridge relative to the main assembly is determined. When the driving force is not applied, there is a gap in the radio direction between the male coupling projection 37*a* and the recess 39*a*, and therefore, the coupling can be easily released. During the driving, the contact force at the coupling portion is stable, so that possible play or vibration can be suppressed.

Figure 26:
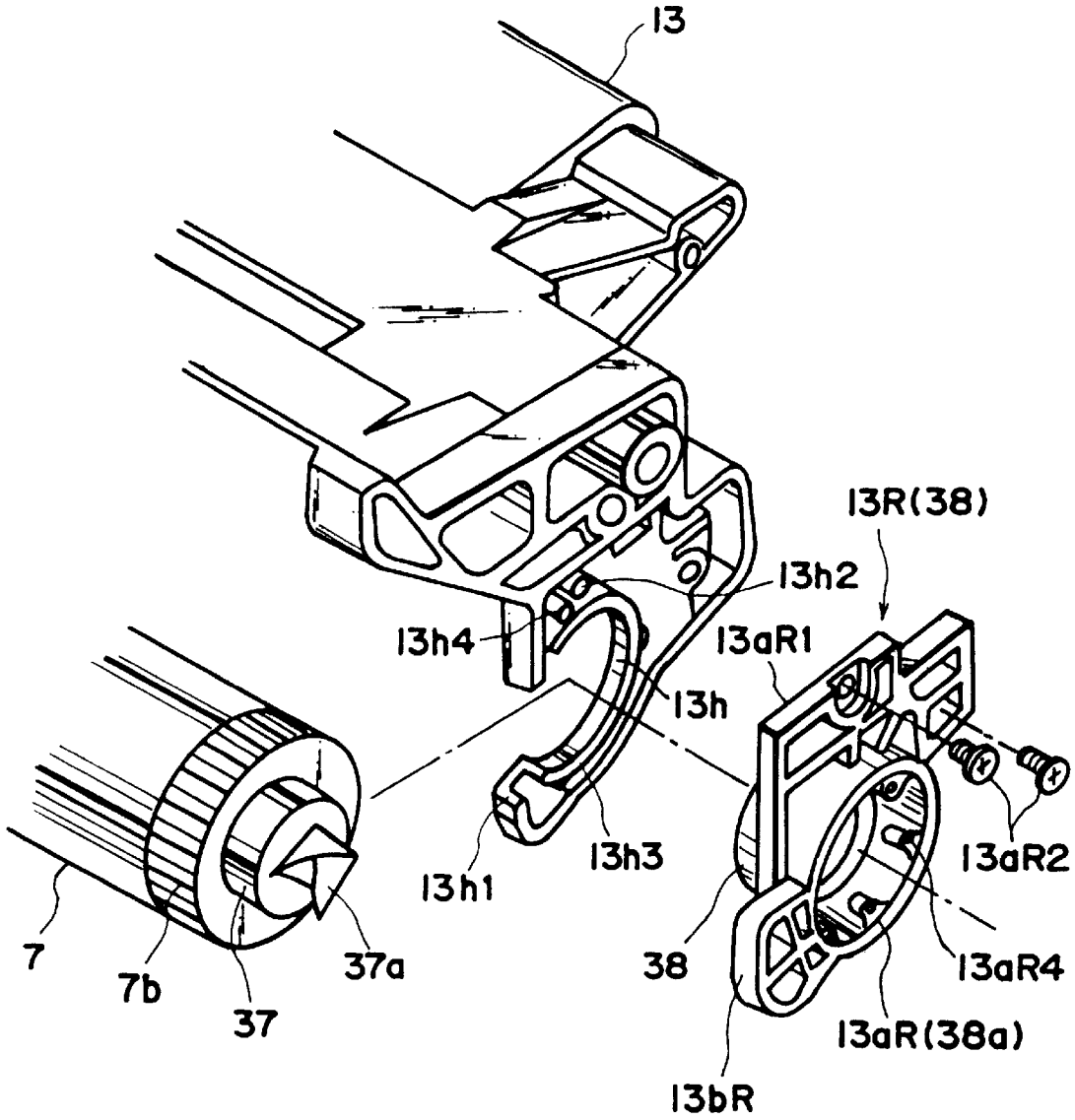
FIG. 26 is a perspective view illustrating a mounting portion for mounting the photosensitive drum to the cleaning frame.
Figure 27:
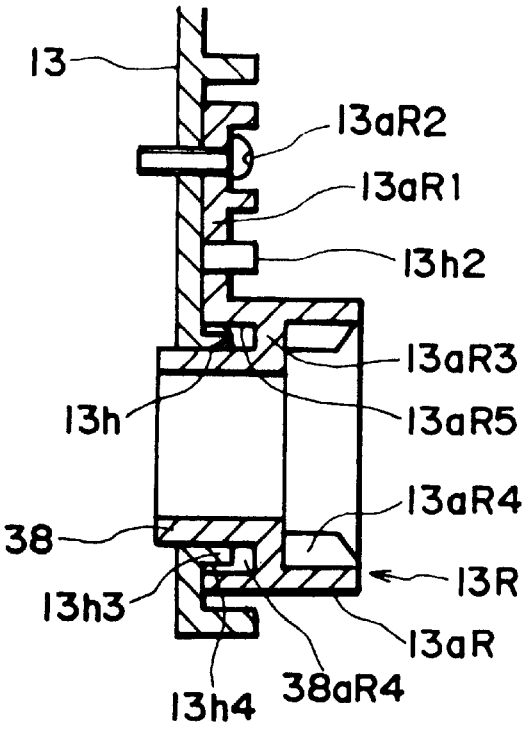
FIG. 27 is a longitudinal sectional view illustrating a drum shaft receiving portion.
Figure 28:
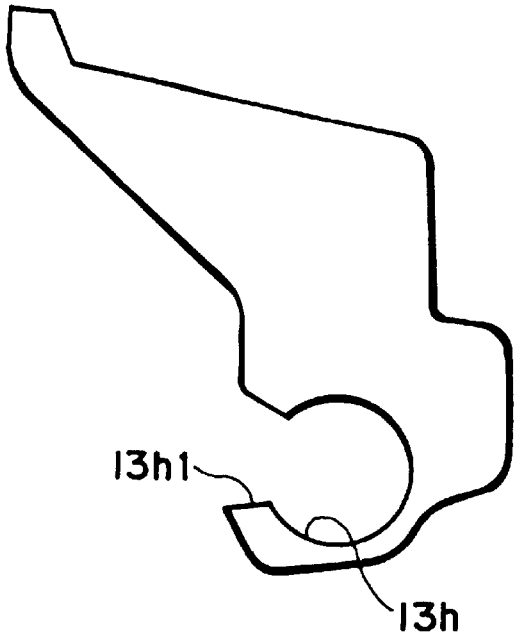
FIG. 28 is a side view illustrating an outer configuration of the drum shaft receiving portion.

FIG. 26 FIG. 26 shows the mounting of the right-hand guide member 13R to the cleaning frame 13 in detail; FIG. 27 is a longitudinal sectional view wherein the right-hand guide member 13R has been mounted to the cleaning frame 13; and FIG. 28 shows a part of the right-hand surface of the cleaning frame 13.

Figure 29:
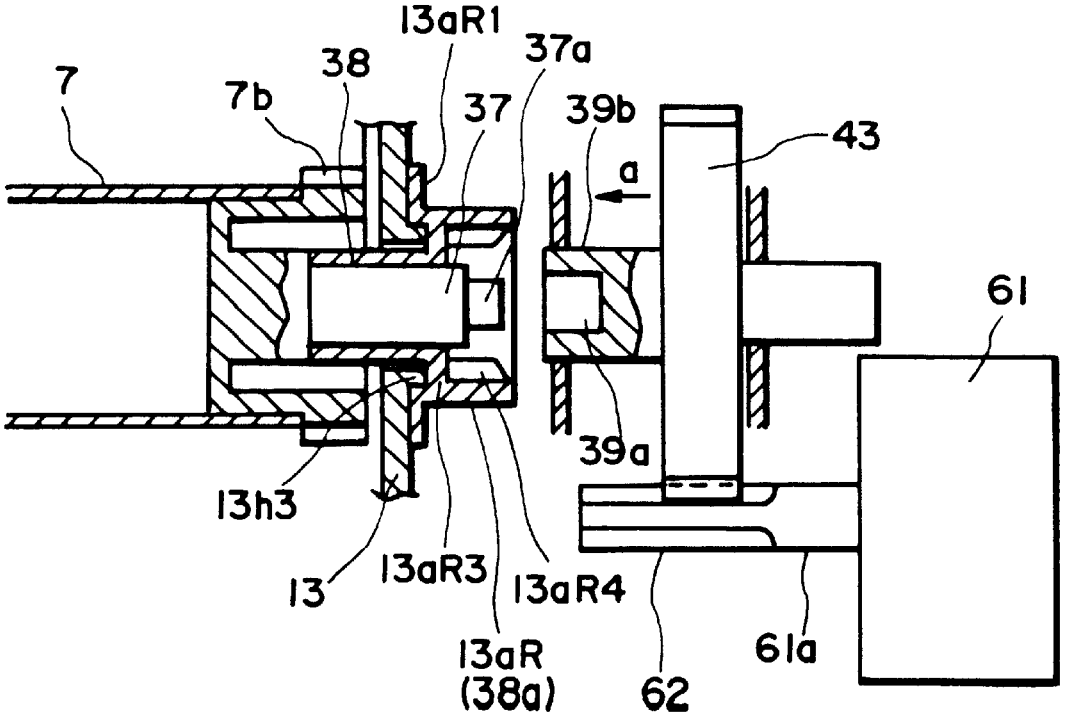
FIG. 29 is a developed sectional view of a drum shaft receiving portion according to another embodiment of the present invention.

FIG. 29 is a side view schematically showing the mounting portion of the bearing 38 integrally formed with the right-hand guide member 13R. The description will be made as to the mounting of the right-hand guide member 13R integral with the bearing 38 to the cleaning frame 13 shown in FIG. 11 and as to the mounting of the photosensitive drum 7 in the form of a unit to the cleaning frame 13. A rear surface of the right-hand guide member 13R is provided with a small diameter bearing 38 which is concentric with the cylindrical guide 13*a*R, as shown in FIGS. 26, 27. The bearing 38, shown in FIG. 29, is connected to an end of the cylindrical bearing 38 at the disk member 13*a*R3 which is provided axially at the middle of the cylindrical guide 38*a*R. Between the bearing 38 and the cleaning frame 13 side cylindrical guide 13*a*R, a circular groove 38*a*R4 is formed as seen from the inside of the cleaning frame 13. A side surface of the cleaning frame 13 is provided with a bearing mounting hole 13*h* having a partly cut-away circular cross-section as shown in FIGS. 26, 28, the cut-away portion 13*h*1 provides a gap which is smaller than the diameter of the bearing mounting hole 13*h* and which is larger than the diameter of the male coupling shaft 37. The male coupling shaft 37 is spaced from the bearing mounting hole 13*h* to permit engagement with the bearing 38. The positioning pin 13*h*2 integrally formed with the side surface of the cleaning frame 13 is closely fitted in a hole (unshown) of the flange 13*a*R1 of the guide member 13R.

Figure 30:
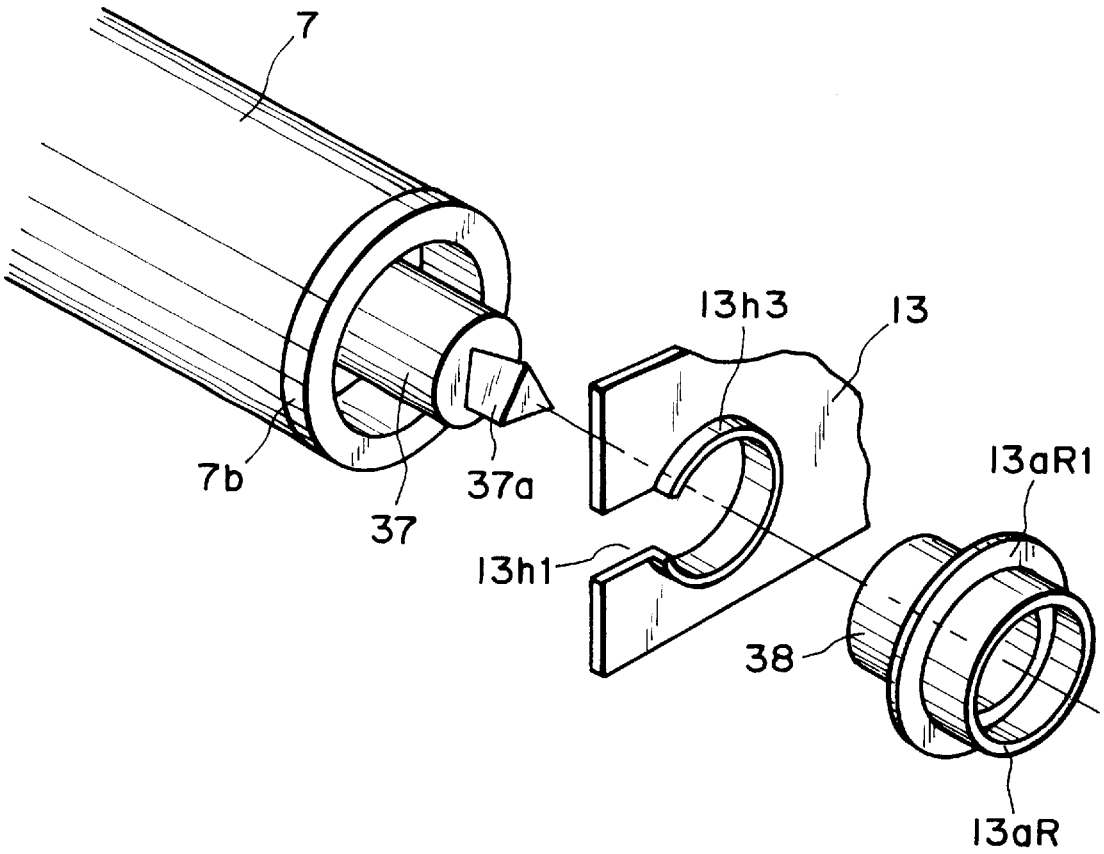
FIG. 30 is a perspective view schematically illustrating the drum shaft receiving portion.

By doing so, the photosensitive drum 7 in the form of a unit can be mounted to the cleaning frame 13 in the direction crossing with the axial direction (longitudinal direction), and when the right-hand guide member 13R is mounted to the cleaning frame 13 in the longitudinal direction, the position of the right-hand guide member 13R relative to the cleaning frame 13 is correct. When the photosensitive drum 7 in the form of a unit is mounted to the cleaning frame 13, the photosensitive drum 7 is moved in the direction crossing with the longitudinal direction as shown in FIG. 26, and the male coupling shaft 37 is passed through the cutaway portion 13*h*1 and is inserted into the bearing mounting hole 13*h* such that drum gear 7*b* is in the cleaning frame 13. In the state, the drum shaft 7*a* integral with the left-hand guide 13*a*L shown in FIG. 11 is passed through the lateral edge 13*k* of the cleaning frame 13, and is brought into engagement with the spur gear 7*n*. A small screw 13*d* is threaded into the cleaning frame 13 through the flange 29 of the guide 13*a*L, thus fixing the guide 13*a*L to the cleaning frame 13, and supporting one end of the photosensitive drum 7. Subsequently, the outer periphery of the bearing 38 integral with the guide member 13R is fitted into the bearing mounting hole 13*h*, and the inner surface of the bearing 38 is fitted around the male coupling shaft 37, and in addition, the positioning pin 13*h*2 of the cleaning frame 13 is inserted into the hole of the flange 13*a*R1 of the right-hand guide member 13R. A small screw 13*a*R2 is threaded into the cleaning frame 13 through the flange 13*a*R1 so that right-hand guide member 13R is fixed to the cleaning frame 13. By doing so, photosensitive drum 7 is firmly and accurately fixed to the cleaning frame 13. Since the photosensitive drum 7 is mounted to the cleaning frame 13 in the direction crossing with the longitudinal direction of the photosensitive drum 7, it is not necessary to move the photosensitive drum 7 in the longitudinal direction, so that longitudinal dimension of the cleaning frame 13 can be reduced. This is also effective to reduce the size of the main assembly 14 of the image forming apparatus. As to the left side cylindrical guide 13*a*L, the large flange 29 is contacted and fixed to the cleaning frame 13, and the drum shaft 7*a* integral with the flange 29 is closely fitted with the cleaning frame 13. As to the righthand side cylindrical guide 13*a*R, it is concentric with and integral with the bearing 38 supporting the photosensitive drum 7, and the bearing 38 is engaged with the bearing mounting hole 13*h* of the cleaning frame 13. Therefore, the photosensitive drum 7 can be placed correctly at right angles relative to the feeding direction of the recording material 2. As to the left side cylindrical guide 13*a*L, the large area flange 29 and the drum shaft 7*a* abutted thereto are made on integral metal, and therefore, the position of the drum shaft 7*a* is correct, so that anti-wearing property is improved. The cylindrical guide 13*a*L is not worn even if process cartridges B are repeatedly mounted to or demounted from the main assembly 14 of the image forming apparatus. As described in the foregoing with respect to the electric contacts, the grounding of the photosensitive drum 7 is easy. The righthand side cylindrical guide 13*a*L has a diameter larger than that of bearing 38, and the bearing 38 and the cylindrical guide 13*a*R are contacted by the disk member 13*a*R3, and the cylindrical guide 13*a*R is connected with the flange 13*a*R1, so that cylindrical guide 13*a*R and the bearing 38 are mutually reinforced. Since the right-hand cylindrical guide 13*a*R has a larger diameter, it is durable against the repeated mounting and demounting of the process cartridges B relative to the main assembly 14 of the image forming apparatus although it is made of a synthetic resin material. FIGS. 29, 30 is a developed longitudinal sectional view illustrating another mounting method of the bearing 38 which is integral with the right side guide member 13R. In the Figure, the bearing 38 for the photosensitive drum 7 is mainly shown. As shown in FIG. 29, the outside edge of the bearing mounting hole 13*h* is provided with a rib 13*h*3 extending in the circumferential direction, and the outer periphery of the rib 13*h*3 constitutes a part of a cylinder. In the example, the outer periphery of the rib 13*h*3 is closely engaged with the circumference of such a portion of the right-hand cylindrical guide 13*a*R as is beyond the disk member 13*a*R3 to the flange 13*a*R1. The bearing mounting portion 13*h* of the bearing 38 and the outer periphery of the bearing 38 are loosely fitted. Therefore, the bearing mounting portion 13*h* is not continuous because of the provision of the cut-away portion 13*h*1 so that opening tendency of the cut-away portion 13*h*1 can be suppressed.

For the same purpose, a plurality of confining bosses 13*h*4 may be provided on the outer periphery of the rib 13*h*3, as shown in FIG. 27. The confining boss 13*h*4 is controlled during manufacturing of the metal mold such that circumscribed circle diameter has an IT tolerance of class 9, and said the concentricity relative to the inside circumference of the mounting hole 13*h* is within 0.01 mm. When the drum shaft reception 38 is mounted to cleaning frame 13, the mounting hole 13*h* of the cleaning frame 13 and the outside circumference of the bearing 38 are fitted, and the inner surface 13*a*R5 of the drum shaft 38 faced to the outside circumference is 50 while confining the confining boss 13*h*4 at the cleaning frame 13 side, and therefore, the possible eccentricity attributable to the cut-away portion 13*h*1 during the assembling operation of the bearing.

Coupling Between Cleaning Frame (Drum Frame) and Developing Device Frame

Figure 25:
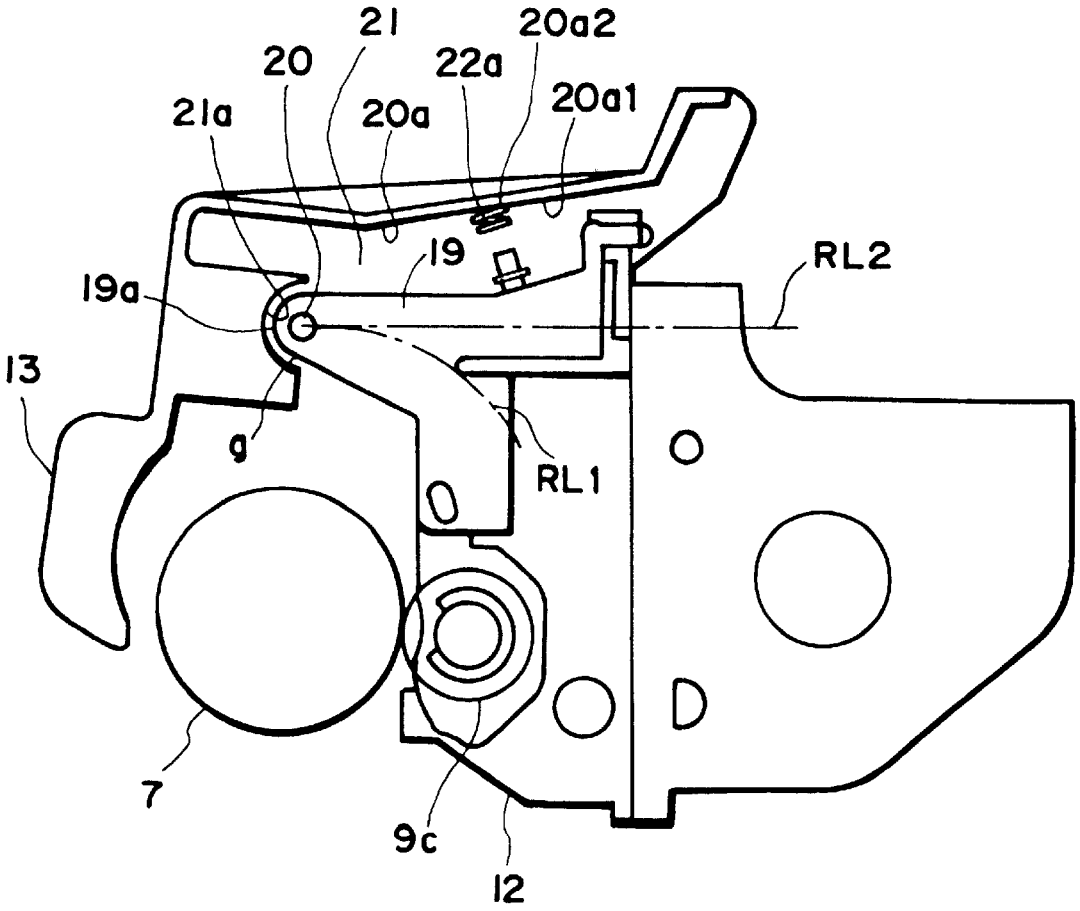
FIG. 25 is a longitudinal sectional view illustrating a coupling portion between the drum frame and the developing device frame.

The cleaning frame 13 containing the charging roller 8 and the cleaning means 10, and the developing device frame 12 containing the developing means 9, are coupled with each other. Usually, the process cartridge B comprises a drum frame 13 containing the electrophotographic photosensitive drum 7 and a developing device frame 12 containing the developing means 9, which are coupled with each other. Referring to FIGS. 12, 13, 25, the description will be made as to the structure of coupling the drum frame 13 and the developing device frame 12 with each other. Here, the "left" and "right" are those as seen from the top side in the direction of the feeding of the recording material 2.

The process cartridge detachably mountable to the main assembly 14 of the electrophotographic image forming apparatus comprises an electrophotographic photosensitive drum 7, a developing means 9 for developing a latent image formed on the electrophotographic photosensitive drum 7, a developing device frame 12 supporting the developing means 9, a drum frame 13 supporting the electrophotographic photosensitive drum 7, a toner frame 11 including a toner accommodating portion, a compression coil spring 22*a*, provided at each of longitudinal opposite end portions of the developing means 9 and having one end mounted to such a portion of the developing device frame 12 as is about the developing means 9 and the other end contacted to the drum frame 13, a first projected portion (arm portion 19 at the righthand side) projected in the direction perpendicular to the longitudinal direction of the developing means 9 at each of one month of the other longitudinal ends of the developing means 9, a second projected portion (arm portion 19 at the left side), a first opening (hole 20 at the right side) provided in the first projected portion (the arm portion 19 at the righthand side), a second opening (hole 20 at the left side) provided in the second projected portion (arm portion 19 at the left side), a first engaging portion recess 21 at the righthand side) provided at a longitudinal end portion of the drum frame 13 and in the portion of the drum frame 13 of above the electrophotographic photosensitive drum 7 and engaged with the first projected portion (arm portion 19 at the right side), a second engaging portion (recess 21 at the left side) provided a other longitudinal end portions of the drum frame 13 and in the portion of the drum frame 13 about the electrophotographic photosensitive drum 7 and engaged with the second projected portion (arm portion 19 at the left side), a third opening (hole 13*e* at the righthand side in FIG. 12) provided in the first engaging portion (recess 21 at the righthand side), a fourth opening (hole 13*e* at the left side in FIG. 12) provided in the second engaging portion (recess 21 at the left side), a first penetrating member (connecting member 22 at the righthand side in FIG. 12) penetrating the first opening (hole 20 at the right side) and the third opening (hole 13*e* at the righthand side) with the first projected portion (arm portion 19 at the righthand side) and the first engaging portion (recess 21 at the righthand side) engaged with each other to couple the drum frame 13 and the developing device frame 12, and a second penetrating member (connecting member 22 at the left side in FIG. 12) penetrating the second opening (hole 20 at the left side) and the fourth opening (hole 13*e* at the left side) with the second projected portion (arm portion 19 at the righthand side) and the second engaging portion (recess 21 at the left side) to couple the drum frame 13 and the developing device frame 12.

The assembling method of the developing device frame 12 and the drum frame 13 comprises a first engaging step of engaging the developing device frame 12, the first projected portion (the righthand side arm portion. 19) of the drum frame 13 and the first engaging portion (righthand side recess 21); a second engaging step of engaging the second projected portion (left side arm portion 19) and the second engaging portion (left side recess 21); a first penetration step of penetrating the first penetrating member (righthand side connecting member 22) through the first opening (righthand side hole 20) provided in the first projected portion (righthand side arm portion 19) and through the third opening (righthand side hole 13*e*) provided in the first engaging portion (righthand side recess 21) with the first projected portion (righthand side arm portion 19) and the first engaging portion (righthand side recess 21) engaged with each other to couple the drum frame 13 and the developing device frame 12; and a second penetration step of penetrating the second penetrating member (left side connecting member 22) through the second opening (left side hole 20) provided in the second projected portion (left side arm portion 19) and through the fourth opening (left side hole 20) provided in the second engaging portion (left side recess 21) with the second projected portion (left side arm portion 19) and the second engaging portion (left side recess 21) the couple the developing device frame 12 and the drum frame 13 with each other. By this, the developing device frame 12 and the drum frame 13 are made integral into a process cartridge B.

In this manner, the developing device frame 12 and the drum frame 13 are engaged with each other, and they can be coupled with each other by penetrating the connecting or the coupling members 22. It can be easily disassembled into the developing device frame 13 and the drum frame 13 by simply removing the connecting members 22. Thus, the assembling and disassembling operations are easy.

The developing means 9 is provided with the developing roller 9*c*; and the first engaging step of engaging the first projected portion and the first engaging portion with each other and the second engaging step of engaging the second projected portion and the second engaging portion, are simultaneously carried out; and (1) the electrophotographic photosensitive drum 7 and the developing roller 9*c* are arranged substantially parallel with each other, (2) the developing roller 9*c* is moved along the periphery of the electrophotographic photosensitive drum 7, (3) the developing device frame 12 is rotated with the movement of the developing roller 9*c*, (4) the first and second projected portion (arm portions 19) enter the first and second engaging portions (recesses 21) by the rotation of the developing device frame 12, and (5) the first and second projected portion (arm portions 19) are engaged with the first and second engaging portion (recesses 21). By doing so, it is possible that arm portion 19 is brought close to the recess 21 with the spacer rollers 9*i* contacted to the peripheral surfaces of the photosensitive drum 7, by rotation of the developing roller 9*c* about the photosensitive drum 7, and therefore, the position where the arm portion 19 and the recess 21 are engaged with each other is constant. Therefore, the configurations of the arm portion 19 and the recess 21 can be determined so as to make it easier to align the hole 20 provided in the arm portion 19 of the developing device frame 12 and the hole 13*e* provided at each side of the recess 21 of the drum frame 13.

As described in the foregoing, it is usual that developing unit D having the toner frame 11 and the developing device frame 12, and the cleaning unit C having the cleaning frame 13 and the charging roller 8, are coupled with each other.

Figure 24:
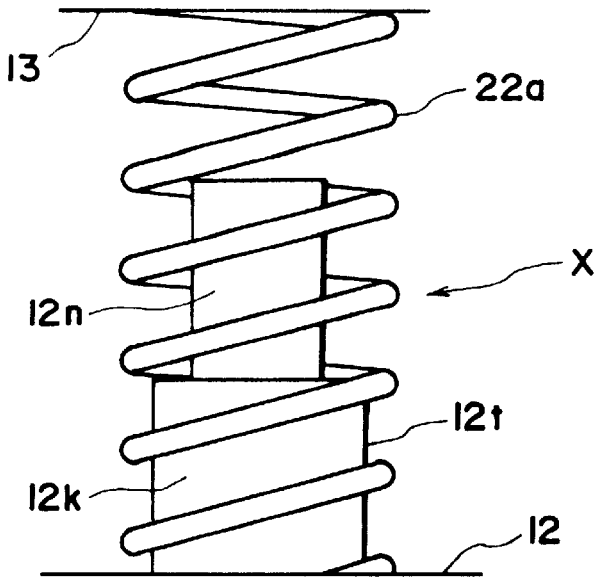
FIG. 24 is a side view illustrating a mounting portion for a compression coil spring.

When the developing device frame 12 and the drum frame 13 are engaged in this manner, the opening against (holes 20) of the first and second projected portion and the opening (hole 13*e*) of the second engaging portion are substantially aligned to permit penetration of the penetrating member (engaging member 22) therethrough. As shown in FIG. 25, the free end 19*a* of the arm portion 19 is accurate having a center at the hole 20, and the bottom 21*a* of the recess 21 is accurate having a center at the hole 13*e*. The radius of the arcuation at the free end of the arm portion 19 is slightly smaller than the radius of the arcuate portion 21*a* at the bottom of the recess 21. The difference is such that when the free end 19*a* of the arm portion 19 is abutted to the bottom 21*a* of the recess 21, the connecting member 22 is demonstrated through the hole 13*e* of the drum frame (cleaning frame) 13, and the connecting member 22 having a beveled and is easily inserted into the hole 20 of the arm portion 19. When the connecting member 22 is inserted, an accurate gap g is formed between the free end 19*a* of the arm portion 19 and the bottom 21*a* of the recess 21, so that arm portion 19 is rotatably supported by the connecting member 22. For the convenience of explanation, the gap g is exaggerated in the Figure, but actually, the gap g is smaller than the end of the connecting member 22 or the dimension of the beveling. As shown in FIG. 25, when the developing device frame 12 and the drum frame 13 are assembled, the hole 20 of the arm portion 19 traces a track RL1 or RL2 or a portion between the tracks RL1, RL2. At this time, the inner surface 20*a* of the upper wall of the recess 21 is continuously inclined to such that compression coil spring 22*a* continuously and gradually compressed. More particularly, the distance between the mounting of the compression coil spring 22*a* to the developing device frame 12 and the inner surface 20*a* of the upper wall of the recess 21 opposed to the mounting portion during the assembling operation, gradually decreases by the determination of the associated dimensions. In this example, the upper coil seat of the compression coil spring 22*a* is contacted to the inclined portion 20*a*1 of the inner surface 20*a*, and in the state of completion of the coupling between the developing device frame 12 and the drum frame 13, the compression coil spring 22*a* is contacted to the spring seat portion 20*a* 2 continuing to the inclined portion 20*a*1. The compression coil spring 22*a* and the spring seat portion 20*a* 2 are orthogonal to each other. With this structure, it is not necessary to particularly compress the compression coil spring 22*a* when the developing device frame 12 and the drum frame 13 are coupled with each other. The assembling operation is easy, and the spacer rollers 9*i* are brought into contact to the photosensitive drum 7 automatically. The track RL1 is an arcuation having a center which is concentric with the photosensitive drum 7, and the track RL2 is substantially linear such that distance from the inclined portion 20*a*1 gradually decreases toward the right side. As shown in FIG. 24, the compression coil spring 22*a* is supported on the developing device frame 12. FIG. 24 is a longitudinal sectional view taken along a line extending in the process cartridge B mounting direction X in the neighborhood of the base portion of the arm portion 19 of the developing device frame 12. On the developing device frame 12, there is provided a spring holding portion 12*t* extending upward. The base portion of the holding portion 12*t* is provided with a spring fixing portion 12*k* in the form of a cylinder around which the inner periphery of the seat coil portion of the compression coil spring 22*a* is press-fitted, and a guide portion 12*n* having a small diameter than the fixing portion to receive the compression coil spring 22*a*. The height of the spring fixing portion 12*k* is not less than one turn of the coil, but practically it is not less than to provide two turns. As shown in FIG. 12, a partition wall 13*t* is provided in the inside of each of the outer wall 13*s* and the outer wall 13*s* of the drum frame 13 with a space there between two provide a recess 21. As shown in FIG. 12, the inner side of the outer wall 13*s* and the side of the partition wall 13*t* opposed to the outer wall 13*s*, constituting the recess 21 at the right side where drum gear 7*b* is provided, are perpendicular to the longitudinal direction, and the arm portion 19 of the developing device frame 12 at the right side where the developing roller gear 9*k* is provided is closely fitted into between the opposing walls. On the other hand, the arm portion 19 of the developing device frame 12 is loosely (in the longitudinal direction) fitted into the recess 21 of the cleaning frame 13 at the left side where the spur gear 7*n* is provided. By this, the developing device frame 12 and the cleaning frame 13 are correctly position in the longitudinal direction. This is because the distance between the opposing walls of the recess 21 at one longitudinal end portion can be relatively easily made correct, and the width of the arm portion 19 can be relatively easily made correct. Even if the dimension difference occurs in the longitudinal direction due to thermal deformation provided by temperature rise of the developing device frame 13 and the cleaning frame 12, the thermal deformation difference in the small distance between the opposing walls of the recess 21 or in the small width of the arm portion 19 received between the opposing walls is small. Despite the relatively large dimension change in the total length due to the thermal deformations of the developing device frame 12 and the cleaning frame 13, the recess 21 at the spur gear 7*n* side and the arm portion 19 received by the recess 21 are loosely fitted into longitudinal direction, and therefore, no stress is produced between the developing device frame 12 and the cleaning frame 13.

Any one of the remanufacturing steps may be automated using a robot. The process cartridge B to which the present invention is applicable is not limited to a process cartridge for formation of the monochromatic image is, but maybe a color cartridge for formation of multicolor image is (two-color images, three-color images, full-color images or the like) using a plurality of developing means. In the above-described, the electrophotographic photosensitive member has been described as photosensitive drum, but the electrophotographic photosensitive member is not limited to such a photosensitive drum, but the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like. Also, the present invention is preferably usable with various known developing methods such as the magnetic brush developing method using two component toner, the cascade developing method, the touch-down developing method, the cloud developing method. The structure of the charging means described in the foregoing is of a so-called contact type charging method, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charged the surface, is usable. The charging means may be a roller type as described in the foregoing, a blade type (charging blade), a pad type, a block type, a rod type, a wire type or the like. As for a cleaning method for removing toner remaining on the photosensitive drum, a blade, a fur brush, a magnetic brush or the like is usable.

Remanufacturing of Process Cartridge

The description will be made as to the remanufacturing method of the process cartridge.

The remanufacturing method comprises a unit separating step of separating the developing unit and the cleaning unit from each other, more particularly, the separating step between the developing unit D and the developing unit D. As described in the foregoing, the coupling between the developing device frame 12 and the drum frame 13 is accomplished by the connecting member 22 penetrating the hole 20 formed in the left and right arm portions 19 of the developing device frame 12 and the left and right holes 13*e* formed in the drum frame 13. Therefore, the disassembling therebetween is easily accomplished by removing the connecting member 22. The use can be made with an usual tool such as nippers, pinches or a special tool which corresponds to the shape of the process cartridge B. FIGS. 13 and 12 show the developing unit D and the cleaning unit C thus disassembled.

Developing Roller Dismounting Step

As described in [Developing device frame], the developing roller unit G is supported by mounting the bearing box 9*v* and the drive transmission unit DG to the side plates 12B, 12A of the developing device frame 12 as shown in FIG. 14. Therefore, unshown small screws fixing the bearing box 9*v* and the drive transmission unit DG to the side plates 12B, 12A of the developing device frame 12 are removed by a screwdriver, and the bearing box 9*v* and the drive transmission unit DG are dismounted, and then the developing roller unit G is pulled up.

Developing Blade Dismounting Step

As described in [Developing device frame], the developing blade 9*d* is affixed to the developing device frame 12 by threading the small screws 9*d*6 into the female screws 12*i*2 through the screw bores 9*d*4 formed in the metal plate 9*d*1 and through the screw bores 9*y*1*a*, 9*y*2*a* formed in the scraper (righthand side) 9*y*1 and the scraper (left side) 9*y*2. Thus, the scraper 9*y*1 (righthand sides) and the 9*y*2 (left side) and the metal plate 9*d*1 on the flat surface 12*i* (FIG. 14). Therefore, the small screws 9*d*6 are removed by a tool such as a screwdriver, the scraper (righthand side) 9*y*1 and the scraper (left side) 9*y*2 and the developing blade 9*d* are removed by pulling them up away from the blade abutment flat surface 12*i*. Then, they are dismounted.

Elastic Member Mounting Step

Figure 31:
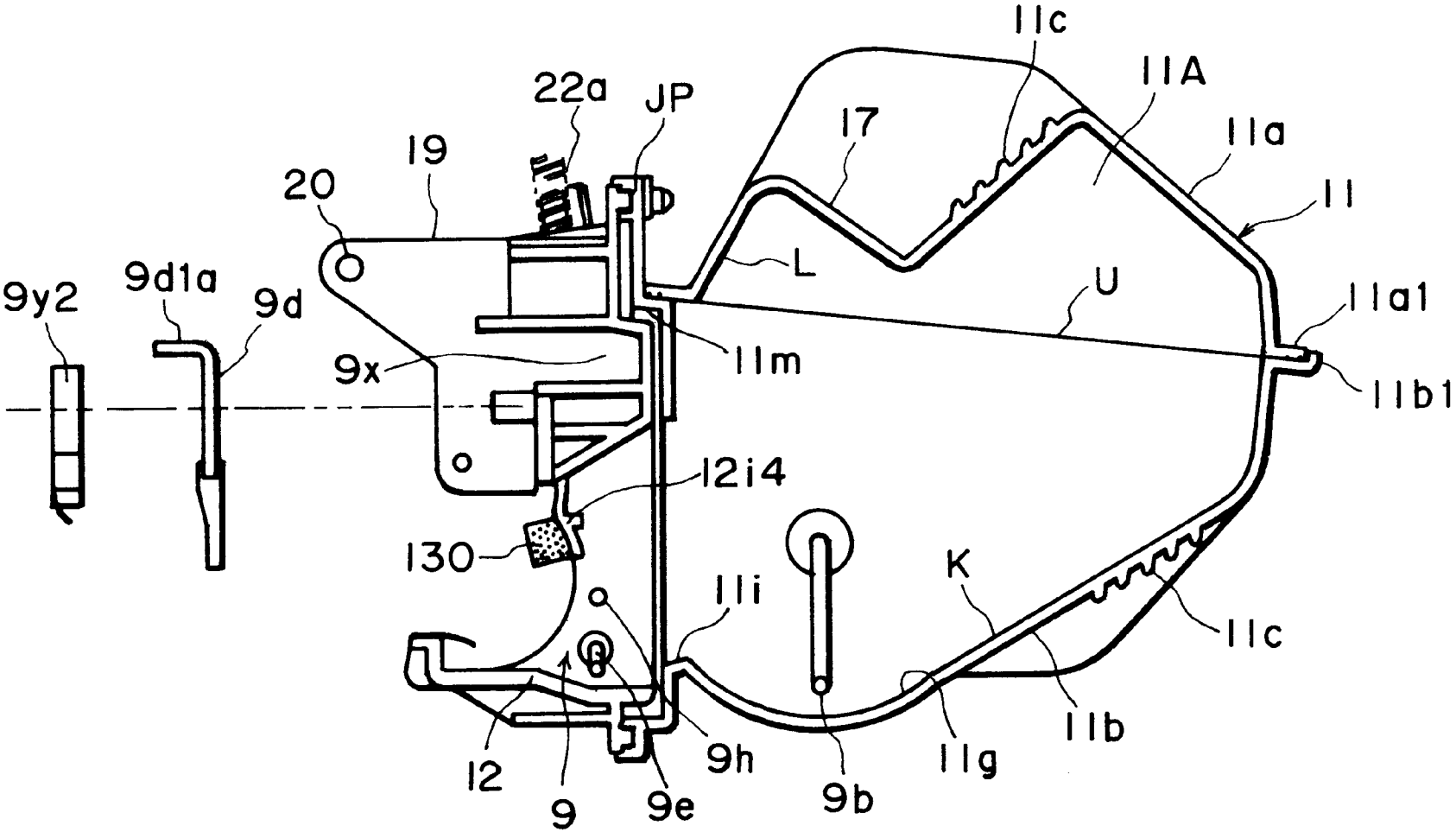
FIG. 31 is a longitudinal sectional view showing the step of mounting the developing blade with a reversed facing orientation.

After the developing blade 9*d* is removed, as shown in FIGS. 31 and 32, an elastic member 130 is mounted to the side (back side) of the silicone rubber 9*d*2 of the developing blade 9*d* which is opposite from the side contacted to the developing roller 9*c*, in this embodiment. The elastic member 130 is mounted on the seat 12*i*4 of the developing device frame 12 by means of bonding means such as a double coated tape along the longitudinal direction of the developing blade 9*d* such that longitudinal opposite ends thereof are contacted to the left and right assistance seals 12*s*3, respectively. In other words, the bonding means such as the double coated tape is extended over the entire width between the left and right assistance seals 12*s*3. Therefore, the length, majored in the longitudinal direction, of the elastic member 130 is shorter than the length of the developing blade 9*d* by the widths of the left and right assistance seals 12*s*3.

Figure 33:
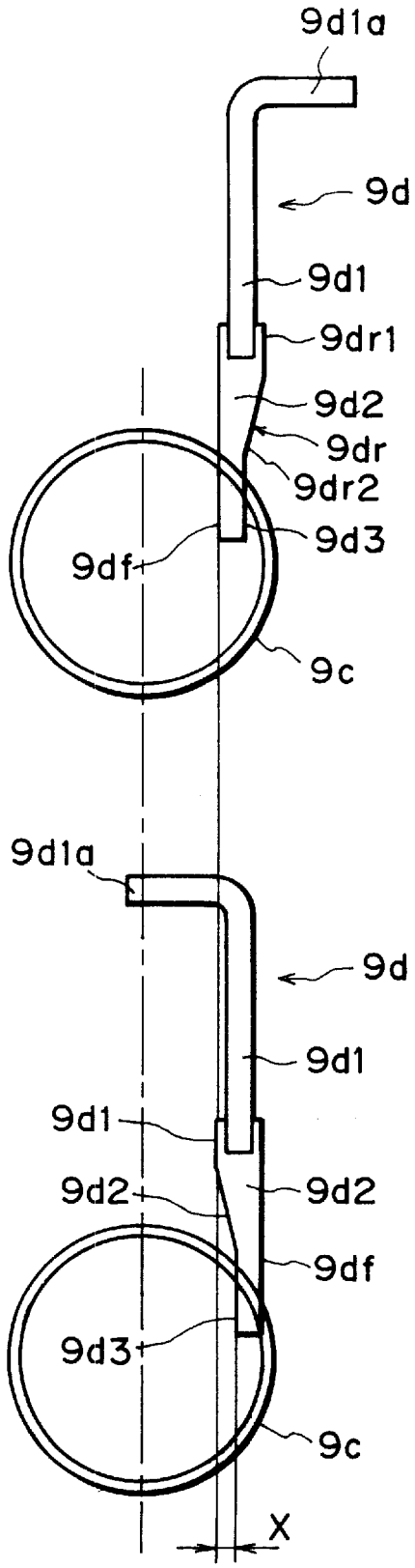
FIG. 33 is a schematic view illustrating a difference in the relative positions of the developing plate to the developing roller when the developing blade is reversed and then mounted.
Figure 34:
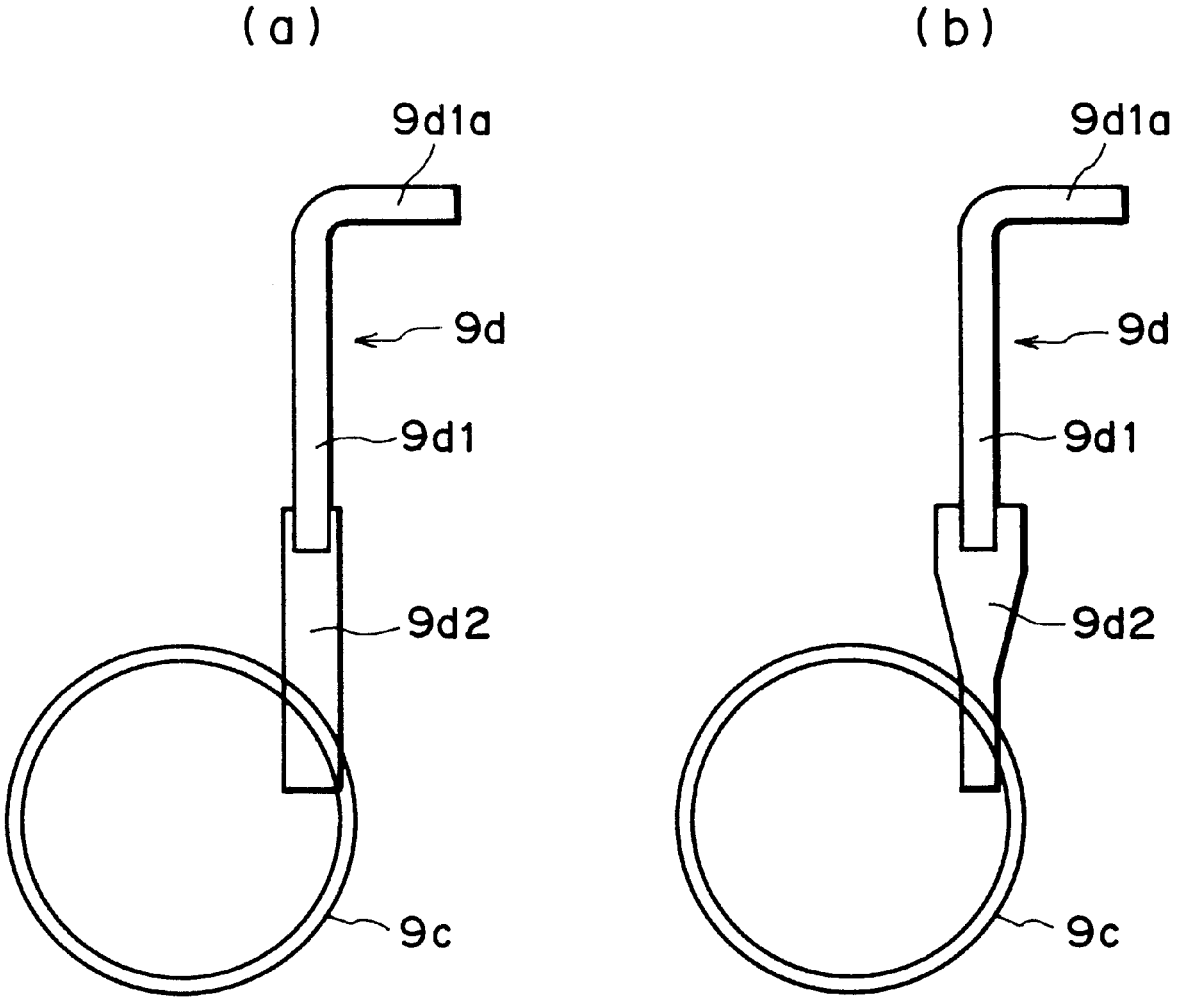
FIG. 34 is a sexual view of a developing blade in which the configuration of the cross-section of the portion contacted to the developing roller is symmetrical.

The description will be made as to reason why the elastic member 130 is mounted. In the remanufacturing step of this embodiment, the developing blade 9*d* is reversed in its facing orientation and is reused, as will be described hereinafter. FIG. 33 shows a relative to positional relationship between the developing roller 9*c* and the developing blade 9*d*. For the purpose of easy understanding of the relative position, there are shown only the developing roller 9*c* and the developing blade 9*d*. In the figure, the upper part shows the state before the remanufacturing, and the lower parts shows the relative positional relationship between the developing roller 9*c* and the developing blade 9*d* after the remanufacturing. The position of the developing roller 9*c* in the lateral direction is placed on the same perpendicular line. As will be understood from the Figure, the cross-sectional configuration of the silicone rubber 9*d*2 of the developing blade 9*d* is not symmetrical about the front and back sides. More particularly, before the remanufacturing, the side (front surface 9*df*) contacted to the developing roller 9*c* comprises a single flat surface, but the back side 9*dr* comprises three flat surfaces including a flat surface 9*dr*1 where the metal plate 9*d*1 is sandwiched by the blade, and a tapered surface 9*dr*2 and a flat surface 9*dr*3 extended from the tapered surface. Therefore, when the developing blade 9*d* is reversed and then is remounted, the silicone rubber 9*d*2 of the developing blade 9*d* is retracted relative to the developing roller 9*c* by a distance X, that is, the distance between the flat surfaces 9*dr*1 and 9*dr*3 (away from the center of the developing roller 9*c*), is shown in FIG. 33. By the shifting-back of the silicone rubber 9*d*2 from the developing roller 9*c*, the degree of the formation of the silicone rubber 9*d*2 decreases with a result of the contact pressure to the developing roller 9*c*, and therefore, the amount of the toner applied on the peripheral surface of the developing roller 9*c* is not as desired. In addition, the desired to be electric charge is not supplied with a result of image defect.

Figure 37:
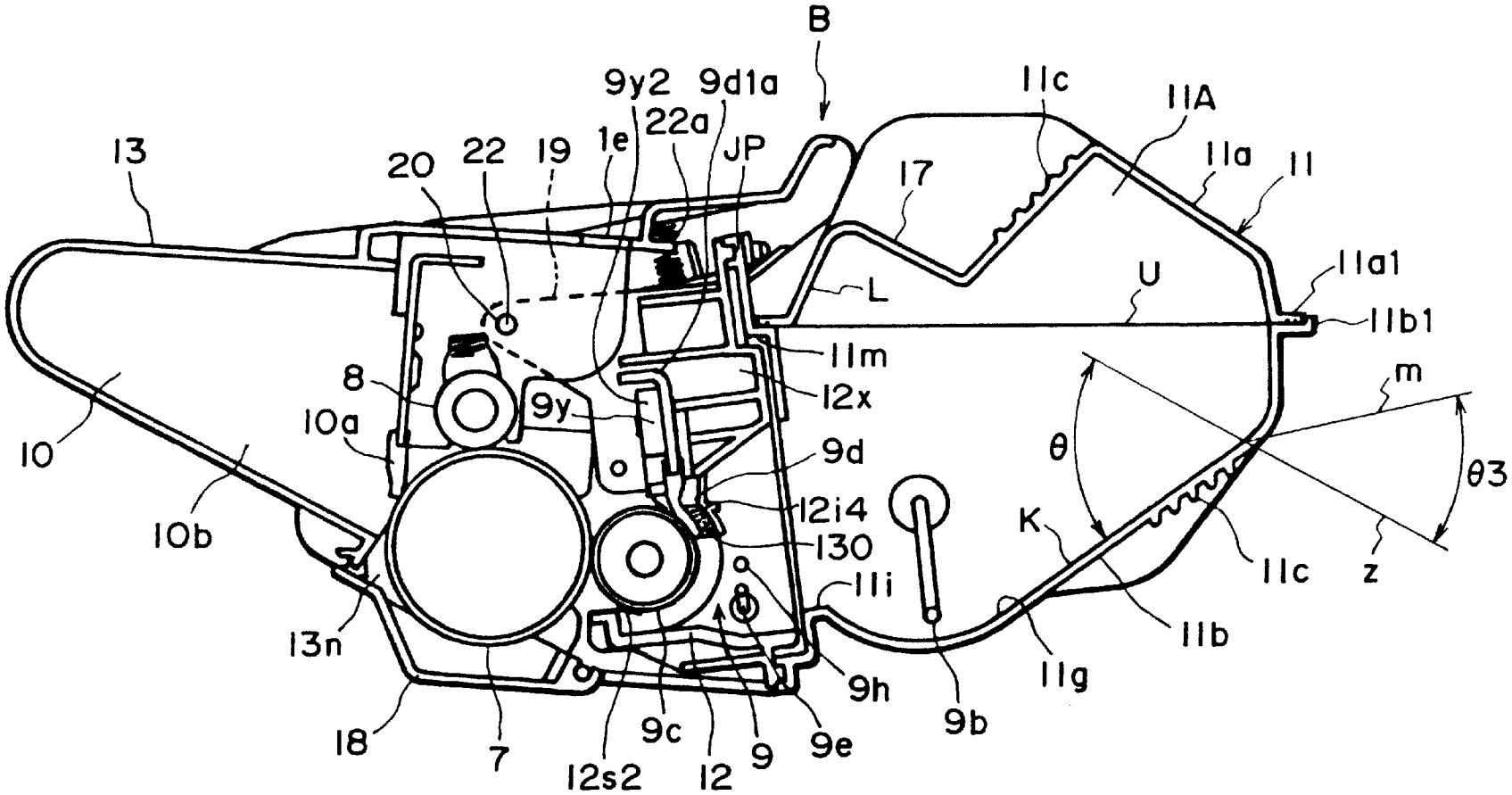
FIG. 37 is a longitudinal sectional view of a process cartridge remanufactured according to an embodiment of the present invention.
Figure 38:
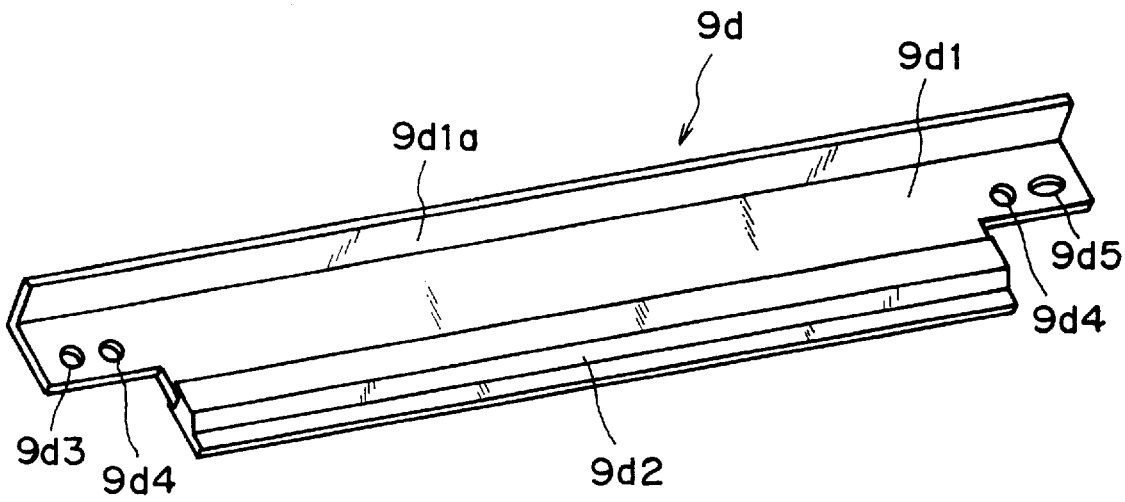
FIG. 38 is a perspective view of an outer appearance of a developing blade usable with a process cartridge, the developing blade having been remanufactured according to an embodiment of the present invention.

In consideration of this, in order to compensate for the reduced contact pressure attributable to the reduction of the deformation of the silicone rubber 9*d*2, the elastic member 130 is mounted to the seat 12*i*4 of the developing device frame 12, by which the silicone rubber 9*d*2 is urged against the developing roller 9*c* from the back side using the elastic force of the elastic member 130. FIG. 37 shows this state. FIG. 37 is a sectional view of the process cartridge B remanufactured through the remanufacturing method according to this embodiment of the present invention. The elastic member 130 mounted to the seat 12*i*4, as shown in FIG. 37, is disposed at the side of the silicone rubber 9*d*2 opposite from the side contacted to the developing roller 9*c*. As shown in FIG. 31, without the developing blade 9*d*, it has a substantially square shape, but when the developing blade 9*d* and the developing roller 9*c* are mounted, the silicone rubber 9*d*2 is compressed and deformed toward the toner frame 11 between the toner frame 11 and the seat 12*i*4. Due to the reaction force of the compression, the contact pressure of the silicone rubber 9*d*2 against the developing roller 9*c* increases, thus compensating for the reduction in the contact pressure attributable to the reversed mounting of the developing blade 9*d*. The material and the big video compression of the elastic member 130 is determined corresponding to the reduction of the contact pressure due to the reversed developing blade 9*d*. The material of the elastic member 130 is a foam material such as Moltopren (tradename) or the like, a synthetic rubber material such as urethane rubber or the like, a natural rubber material, elastomer or another material having a sufficient elasticity. The position to which the elastic member 130 is mounted is not limited to the seat 12*i*4 of the developing device frame 12, but it may be a back side of the silicone rubber 9*d*2, or the mounting surface may be any of four sides of the substantial square, corresponding to the configuration of the developing device frame 12 (any of the top, bottom, left or right side of the elastic member 130 in FIG. 31). What is required is that elastic member is compressed and deformed by being sandwiched between the back side of the silicone rubber 9*d*2 and some member. In this embodiment, the assistance seals 12*s*3 are provided at the longitudinal opposite ends of the opening 11*i*. However, assistance seals 12*s*3 are not provided as the case may be. In such a case, the elastic member 130 is mounted on the seat 12*i*4 of the developing device frame 12 by means of bonding means such as a double coated tape along the longitudinal direction of the developing blade 9*d* such that opposite longitudinal ends of the elastic member 130 are contacted to the seal members 12*s*1. In other words, the double coated tape is mounted on the seat 12*i*4 of the developing device frame 12 over the entire with his between the left and right seal members 12*s*1. In this case, the length of the elastic member 130 is substantially equal to that of the developing blade 9*d*.

In this invention, however, the elastic member 130 is not inevitable. As shown in FIG. 43, if the cross-sectional configuration of the silicone rubber 9*d*2 of the developing blade 9*d* is symmetrical configuration, that is, the front and back are symmetrical such that contact pressure to the developing roller 9*c* remains unchanged even if the face orientation of the silicone rubber 9*d*2 is the first, except for the change of the contact pressure due to the variation attributable to the tolerance and/or mounting error or the like of the associated parts, there is no need of using the elastic member 130. Additionally, even if the contact pressure to the developing roller 9*c* changes, the elastic member 130 is not necessary if the change is within the tolerance.

When the developing blade 9*d* becomes outcome contact with the developing roller 9*c* by reversing the developing blade 9*d*, the developing blade 9*d* may be the formed using the reaction force of the elastic member 130 to contact it to the developing roller 9*c*. In other words, the contact pressure may be provided only by the reaction force of the elastic member 130.

Toner Refilling Step

Figure 35:
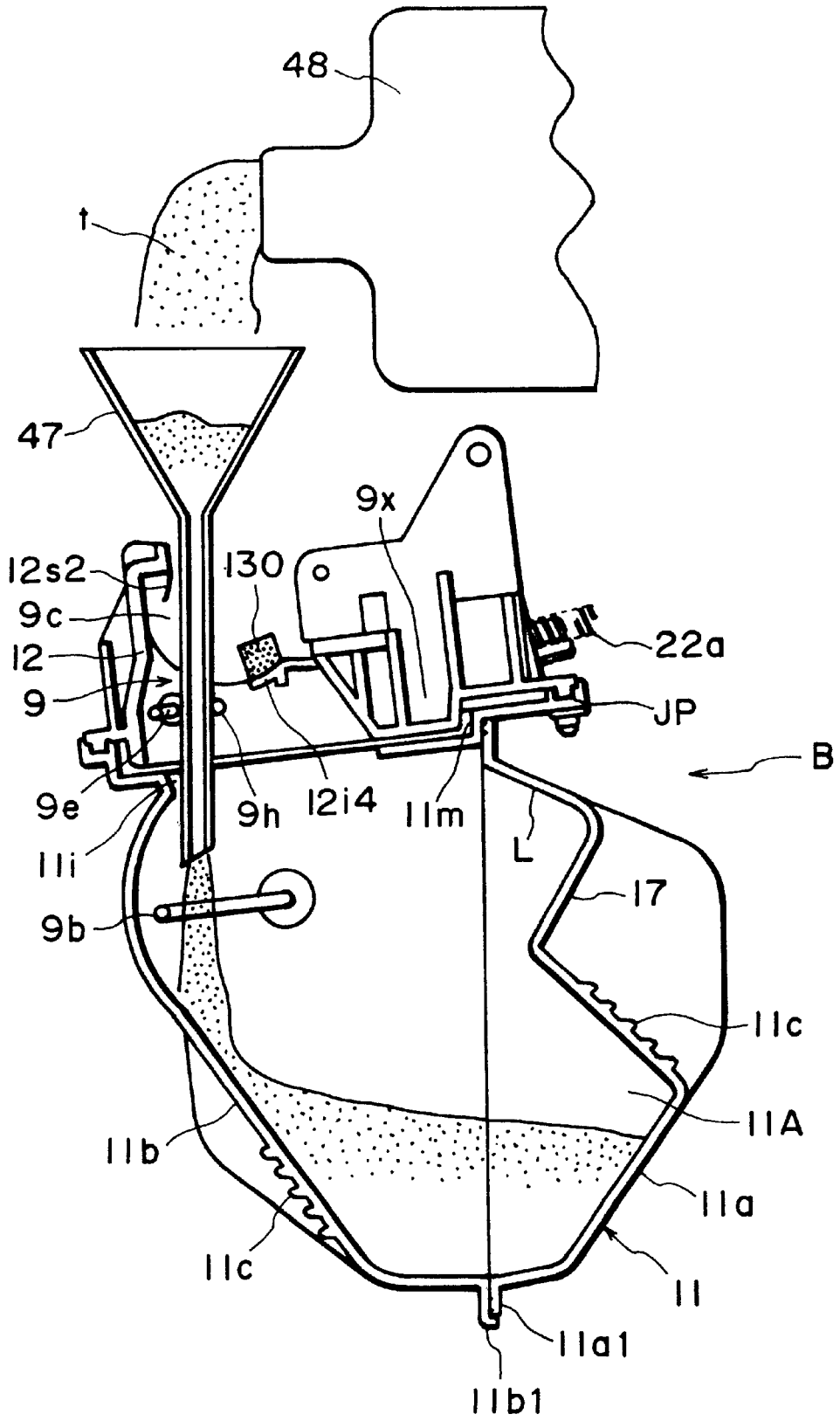
FIG. 35 is a longitudinal sectional view illustrating a toner refilling step.

Then, the toner is refilled into the toner container 11A. In the toner filling step, as shown in FIG. 35, the frame of the developing unit D is held such that opening 11*i* takes an upper position, and the toner container 11A takes a lower position. A free end of a funnel 47 is inserted into the opening 11*i*, and the toner is let fall into the funnel 47 from a toner bottle 48. A constant amount supplying device provided with an auger is preferably used in the main assembly of the funnel, since then, the toner can be refilled with high-efficiency.

Developing Blade Re-mounting Step

Then, the developing blade 9*d* is re-mounted. When the developing blade 9*d* is re-mounted, the deposited toner is removed by blowing air, and thereafter, the developing blade 9*d* is reversed in its facing orientation, as described hereinbefore, and then it is mounted. More particularly, the developing blade 9*d* was mounted on the developing device frame 12 such that bent portion 9*d*1*a* of the metal late 9*d*1 faces toward the toner container 11A, as shown in FIGS. 3 and 14. The developing blade 9*d* is now mounted such that bent portion 9*d*1*a* faces toward the photosensitive drum 7, as shown in FIGS. 31 and 37. The description will be made as to the reason why the developing blade 9*d* is mounted with the reversed facing orientation.

As described hereinbefore, the silicone rubber 9*d*2 of the developing blade 9*d* functions to regulate the amount of the toner applied on the peripheral surface of the developing roller 9*c* and also to triboelectrically charge the toner, when the developing roller 9*c* is rotated. When the developing roller 9*c* rotates, it is rubbed with the toner. When the process cartridge B is used, the silicone rubber 9*d*2 is gradually scraped by the particles of the toner with the result of a great number of scores extending in the peripheral motion of the developing roller 9*c*. The scorers, sooner or later, causes an image defect such as strikes or density non-uniformity one like on the resultant image. However, such scores are produced gradually from the beginning of the use of the process cartridge B, and therefore, there is a margin of a certain degree of scores such that image defect does not result due to the score before the lifetime of the process cartridge, which is determined on the basis of the amount of the toner therein, for example. An example of a commercial process cartridge B has a lifetime of 10,000 prints of A4 size with a print ratio of 4%. However, the user does not always operate the printer with the print ratio of 4% on the average, and therefore, the sufficient margin is provided so as to avoid the image defect even if more than 10,000 prints are produced with the print ratio not more than 4%. In the case that process cartridge B having been used to the extent much beyond the nominal lifetime of the process cartridge B, the scores of the silicone rubber 9*d*2 may be beyond the tolerable limit determined on the occurrence of the image defect. It would be considered that scores of all of the silicone rubbers 9*d*2 are checked to select reusable ones during the remanufacturing. However, it is not easy to check the number of scores and the depth thereof, and it is expected that extensive measuring devices such as a microscope and surface roughness detectors and that inspection is time-consuming. Even if the inspection is carried out, a certain number of developing blades are not reusable.

The present invention utilizes the backside of the silicone rubber 9*d*2 which is not scored by the rubbing with the toner. More particularly, the backside which is free of scores is used by reversing the silicone rubber 9*d*2.

The developing device frame 12 of the process cartridge B to be reused, is provided with a recess 12*x* by which the bent portion 9*d*1*a* is not interfered with the developing device frame 12, when the developing blade 9*d* is mounted such that bent portion 9*d*1*a* of the metal plate 9*d*1 faces toward the toner container 11A, shown in FIG. 3, in the state before the process cartridge is remanufactured. More particularly, referring to FIG. 14, the positions of the hole 9*d*3, the elongated hole 9*d*5 and the screw bore 9*d*4 of the metal plate 9*d*1 are determined relative to the dowel 12*i*1 and the female screws 12*i*2 in the blade abutment flat surface 12*i* (blade mounting portion) of the developing device frame 12, such that it can be mounted even when it is reversed in its facing orientation. Therefore, when it is reversed and mounted, the mounting accuracy can be maintained although the hole 9*d*3 and the elongated hole 9*d*5 are exchanged with each other. When the developing blade 9*d* is reversed and mounted, small screws 9*d*6 are inserted through the screw bores 9*y*1*a*, 9*y*2*a* formed in the scraper (righthand side) 9*y*1 and the scraper (left side) 9*y*2 and through the screw bores 9*d*4 formed in the metal plate 9*d*1, and are threaded into the female screws 12*i*2, by which the scrapers 9*y*1 (righthand side) 9*y*2 (left side) and the metal plate 9*d*1 are fixed to the flat surface 12*i*. The scraper (righthand side) 9*y*1 and the scraper (left side) 9*y*2 are not reversed in the facing orientation, or are not exchanged with each other, but are remounted in the same positions and orientations as those before the remanufacturing. Therefore, the contact pressure from the scraper (righthand side) 9*y*1 or the scraper (left side) 9*y*2 to the developing roller 9*c* is unchanged even after the remanufacturing. In the foregoing, the bent portion 9*d*1*a* of the metal plate 9*d*1 of the developing blade 9*d* is first mounted to be faced toward the toner container 11A, and it is reversed so was to be faced in the opposite direction, that is, toward the photosensitive drum 7. However, this is not limiting, and it may be first mounted to be faced to the photosensitive drum 7, and is reversed so was to be faced toward the toner container 11A in the remanufacturing. The positions of the positioning holes, namely, the hole 9*d*3 and the elongated hole 9*d*5 are at the right and left sides as shown in FIG. 14, but they may be exchanged in the positions. The metal plate 9*d*1 of the developing blade 9*d* is provided with the bent portion 9*d*1*a*, but the bent portion 9*d*1*a* is not inevitable, and the metal plate 9*d*1 may not be provided with such a bent portion. When the metal plate 9*d*1 is a flat plate, the recess 12*x* of the developing device frame 12 is not inevitable. In the foregoing, the material of the developing blade 9*d* in the contact portion relative to the developing roller 9*c* is silicone rubber, but the material is not limiting, and may be another elastic material such as urethane rubber, synthetic rubber or natural rubber, if the contact pressure to the developing roller 9*c* is assured.

Developing Roller Re-mounting Step

Then, the developing roller unit G is mounted. The developing roller 9*c*, the spacer roller 9*i* and the developing roller gear 9*k* which constitute the developing roller unit G having been dismounted in the developing roller unit dismounting step, are separated and clean by air blow or the like to remove the deposited toner. Then, the inspection is made as to whether they are reusable or not. If the result only inspection is not satisfactory on the basis of a predetermined level, a new part or parts are used in place thereof. If the statistics or the analysis in the design shows that particular part or parts are replaced with new ones with high frequency or high probability, it or they may be exchanged with a new one or ones without the inspection in the remanufacturing. The flange 9*p*, the magnet 9*g* in the developing roller 9*c*, the journal 9*w* and the development coil spring contact 9*l* are not disassembled. The reassembled developing roller unit G after the series of cleaning and inspecting operations, is remounted to the developing device frame 12 by fixing the bearing box 9*v* and the drive transmission unit DG to the side plates 12B, 12A with unshown small screws.

Cleaning Unit Remanufacturing Step

Figure 36:
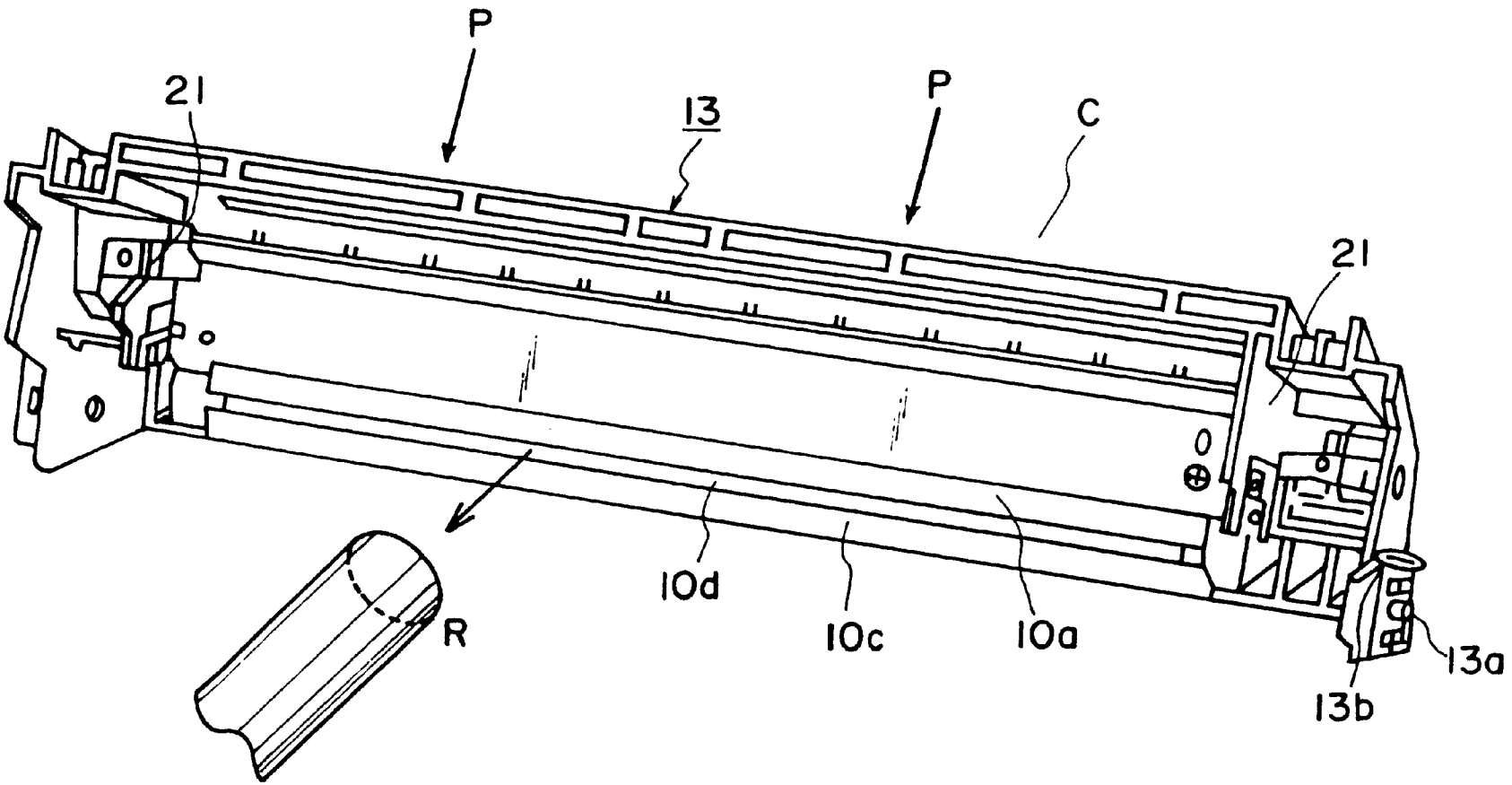
FIG. 36 is a prospective view illustrating the cleaning operation for the cleaning frame.

Then, the cleaning unit is remanufactured. As shown in FIGS. 11 and 12, the drum flange 36 is fixed to an end of the photosensitive drum 7 by cramping, bonding or the like, and a spur gear 7*n* is fixed to the other end thereof. The drum flange 36 and the spur gear 7*n* are rotatably mounted to the cleaning frame 13 by the bearing 38 and the flange 29 integrally having the drum shaft 7*a*, the expanded diameter portion 7*a*2 and the cylindrical guide 13*a*L, respectively. The bearing 38, as shown in FIGS. 26, 27, is mounted to the cleaning frame 13 by the small screw 13*a*R2, and the flange 29, as shown in FIG. 11, is mounted to the cleaning frame 13 by the small screw 13*d*. Therefore, by dismounting the bearing 38 and the flange 29, the photosensitive drum 7 can be removed from the cleaning frame 13. Then, as shown in FIG. 36, the cleaning unit C from which the photosensitive drum 7 has been removed, is placed on a table, and is fixed thereto. A suction nozzle R of a suction device (unshown) is manipulated to contact the suction port of the suction nozzle R is contacted to the cleaning unit C at the gap 10*d* between the cleaning blade 10*a* and the receptor sheet 10*c*. The suction nozzle R is moved in the lateral direction along the gap 10*d* while beating the top side of the cleaning unit C as indicated by an arrow P, so that removed toner is suctioned from the inside. After the completion of the toner removal, the cleaning blade 10*a* and the receptor sheet 10*c* are removed from the cleaning unit C, and the inside of the cleaning frame 13 and the removed toner stagnation are cleaned by air blowing or the like. The removed photosensitive drum 7 and the cleaning blade 10*a* are cleaned by air blowing or the like to remove the toner, and the inspection is made to determine whether they are reusable one not. If the result only inspection is not satisfactory on the basis of a predetermined level, a new part or parts are used in place thereof. If the statistics or the analysis in the design shows that particular part or parts are replaced with new ones with high frequency or high probability, it or they may be exchanged with a new one or ones without the inspection in the remanufacturing. The reused or new cleaning blade 10*a* and the new receptor sheet 10*c* are mounted to the cleaning frame 13, and thereafter, the reuse toward new photosensitive drum 7 is rotatably mounted to the cleaning frame by the small screw 13*a*R2 (FIG. 26) and the small screw 13*d* (FIGS. 6, 11) at the bearing 38 and the flange 29, Unit Re-coupling Step of Re-coupling the Developing Unit and the Cleaning Unit with Each Other As described in the foregoing, the developing unit D remanufactured through the developing roller unit dismounting step, the developing blade dismounting step, elastic member affixing step, the toner refill step and the developing blade re-mounting step after the separation between the developing unit D and the cleaning unit C, and the cleaning unit C remanufactured by the cleaning unit remanufacturing step, are recoupled for rotation about the connecting member 22 through the reverse process of the separating step of separating the developing unit and the cleaning unit from each other. More particularly, the free end of the arm portion 19 at each of the longitudinal sides (axis direction of the developing roller 9*c*) of the developing device frame 12 as shown in FIG. 13 (as has been described in [Structure of housing of process cartridge B], is inserted into the recess 21 for receiving the arm portion 19 provided on the cleaning frame 13 shown in FIG. 12, and the connecting member 22 is press-fitted into the mounting hole 13*e* of the cleaning frame 13, and is engaged into the rotation hole 20 provided at an end of the arm portion 19,.and is further press-fitted into the inside hole 13*e*.

The major steps of the process cartridge remanufacturing are described in the foregoing. However, the foregoing is an example of the remanufacturing method according to the present invention, which is not necessarily limited to the example.

In the foregoing the cleaning unit remanufacturing step is described after the developing roller unit re-mounting step, but it does not mean that cleaning unit remanufacturing step is to be carried out how to the developing roller unit re-mounting step. Since the developing unit and the cleaning unit have been separated from each other by the separating step, and therefore, the remanufacturing operations can be carried out independently from each other. The remanufacturing operations of them can be carried out in parallel and simultaneously, although one of them can be carried out after the other.

In the foregoing, the toner is filled through the opening 11*i* as shown in FIG. 35 in the toner refill step, and therefore, it is carried out between the elastic member affixing step and the developing blade re-mounting step. However, the toner may be refilled through the toner filling opening 11*d* of the toner frame 11. In this case, if the opening 11*i* is not covered, the toner leaks, the refilling is preferably carried out after the developing roller unit re-mounting step from the stomach bond of the operativity and the operational efficiency.

It should be noted that developing blade or the developing roller unit removed from the developing unit, or the photosensitive drum or the cleaning blade removed from the cleaning unit, are not necessarily mounted to the very developing unit from which the developing blade or the developing roller unit is removed, or to the very cleaning unit from which the photosensitive drum or the cleaning unit are removed. When the remanufacturing is carried out using a production line or the like (flow system), the developing blades removed from developing units are accommodated in a box, and they are subjected to the air cleaning, and then they are supplied to the remounting station. Therefore, the developing blades do not necessarily go back to the original developing units, respectively. This is not a problem because the cartridge configurations are the same despite a small dimension difference which, however, within the tolerance, if the types of the process cartridges are the same, and therefore, it is not inevitable that they are returned to the original developing units. The same applies to the developing roller unit, the photosensitive drum and the cleaning blade. For the same reasons, as regards the re-coupling of the developing unit and the cleaning unit, the combination of them is not necessary the original combination.

In the foregoing embodiments, the used process cartridge is collected back and is disassembled. Then, the parts resulting from the disassembling of the process cartridges, may be put together, for the respective parts. Then, the process cartridges are remanufactured through the remanufacturing method as described in the foregoing, using such a part or a new part (not used parts) as the case may be appropriate. In another remanufacturing system, the used process cartridges are collected and disassembled. Then, the process cartridges are remanufactured through the remanufacturing method as described in the foregoing, using the part removed from the same process cartridge, a part removed from another process cartridge or a new part (not used parts) as the case may be appropriate.

Any one of the remanufacturing steps may be automated using a robot. The process cartridge B to which the present invention is applicable is not limited to a process cartridge for formation of the monochromatic image is, but maybe a color cartridge for formation of multicolor image is (two-color images, three-color images, full-color images or the like) using a plurality of developing means 10. The structure of the charging means described in the foregoing is of a so-called contact type charging method, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charged the surface, is usable. The charging means may be a roller type as described in the foregoing, a blade type (charging blade), a pad type, a block type, a rod type, a wire type or the like. As for a cleaning method for removing toner remaining on the photosensitive drum, a blade, a fur brush, a magnetic brush or the like is usable.

The process cartridge may contain the image bearing member and the developing means as a unit which is detachably mountable to the main assembly of the image forming apparatus. The process cartridge may integrally contain an electrophotographic photosensitive drum, and charging means, developing means or cartridge, in the form of a unit or a cartridge, which is detachably mountable to a main assembly of an image forming apparatus. Furthermore, the process cartridge may contain at least the electrophotographic photosensitive drum and the developing means. In the foregoing embodiment, a laser beam printer has been described in the foregoing as an example of the electrophotographic image forming apparatus, but the present invention is not limited thereto, and the present invention is applicable to an electrophotographic copying machine, a facsimile machine, a facsimile machine or the like of an electrophotographic type.

As described in the foregoing, the present invention provides a simple remanufacturing method for a process cartridge.

While the invention has been described with reference to the structures disclosed herein, it is not confined to the details set forth and this application is intended to cover such modifications or changes as may come within the purpose of the improvements or the scope of the following claims.

What is claimed is:

1. A remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step of separating the first unit and the second unit from each other;

(B) a developing blade dismounting step of dismounting from the second unit a developing blade, mounted into the second unit, for regulating an amount of the developer deposited on the developing roller;

(C) a developer filling step of filling the developer into the developer accommodating portion through a developer supply opening for supplying the developing roller from the developer accommodating portion;

(D) a developing blade mounting step of mounting the developing blade dismounted in said developing blade dismounting step to the second unit with a facing orientation which is opposite from a facing orientation before said developing blade dismounting step; and (E) a unit coupling step of coupling the first unit and the second unit.

2. A remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step of separating the first unit and the second unit from each other;

(B) a developing blade dismounting step of dismounting from the second unit a developing blade, mounted into the second unit, for regulating an amount of the developer deposited on the developing roller;

(C) a developing blade mounting step of mounting the developing blade dismounted in said developing blade dismounting step to the second unit with a facing orientation which is opposite from a facing orientation before said developing blade dismounting step;

(D) a developer filling step of filling the developer into the developer accommodating portion through a developer filling port provided in the developer accommodating portion; and (E) a unit coupling step of coupling the first unit and the second unit.

3. A method according to claim 1 or 2, wherein said developing blade is effective to regulate an amount of the developer by elastically contacting a part thereof to the developing roller, said method further comprising an elastic member mounting step of mounting an elastic member for applying a constant pressure against the developing roller from the developing blade, that said developing blade dismounting step.

4. A method according to claim 3, wherein said elastic member is mounted to the developing blade or to the second unit.

5. A method according to claim 1 or 2, wherein in said developing blade mounting step, the developing blade to be mounted to the second unit is the developing blade dismounted from the second unit of said process cartridge or a developing blade dismounted from a second unit of another process cartridge.

6. A method according to claim 1 or 2, further comprising a developing roller dismounting step of dismounting the developing roller from the second unit prior to said developing blade dismounting step, and a developing roller mounting step of mounting the developing roller to said second unit after said developing blade mounting step and before said unit coupling step.

7. A method according to claim 6, wherein in said developing roller mounting step, the developing roller to be mounted to the second unit is the developing roller dismounted from the second unit of said process cartridge or a developing roller dismounted from a second unit of another process cartridge.

8. A method according to claim 6, wherein said developing roller dismounting step including an end cover dismounting step of dismounting a first end cover mounted to one longitudinal end portion of the developing roller and a second end cover mounted to the other longitudinal end portion from said second unit, and said developing roller mounting step including an end cover mounting step or mounting the first end cover to said one longitudinal end portion and mounting the second end cover to the other longitudinal end of portion.

9. A method according to claim 8, wherein in said end cover mounting step, the first end cover and/or the second end cover to be mounted to the second unit is the first end cover and/or the second end cover dismounted from the second unit of said process cartridge or a first end cover and/or a second end cover dismounted from a second unit of another process cartridge.

10. A method according to claim 1, wherein said developing blade comprises an elongated plate-like silicone rubber and an integral metal plate member extending in a longitudinal direction of the plate-like silicone rubber at one lateral side thereof, and wherein said developing blade is mounted to the second unit by a screw.

11. A method according to claim 1, 2 or 10, wherein when the developing blade is mounted to the second unit, a positioning reference, relative to the second unit in the longitudinal direction, for the developing blade is at one longitudinal end of the developing blade, before said developing blade dismounting step, and wherein the positioning reference is at another end in said developing blade mounting step.

12. A method according to claim 1 or 2, wherein the developing blade is provided at each of the longitudinal ends of a front side thereof with a scraper contacted to the developing roller to scrape the developer off a peripheral surface of the developing roller adjacent each of the longitudinal ends of the developing roller, a contact surface of the scraper contacted to the peripheral surface of the developing roller before said developing blade dismounting step being the same as the contact surface after said developing blade mounting step.

13. A method according to claim 12, wherein said scraper is fixed to the second unit with the developing blade by a screw.

14. A method according to claim 1 or 2, wherein the first unit and/or the second unit coupled with each other in said unit coupling step are the same as those separated in said unit separating step, or the first unit and/or the second unit coupled with each other in said unit coupling step are a first unit and/or a second unit randomly selected from a plurality of first units and second units provided by execution of separation steps of other process cartridges.

15. A method according to claim 1 or 2, further comprising a cleaning blade and electrophotographic photosensitive drum dismounting step of dismounting a cleaning blade for removing the developer remaining on the electrophotographic photosensitive drum and said electrophotographic photosensitive drum, from the first unit, prior to said unit coupling step, and a developer removing step of removing from the first unit the developer removed from the electrophotographic photosensitive drum by the cleaning blade.

16. A method according to claim 1 or 2, wherein the dismounted electrophotographic photosensitive drum is reused or is replaced with a new electrophotographic photosensitive member, or the dismounted developing roller is reused or is replaced with a new developing roller, or the dismounted cleaning blade is reused or is replaced with a new developing blade.

17. A method according to claim 16, wherein in said electrophotographic photosensitive drum mounting step, the electrophotographic photosensitive drum to be mounted to the first unit is the electrophotographic photosensitive drum dismounted from the first unit of said process cartridge or an electrophotographic photosensitive drum dismounted from a first unit of another process cartridge.

18. A method according to claim 16, wherein in said cleaning blade mounting step, the cleaning blade to be mounted to the first unit is the cleaning blade dismounted from the first unit of said process cartridge or a cleaning blade dismounted from a first unit of another process cartridge.

19. A remanufacturing method for a process cartridge detachably mountable to a main assembly of an electrophotographic image forming apparatus, said process cartridge including a first unit supporting an electrophotographic photosensitive drum and a cleaning blade for removing a developer remaining on the electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said first unit and said second unit being rotatably coupled with each other, said method comprising:

(A) a separating step of separating the first unit and the second unit from each other;

(B) a drum replacing step of replacing the electrophotographic photosensitive drum mounted to said first unit with a new electrophotographic photosensitive drum;

(C) a developing roller dismounting step of dismounting the developing roller mounted to the second unit;

(D) a developing blade dismounting step of dismounting a developing blade, mounted to the second unit, for regulating an amount of the developer by elastically contacting a part thereof to the developing roller, from the second unit;

(E) an elastic member mounting step of mounting an elastic member for applying a contact pressure to the developing roller from the developing blade which has been dismounted from the second unit and which is to be reused;

(F) a developer filling step of filling the developer into the developer accommodating portion through a developer supply opening for supplying the developing roller from the developer accommodating portion;

(G) a developing blade mounting step, of mounting the developing blade dismounted in said developing blade dismounting step to the second unit with a facing orientation which is opposite from a facing orientation before said developing blade dismounting step;

(H) a developing roller mounting step of mounting the developing roller to the second unit; and (I) a unit coupling step of coupling the first unit and the second unit.

20. A method according to claim 19, wherein said elastic member is mounted to the developing blade or to the second unit.

21. A method according to claim 19 or 20, wherein in said developing blade mounting step, the developing blade to be mount ed to the second unit is the developing blade dismounted from the second unit of said process cartridge or a developing blade dismounted from a second unit of another process cartridge.

22. A method according to claim 19 wherein in said developing roller mounting step, the developing roller to be mounted to the second unit is the developing roller dismounted from the second unit of said process cartridge or a developing roller dismounted from a second unit of another process cartridge.

23. A method according to claim 19 wherein said developing roller dismounting step includes an end cover dismounting step of dismounting a first end cover mounted to one longitudinal end portion of the developing roller and a second end cover mounted to the other longitudinal end portion from said second unit, and wherein said developing roller mounting step includes an end cover mounting step of mounting the first end cover to said one longitudinal end portion and mounting the second end cover to the other longitudinal end portion.

24. A method according to claim 23, wherein in said end cover mounting step, the first end cover and/or the second end cover to be mounted to the second unit is the first end cover and/or the second end cover dismounted from the second unit of said process cartridge or a first end cover and/or a second end cover dismounted from a second unit of another process cartridge.

25. A method according to claim 19, wherein said developing blade comprises an elongated plate-like silicone rubber and an integral metal plate member extending in a longitudinal direction of the plate-like silicone rubber at one lateral side thereof, and wherein said developing blade is mounted to the second unit by a screw.

26. A method according to claim 19 or 25 wherein when the developing blade is mounted to the second unit, a positioning reference, relative to the second unit in the longitudinal direction, for the developing blade is at one longitudinal end of the developing blade, before said developing blade dismounting step, and wherein the positioning reference is at the other end in said developing blade mounting step.

27. A method according to claim 19 or 25, wherein the developing blade is provided at each of the longitudinal ends of a front side thereof with a scraper contacted to the developing roller to scrape the developer off a peripheral surface of the developing roller adjacent each of the longitudinal ends of the developing roller, a contact surface of the scraper contacted to the peripheral surface of the developing roller before said developing blade dismounting step is the same as the contact surface after said developing blade mounting step.

28. A method according to claim 27, wherein said scraper is fixed to the second unit with the developing blade by a screw.

29. A method according to claim 19, wherein the first unit and/or the second unit coupled with each other in said unit coupling process are the same as those separated in said unit separating step, or the first unit and/or the second unit coupled with each other in said unit coupling step are a first unit and/or a second unit randomly selected from a plurality of first units and second units provided by execution of separation steps of other process cartridges.

30. A method according to claim 19, wherein in said drum replacing step, the cleaning blade and the electrophotographic photosensitive drum is dismounted from said first unit, and the developer removed from the electrophotographic photosensitive drum removed by the cleaning blade is removed from said first unit.

31. A method according to claim 19, wherein the dismounted developing roller is reused or is replaced with a new developing roller, or the dismounted cleaning blade is reused or is replaced with a new cleaning blade.

32. A method according to claim 19 or 30, wherein when said cleaning blade is reused, the cleaning blade mounting step, the cleaning blade to be mounted to the first unit is the cleaning blade dismounted from the first unit of said process cartridge or a cleaning blade dismounted from a first unit of another process cartridge.

33. A remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said second unit further supporting a developing blade for regulating an amount of the developer deposited on said developing roller, said developing blade being reversibly usable, said developing blade being mounted in a frontward facing orientation, wherein when said developing blade is mounted in a backward facing orientation, a deflection thereof by contact to said developing roller is smaller than when said developing blade is mounted in the frontward orientation, said first unit and said second unit being rotatably coupled with each other, said method comprising:

(A) a separating step of separating the first unit and the second unit from each other;

(B) a developing blade dismounting step of dismounting from the second unit a developing blade, mounted into the second unit, for regulating an amount of the developer deposited on the developing roller;

(C) a developing filling step of filling the developer into the developer accommodating portion through a developer supply opening for supplying the developing roller from the developer accommodating portion;

(D) an elastic member mounting step of mounting an elastic member to said second unit or to a backside of said developing blade such that the elastic member is disposed between the backside of said developing blade and said second unit, when said developing blade is mounted in the backward orientation;

(E) a developing blade mounting step of mounting the developing blade dismounted in said developing blade dismounting step to the second unit with a facing orientation which is opposite from a facing orientation before said developing blade dismounting step, such that the elastic member is compressed and deformed between said developing blade and said second unit; and (F) a unit coupling step of coupling the fist unit and the second unit.

34. A remanufacturing method for a process cartridge detachably mountable to a main assembly of an electrophotographic image forming apparatus, said process cartridge including a first unit supporting an electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said second unit further supporting a developing blade for regulating an amount of the developer deposited on said developing roller, said developing blade being reversibly usable, said developing blade being mounted in a frontward facing orientation, wherein when said developing blade is mounted in a backward facing orientation, a deflection thereof by contact to said developing roller is smaller than when said developing blade is mounted in the frontward orientation, said first unit and said second unit being rotatably coupled with each other, said method comprising:

(A) a separating step of separating the first unit and the second unit from each other;

(B) a developing blade dismounting step of dismounting from the second unit a developing blade, mounted into the second unit, for regulating an amount of the developer deposited on the developing roller;

(C) an elastic member mounting step of mounting an elastic member to said second unit or to a backside of said developing blade such that the elastic member is disposed between the backside of said developing blade and said second unit, when said developing blade is mounted in the backward orientation;

(D) a developing blade mounting step of mounting the developing blade dismounted in said developing blade dismounting step to the second unit with a facing orientation which is opposite from a facing orientation before said developing blade dismounting step, such that the elastic member is compressed and deformed between said developing blade and said second unit;

(E) a developer filling step of filling the developer into the developer accommodating portion through a developer filling port provided in the developer accommodating portion; and (F) a unit coupling step of coupling the first unit and the second unit.

35. A remanufacturing method for a process cartridge detachably mountable to a main assembly of an electrophotographic image forming apparatus, said process cartridge including a first unit supporting an electrophotographic photosensitive drum and a cleaning blade for removing a developer remaining on the electrophotographic photosensitive drum, and a second unit supporting a developing roller for developing an electrostatic latent image formed on the electrophotographic photosensitive drum and having a developer accommodating portion accommodating a developer to be used for developing the electrostatic latent image by the developing roller, said second unit further supporting a developing blade for regulating an amount of the developer deposited on said developing roller, said developing blade being reversibly usable, said developing blade being mounted in a frontward facing orientation, wherein when said developing blade is mounted in a backward facing orientation, a deflection thereof by contact to said developing roller is smaller than when said developing blade is mounted in the frontward orientation, said first unit and said second unit being rotatably coupled with each other, said method comprising:

(A) a separating step of separating the first unit and the second unit from each other;

(B) a drum replacing step of replacing the electrophotographic photosensitive drum mounted to said first unit with a new electrophotographic photosensitive drum;

(C) a developing roller dismounting step of dismounting the developing roller mounted to the second unit;

(D) a developing blade dismounting step of dismounting a developing blade, mounted to the second unit, for regulating an amount of the developer by elastically contacting a part thereof to the developing roller, from the second unit;

(E) a developer filling step of filling the developer into the developer accommodating portion through a developer supply opening for supplying the developing roller from the developer accommodating portion;

(F) an elastic member mounting step of mounting an elastic member to said second unit or to a backside of said developing blade such that the elastic member is disposed between the backside of said developing blade and said second unit, when said developing blade is mounted in the backward orientation;

(G) a developing blade mounting step of mounting the developing blade dismounted in said developing blade dismounting step to the second unit with a facing orientation which is opposite from a facing orientation before said developing blade dismounting step, such that the elastic member is compressed and deformed between said developing blade and said second unit;

(H) a developing roller mounting step of mounting the developing roller to the second unit; and (I) a unit coupling step of coupling the first unit and the second unit.

36. A method according to claim 33 or 34, wherein said developing blade is effective to regulate an amount of the developer by elastically contacting a part thereof to the developing roller, said method further comprising an elastic member mounting step of mounting an elastic member for applying a constant pressure against the developing roller from the developing blade, that said developing blade dismounting step.

37. A method according to claim 33, 34, or 35, wherein said elastic member is mounted to the developing blade or to the second unit.

38. A method according to claim 33, 34, or 35, wherein in said developing blade mounting step, the developing blade to be mounted to the second unit is the developing blade dismounted from the second unit of said process cartridge or a developing blade dismounted from a second unit of another process cartridge.

39. A method according to claim 33, 34, or 35, further comprising a developing roller dismounting step of dismounting the developing roller from the second unit prior to said developing blade dismounting step, and a developing roller mounting step of mounting the developing roller to said second unit after said developing blade mounting step and before said unit coupling step.

40. A method according to claim 39, wherein in said developing roller mounting step, the developing roller to be mounted to the second unit is the developing roller dismounted from the second unit of said process cartridge or a developing roller dismounted from a second unit of another process cartridge.

41. A method according to claim 39, wherein said developing roller discounting step includes an end cover dismounting step of dismounting a first end cover mounted to one longitudinal end portion of the developing roller and a second end cover mounted to the other longitudinal end portion from said second unit, and said developing roller mounting step includes an end cover mounting step of mounting the first end cover to said one longitudinal end portion and mounting the second end cover to the other longitudinal end portion.

42. A method according to claim 41, wherein in said end cover mounting step, the first end cover and/or the second end cover to be mounted to the second unit is the first end cover and/or the second end cover dismounted from the second unit of said process cartridge or a first end cover and/or a second end cover dismounted from a second unit of another process cartridge.

43. A method according to claim 33, 34, or 35, wherein said developing blade comprises an elongated plate-like silicone rubber and an integral metal plate member extending in a longitudinal direction of the plate-like silicone rubber at one lateral side thereof, and wherein said developing blade is mounted to the second unit by a screw.

44. A method according to claim 1 or 2, wherein when the developing blade is mounted to the second unit, a positioning reference, relative to the second unit in the longitudinal direction, for the developing blade is at one longitudinal end of the developing blade, before said developing blade dismounting step, and wherein the positioning reference is at another end in said developing blade mounting step.

45. A method according to claim 33, 34, or 35, wherein the developing blade is provided at each of the longitudinal ends of a front side thereof with a scraper contacted to the developing roller to scrape the developer off a peripheral surface of the developing roller adjacent each of the longitudinal ends of the developing roller, a contact surface of the scraper contacted to the peripheral surface of the developing roller before said developing blade dismounting step is the same as the contact surface after said developing blade mounting step.

46. A method according to claim 12, wherein said scraper is fixed to the second unit with the developing blade by a screw.

47. A method according to claim 33, 34, or 35, wherein the first unit and/or the second unit coupled with each other in said unit coupling step are the same as those separated in said unit separating step, or the first unit and/or the second unit coupled with each other in said unit coupling step are a first unit and/or a second unit randomly selected from a plurality of first units and second units provided by execution of separation steps of other process cartridges.

48. A method according to claim 33, 34, or 35, further comprising a cleaning blade and electrophotographic photosensitive drum dismounting step of dismounting a cleaning blade for removing the developer remaining on the electrophotographic photosensitive drum and said electrophotographic photosensitive drum, from the first unit, prior to said unit coupling step, and a developer removing step of removing from the first unit the developer removed from the electrophotographic photosensitive drum by the cleaning blade.

49. A method according to claim 33, 34, or 35, wherein the dismounting electrophotographic photosensitive drum is reused or is replaced with a new electrophotographic photosensitive member, or the dismounted developing roller is reused or is replaced with a new developing roller, or the dismounting cleaning blade is reused or is replaced with a new developing blade.

50. A method according to claim 49, wherein in said electrophotographic photosensitive drum mounting step, the electrophotographic photosensitive drum to be mounted to the first unit is the electrophotographic photosensitive drum dismounted from the first unit or said process cartridge or an electrophotographic photosensitive drum dismounted from a first unit of another process cartridge.

51. A method according to claim 33, 34, or 35, wherein in said cleaning blade mounting step, the cleaning blade to be mounted the first unit is the cleaning blade dismounted from the first unit of said process cartridge or a cleaning blade dismounted from a first unit of another process cartridge.

52. A method according to claim 35, wherein in said drum replacing step, the cleaning blade and the electrophotographic photosensitive drum are dismounted from said first unit, and the developer removed from the electrophotographic photosensitive drum removed by the cleaning blade is removed from said first unit.

* * * * *

UNITED STATES PATENT AND TRADEMARK OFFICE

CERTIFICATE OF CORRECTION

PATENT NO. : 6,519,430 B2
DATED : February 11, 2003
INVENTOR(S) : Akira Higeta et al.

It is certified that error appears in the above-identified patent and that said Letters Patent is hereby corrected as shown below:

Column 1,
Line 44, "are" should be deleted.

Column 6,
Line 20, "provide contacted" should read -- contacted --.

Column 10,
Line 3, "couterclockwise" should read -- counterclockwise --.

Column 13,
Line 15, "an" should be deleted.
Line 23, "Ilk." should read -- 11*k*. --.
Line 31, "it" should read -- is --.

Column 14,
Lines 35 and 64, "trianglar" should read -- triangular --.

Column 16,
Line 32, "its" should read -- is --.

Column 19,
Line 3, "these" should read -- is --.

Column 21,
Line 49, "T he" should read -- The --.

Column 22,
Line 23, "I" should read -- In --.
Line 62, "riches" should read -- reaches --.

Column 24,
Line 3, "an" should read -- and --.

Column 26,
Line 30, "one like" should read -- or the like --.
Line 38, "or the" should read -- or --.
Line 39, "formed" should read -- deformed -- , and "and the" should read -- the --.

UNITED STATES PATENT AND TRADEMARK OFFICE

CERTIFICATE OF CORRECTION

PATENT NO. : 6,519,430 B2
DATED : February 11, 2003
INVENTOR(S) : Akira Higeta et al.

It is certified that error appears in the above-identified patent and that said Letters Patent is hereby corrected as shown below:

Column 27,
Line 2, "this" should read -- is --.
Line 3, "Figure." should read -- Figure). --
Line 34, "transmitting" should read -- transmitted --.
Line 49, "face to" should read -- facing --.
Line 53, "compressed," should read -- is compressed, --.
Line 55, "it extending" should read -- is extended --.

Column 28,
Line 1, "cartridges" should read -- cartridge is --.
Line 55, "position," should read -- positioned, --.

Column 29,
Line 46, "FIG. 26" (second occurrence) should be deleted.

Column 32,
Line 46, "portion. 19" should read -- portion 19 --.

Column 33,
Line 1, "the couple" should read -- to couple --.

Column 34,
Line 47, "there" should read -- therebetween --.
Line 48, "between" should be deleted, and "two" should read -- to --.
Line 60, "position" should read -- positioned --.

Column 35,
Line 42, "charged" should read -- charge --.

Column 40,
Line 62, "one" should read -- or --.

Column 41,
Line 41, "is to" should read -- must -- , and "how to" should read -- after --.
Line 46, "of them" should be deleted.

UNITED STATES PATENT AND TRADEMARK OFFICE

CERTIFICATE OF CORRECTION

PATENT NO. : 6,519,430 B2 
DATED : February 11, 2003
INVENTOR(S) : Akira Higeta et al.

It is certified that error appears in the above-identified patent and that said Letters Patent is hereby corrected as shown below:

Column 42,
Line 13, "necessary" should read -- necessarily --.
Lines 30 and 31, "image is," should read -- images, --.
Line 40, "charged" should read -- charge --.
Line 63, "a facsimile machine," should be deleted.

Column 46,
Line 24, "mount ed" should read -- mounted --.
Lines 28 and 34, "claim 19" should read -- claim 19, --.
Line 57, "claim 19 or 25" should read -- claim 19 or 25, --.

Column 48
Line 12, "fist" should read -- first --.

Column 52,
Line 6, "mounted" should read -- mounted to --.

Signed and Sealed this

Second Day of December, 2003

JAMES E. ROGAN
*Director of the United States Patent and Trademark Office*